US011117028B2

(12) United States Patent
Parsons et al.

(10) Patent No.: US 11,117,028 B2
(45) Date of Patent: Sep. 14, 2021

(54) GOLF CLUB HEADS AND METHODS TO MANUFACTURE GOLF CLUB HEADS

(71) Applicant: Parsons Xtreme Golf, LLC, Scottsdale, AZ (US)

(72) Inventors: Robert R. Parsons, Scottsdale, AZ (US); Bradley D. Schweigert, Cave Creek, AZ (US); Michael R. Nicolette, Scottsdale, AZ (US); Caleb S. Kroloff, Phoenix, AZ (US); Matthew T. Andrews, Scottsdale, AZ (US); Daniel C. Kirtley, Scottsdale, AZ (US)

(73) Assignee: Parsons Xtreme Golf, LLC, Scottsdale, AZ (US)

( * ) Notice: Subject to any disclaimer, the term of this patent is extended or adjusted under 35 U.S.C. 154(b) by 0 days.

(21) Appl. No.: 17/225,414

(22) Filed: Apr. 8, 2021

(65) Prior Publication Data

US 2021/0220710 A1 Jul. 22, 2021

Related U.S. Application Data

(63) Continuation-in-part of application No. 17/205,887, filed on Mar. 18, 2021, which is a continuation of (Continued)

(51) Int. Cl.
*A63B 53/04* (2015.01)
*A63B 60/02* (2015.01)
(Continued)

(52) U.S. Cl.
CPC ..... *A63B 53/0466* (2013.01); *A63B 53/04* (2013.01); *A63B 60/02* (2015.10);
(Continued)

(58) Field of Classification Search
CPC ..... A63B 53/0454; A63B 53/0458; A63B 53/0462; A63B 53/0416; A63B 53/0466;
(Continued)

(56) References Cited

U.S. PATENT DOCUMENTS 1,133,129 A 3/1915 Govan
1,269,745 A 6/1918 Robertson
(Continued)

OTHER PUBLICATIONS

PCT/US15/42484: International Search Report and Written Opinion dated Oct. 19, 2015 (12 Pages).
(Continued)

*Primary Examiner* — Benjamin Layno

(57) ABSTRACT

Embodiments of golf club heads and methods to manufacture golf club heads are generally described herein. In one example, a golf club head may include a body portion having a top portion, a bottom portion, a toe portion, a heel portion, a front portion, and a rear portion. The front portion may include an exterior surface and an interior surface. A wall structure may be located inside the body portion and may be spaced apart from the interior surface of the front portion to form a channel therebetween. A filler material may be disposed inside the channel and may compress against the wall structure when the face portion strikes a golf ball. Other examples and embodiments may be described and claimed.

20 Claims, 35 Drawing Sheets

Related U.S. Application Data application No. 16/820,366, filed on Mar. 16, 2020, now Pat. No. 10,981,037, which is a continuation of application No. 16/418,691, filed on May 21, 2019, now Pat. No. 10,653,928, and a continuation-in-part of application No. 16/375,553, filed on Apr. 4, 2019, now Pat. No. 10,695,623, and a continuation-in-part of application No. 16/372,009, filed on Apr. 1, 2019, now Pat. No. 10,821,334, and a continuation-in-part of application No. 16/290,610, filed on Mar. 1, 2019, now Pat. No. 10,617,918, which is a continuation of application No. 15/875,496, filed on Jan. 19, 2018, now Pat. No. 10,252,123, which is a continuation of application No. 15/457,627, filed on Mar. 13, 2017, now Pat. No. 9,895,583, which is a continuation of application No. 15/189,806, filed on Jun. 22, 2016, now Pat. No. 9,636,554, which is a continuation of application No. 14/667,546, filed on Mar. 24, 2015, now Pat. No. 9,399,158, which is a continuation-in-part of application No. 14/615,606, filed on Feb. 6, 2015, now Pat. No. 9,199,140, application No. 17/225,414, which is a continuation-in-part of application No. 17/198,770, filed on Mar. 11, 2021, which is a continuation of application No. 16/807,591, filed on Mar. 3, 2020, now Pat. No. 10,960,274, application No. 17/225,414, which is a continuation-in-part of application No. 17/198,906, filed on Mar. 11, 2021, which is a continuation of application No. 16/813,453, filed on Mar. 9, 2020, now Pat. No. 10,967,231, application No. 17/225,414, which is a continuation-in-part of application No. 17/155,486, filed on Jan. 22, 2021, which is a continuation of application No. 16/774,449, filed on Jan. 28, 2020, now Pat. No. 10,926,142, which is a continuation of application No. 16/179,406, filed on Nov. 2, 2018, now Pat. No. 10,583,336, application No. 17/225,414, which is a continuation-in-part of application No. 17/149,954, filed on Jan. 15, 2021, and a continuation-in-part of application No. 17/138,797, filed on Dec. 30, 2020, which is a continuation of application No. 16/542,548, filed on Aug. 16, 2019, now Pat. No. 10,898,766, which is a continuation-in-part of application No. 16/222,580, filed on Dec. 17, 2018, now Pat. No. 10,722,764, and a continuation of application No. 15/967,098, filed on Apr. 30, 2018, now Pat. No. 10,420,989, and a continuation of application No. 15/831,148, filed on Dec. 4, 2017, now Pat. No. 10,195,501, which is a continuation of application No. 15/453,701, filed on Mar. 8, 2017, now Pat. No. 9,833,667, application No. 17/225,414, which is a continuation-in-part of application No. 16/930,716, filed on Jul. 16, 2020, which is a continuation of application No. 16/422,661, filed on May 24, 2019, now Pat. No. 10,722,765, application No. 17/225,414, which is a continuation-in-part of application No. 16/889,524, filed on Jun. 1, 2020, which is a continuation-in-part of application No. 16/533,352, filed on Aug. 6, 2019, now Pat. No. 10,843,051, and a continuation of application No. 16/419,639, filed on May 22, 2019, now Pat. No. 10,695,624, which is a continuation of application No. 16/234,169, filed on Dec. 27, 2018, now Pat. No. 10,376,754, which is a continuation of application No. 16/205,583, filed on Nov. 30, 2018, now abandoned, application No. 17/225,414, which is a continuation-in-part of application No. 16/815,164, filed on Mar. 11, 2020, which is a continuation of application No. 16/375,553, filed on Apr. 4, 2019, now Pat. No. 10,695,623, application No. 17/225,414, which is a continuation-in-part of application No. 16/713,942, filed on Dec. 13, 2019, now Pat. No. 11,000,742, which is a continuation of application No. 16/198,128, filed on Nov. 21, 2018, now Pat. No. 10,532,257, which is a continuation of application No. 16/375,553, filed on Apr. 4, 2019, now Pat. No. 10,695,623, which is a continuation of application No. 15/967,117, filed on Apr. 30, 2018, now Pat. No. 10,293,221, which is a continuation of application No. 15/457,618, filed on Mar. 13, 2017, now Pat. No. 9,987,526, which is a continuation of application No. 15/163,393, filed on May 24, 2016, now Pat. No. 9,662,547, which is a continuation of application No. 14/667,541, filed on Mar. 24, 2015, now Pat. No. 9,352,197, which is a continuation-in-part of application No. 14/615,606, filed on Feb. 6, 2015, now Pat. No. 9,199,140, application No. 16/533,352, which is a continuation of application No. 16/030,403, filed on Jul. 9, 2018, now Pat. No. 10,413,787, application No. 16/419,639, which is a continuation-in-part of application No. 15/981,094, filed on May 16, 2018, now Pat. No. 10,384,102, which is a continuation of application No. 15/724,035, filed on Oct. 3, 2017, now Pat. No. 9,999,814, which is a continuation of application No. 15/440,968, filed on Feb. 23, 2017, now Pat. No. 9,795,842, application No. 17/225,414, which is a continuation-in-part of application No. 15/970,665, filed on May 3, 2018, which is a continuation-in-part of application No. 15/808,552, filed on Nov. 9, 2017, now Pat. No. 10,099,093, and a continuation-in-part of application No. 15/807,201, filed on Nov. 8, 2017, now Pat. No. 10,010,770, and a continuation-in-part of application No. 15/725,900, filed on Oct. 5, 2017, now Pat. No. 10,052,532, and a continuation-in-part of application No. 15/724,035, filed on Oct. 3, 2017, now Pat. No. 9,999,814, and a continuation of application No. 15/667,343, filed on Aug. 2, 2017, now Pat. No. 10,213,659, and a continuation-in-part of application No. 15/477,972, filed on Apr. 3, 2017, now Pat. No. 9,914,029, which is a continuation of application No. 15/406,408, filed on Jan. 13, 2017, now Pat. No. 9,861,867, application No. 16/375,553, which is a continuation of application No. 15/967,117, filed on Apr. 30, 2018, now Pat. No. 10,293,221, which is a continuation of application No. 15/457,618, filed on Mar. 13, 2017, now Pat. No. 9,987,526, which is a continuation of application No. 15/163,393, filed on May 24, 2016, now Pat. No. 9,662,547, application No. 16/372,009, which is a continuation of application No. 15/875,416, filed on Jan. 19, 2018, now Pat. No. 10,293,220, which is a continuation of application No. 15/446,842, filed on Mar. 1, 2017, now Pat. No. 9,895,582, which is a continuation of application No. 15/377,120, filed on Dec. 13, 2016, now Pat. No. 9,802,087, which is a continuation of application No. 14/939,849, filed on Nov. 12, 2015, now Pat. No. 9,555,295, which is a continuation of application No. 14/615,606, filed on Feb. 6, 2015, now Pat. No. 9,199,140, application No. 16/418,691, which is a continuation of application No. 15/803,157, filed on Nov. 3, 2017, now Pat. No. 10,335,645, which is a continuation of application No. 15/290,859, filed on Oct. 11, 2016, now Pat. No. 9,814,945, which is a continuation of application No. 15/040,892, filed on Feb. 10, 2016, now Pat. No. 9,550,096, application No. 15/967,098, which is a continuation of application No. 15/687,273, filed on Aug. 25, 2017, now Pat. No. 9,981,160, application No. 16/198,128, which is a continuation of application No. 15/583,756, filed on May 1, 2017, now Pat. No. 10,143,899, which is a continuation of application No. 15/271,574, filed on Sep. 21, 2016, now Pat. No. 9,669,270, application No. 15/808,552, which is a continuation of application No. 15/492,711, filed on Apr. 20, 2017, now Pat. No. 9,821,201, application No. 15/807,201, which is a continuation of application No. 15/463,306, filed on Mar. 20, 2017, now Pat. No. 9,821,200, which is a continuation of application No. 15/249,857, filed on Aug. 29, 2016, now Pat. No. 9,630,070, said application No. 15/725,900 is a continuation of application No. 15/445,253, filed on Feb. 28, 2017, now Pat. No. 9,795,843, which is a continuation of application No. 15/227,281, filed on Aug. 3, 2016, now Pat. No. 9,782,643.

(60) Provisional application No. 63/057,252, filed on Jul. 27, 2020, provisional application No. 63/010,036, filed on Apr. 14, 2020, provisional application No. 62/963,430, filed on Jan. 20, 2020, provisional application No. 62/957,757, filed on Jan. 6, 2020, provisional application No. 62/897,015, filed on Sep. 6, 2019, provisional application No. 62/873,773, filed on Jul. 12, 2019, provisional application No. 62/850,292, filed on May 20, 2019, provisional application No. 62/837,592, filed on Apr. 23, 2019, provisional application No. 62/820,728, filed on Mar. 19, 2019, provisional application No. 62/816,418, filed on Mar. 11, 2019, provisional application No. 62/786,371, filed on Dec. 29, 2018, provisional application No. 62/772,669, filed on Nov. 29, 2018, provisional application No. 62/751,456, filed on Oct. 26, 2018, provisional application No. 62/745,113, filed on Oct. 12, 2018, provisional application No. 62/740,355, filed on Oct. 2, 2018, provisional application No. 62/734,922, filed on Sep. 21, 2018, provisional application No. 62/734,176, filed on Sep. 20, 2018, provisional application No. 62/676,860, filed on May 25, 2018, provisional application No. 62/662,112, filed on Apr. 24, 2018, provisional application No. 62/655,437, filed on Apr. 10, 2018, provisional application No. 62/624,294, filed on Jan. 31, 2018, provisional application No. 62/621,948, filed on Jan. 25, 2018, provisional application No. 62/581,456, filed on Nov. 3, 2017, provisional application No. 62/530,734, filed on Jul. 10, 2017, provisional application No. 62/512,275, filed on May 30, 2017, provisional application No. 62/445,878, filed on Jan. 13, 2017, provisional application No. 62/444,671, filed on Jan. 10, 2017, provisional application No. 62/419,242, filed on Nov. 8, 2016, provisional application No. 62/412,389, filed on Oct. 25, 2016, provisional application No. 62/406,856, filed on Oct. 11, 2016, provisional application No. 62/380,727, filed on Aug. 29, 2016, provisional application No. 62/362,491, filed on Jul. 14, 2016, provisional application No. 62/361,988, filed on Jul. 13, 2016, provisional application No. 62/360,802, filed on Jul. 11, 2016, provisional application No. 62/356,539, filed on Jun. 30, 2016, provisional application No. 62/337,184, filed on May 16, 2016, provisional application No. 62/329,662, filed on Apr. 29, 2016, provisional application No. 62/301,756, filed on Mar. 1, 2016, provisional application No. 62/296,506, filed on Feb. 17, 2016, provisional application No. 62/291,793, filed on Feb. 5, 2016, provisional application No. 62/281,639, filed on Jan. 21, 2016, provisional application No. 62/195,211, filed on Jul. 21, 2015, provisional application No. 62/194,135, filed on Jul. 17, 2015, provisional application No. 62/184,757, filed on Jun. 25, 2015, provisional application No. 62/138,918, filed on Mar. 26, 2015, provisional application No. 62/120,760, filed on Feb. 25, 2015, provisional application No. 62/115,024, filed on Feb. 11, 2015, provisional application No. 62/109,510, filed on Jan. 29, 2015, provisional application No. 62/105,123, filed on Jan. 19, 2015, provisional application No. 62/101,543, filed on Jan. 9, 2015, provisional application No. 62/048,693, filed on Sep. 10, 2014, provisional application No. 62/042,155, filed on Aug. 26, 2014.

(51) Int. Cl.
*A63B 53/06* (2015.01)
*A63B 60/54* (2015.01)

(52) U.S. Cl.
CPC ..... *A63B 53/0408* (2020.08); *A63B 53/0412* (2020.08); *A63B 53/0416* (2020.08); *A63B 53/0433* (2020.08); *A63B 53/0454* (2020.08); *A63B 53/0458* (2020.08); *A63B 53/0462* (2020.08); *A63B 53/06* (2013.01); *A63B 60/54* (2015.10); *A63B 2053/0491* (2013.01); *A63B 2209/00* (2013.01)

(58) Field of Classification Search
CPC . A63B 53/0408; A63B 2209/00; A63B 60/54; A63B 53/04
USPC ..... 473/332, 342, 345, 346, 349, 350
See application file for complete search history.

(56) References Cited

U.S. PATENT DOCUMENTS

| | | | | |
|---|---|---|---|---|
| 1,306,029 | A | 6/1919 | Robertson | |
| D55,864 | S | 7/1920 | Jenkins | |
| D55,867 | S | 7/1920 | Matters | |
| 1,534,600 | A | 4/1925 | Mattern | |
| 1,538,312 | A | 5/1925 | Neish | |
| D138,437 | S | 8/1944 | Link | |
| D138,438 | S | 8/1944 | Link | |
| D138,442 | S | 8/1944 | Link | |
| 3,556,533 | A | 1/1971 | Hollis | |
| 3,652,094 | A | 3/1972 | Glover | |
| D240,748 | S | 7/1976 | Bock et al. | |
| 4,085,934 | A | 4/1978 | Churchward | |
| D253,778 | S | 12/1979 | Madison | |
| 4,754,977 | A | 7/1988 | Sahm | |
| D307,783 | S | 5/1990 | Iinuma | |
| 5,106,094 | A | 4/1992 | Desbiolles et al. | |
| D326,885 | S | 6/1992 | Paul | |
| 5,219,408 | A | 6/1993 | Sun | |
| D351,883 | S | 10/1994 | Solheim et al. | |
| 5,351,958 | A | 10/1994 | Helmstetter | |
| 5,447,311 | A | 9/1995 | Viollaz et al. | |
| 5,467,983 | A * | 11/1995 | Chen | A63B 53/04 473/342 |
| 5,499,819 | A | 3/1996 | Nagamoto | |
| 5,518,243 | A | 5/1996 | Redman | |

(56) References Cited

U.S. PATENT DOCUMENTS

D378,111 S 2/1997 Parente et al.
5,624,331 A 4/1997 Lo et al.
D384,120 S 9/1997 Cruz et al.
5,788,584 A 8/1998 Parente et al.
D400,625 S 11/1998 Kubica et al.
D400,627 S 11/1998 Kubica et al.
D405,489 S 2/1999 Kubica et al.
D405,492 S 2/1999 Kubica et al.
D405,498 S 2/1999 Laney
5,997,415 A 12/1999 Wood
6,146,287 A 11/2000 Rugge et al.
D444,830 S 7/2001 Kubica et al.
6,280,349 B1 8/2001 Cook
6,290,609 B1 9/2001 Takeda
6,306,048 B1 10/2001 McCabe et al.
6,409,612 B1 6/2002 Evans et al.
6,568,248 B1 5/2003 Guieze et al.
D478,140 S 8/2003 Burrows
6,607,451 B2 8/2003 Kosmatka et al.
6,638,182 B2 10/2003 Kosmatka
6,773,360 B2 8/2004 Willett et al.
6,811,496 B2 11/2004 Wahl et al.
D508,969 S 8/2005 Hasebe
6,969,326 B2 11/2005 Shiell et al.
D513,051 S 12/2005 Barez et al.
6,979,270 B1 12/2005 Allen
D514,179 S 1/2006 Chen et al.
D514,185 S 1/2006 Barez et al.
6,991,560 B2 1/2006 Tseng
D520,586 S 5/2006 Bingman
D522,077 S 5/2006 Schweigert et al.
D522,601 S 6/2006 Schweigert et al.
D523,498 S 6/2006 Chen et al.
D526,694 S 8/2006 Schweigert et al.
7,083,530 B2 8/2006 Wahl et al.
7,121,956 B2 10/2006 Lo
D534,599 S 1/2007 Barez et al.
7,166,040 B2 1/2007 Hoffman et al.
D536,401 S 2/2007 Kawami
D536,403 S 2/2007 Kawami
7,186,190 B1 3/2007 Beach et al.
7,214,142 B2 5/2007 Meyer et al.
7,223,180 B2 5/2007 Willett et al.
7,261,646 B2 8/2007 Shiell et al.
7,281,994 B2 10/2007 Shiell et al.
7,303,486 B2 12/2007 Imamoto
D563,498 S 3/2008 Jertson et al.
D564,054 S 3/2008 Jertson et al.
D564,055 S 3/2008 Jertson et al.
7,338,388 B2 3/2008 Schweigert et al.
7,347,794 B2 3/2008 Schweigert
D566,934 S 4/2008 Valle
D567,317 S 4/2008 Jertson et al.
D569,933 S 5/2008 Jertson et al.
D569,934 S 5/2008 Jertson et al.
D569,935 S 5/2008 Schweigert et al.
D569,936 S 5/2008 Schweigert et al.
D569,942 S 5/2008 Jertson et al.
D570,937 S 6/2008 Schweigert et al.
D570,938 S 6/2008 Jertson et al.
7,407,447 B2 8/2008 Beach et al.
7,410,425 B2 8/2008 Willett et al.
7,410,426 B2 8/2008 Willett et al.
7,419,441 B2 9/2008 Hoffman et al.
7,435,190 B2 10/2008 Sugimoto
7,448,963 B2 11/2008 Beach et al.
7,448,964 B2 11/2008 Schweigert et al.
7,494,425 B2 2/2009 Shiell et al.
7,527,565 B1 5/2009 Ehlers et al.
7,530,904 B2 5/2009 Beach et al.
D594,520 S 6/2009 Schweigert et al.
D594,521 S 6/2009 Jertson et al.
D594,919 S 6/2009 Schweigert et al.
7,540,811 B2 6/2009 Beach et al.
D597,620 S 8/2009 Taylor et al.
7,568,985 B2 8/2009 Beach et al.
7,578,753 B2 8/2009 Beach et al.
D600,297 S 9/2009 Jertson et al.
7,584,531 B2 9/2009 Schweigert et al.
7,588,502 B2 9/2009 Nishino
7,591,738 B2 9/2009 Beach et al.
D603,472 S 11/2009 Schweigert et al.
7,611,424 B2 11/2009 Nagai et al.
7,621,823 B2 11/2009 Beach et al.
D605,715 S 12/2009 Barez et al.
7,632,194 B2 12/2009 Beach et al.
7,641,568 B2 1/2010 Hoffman et al.
7,658,666 B2 2/2010 Sung
7,658,686 B2 2/2010 Soracco
7,713,142 B2 5/2010 Hoffman et al.
7,717,804 B2 5/2010 Beach et al.
7,717,805 B2 5/2010 Beach et al.
D618,746 S 6/2010 Jertson et al.
D618,747 S 6/2010 Schweigert et al.
D618,753 S 6/2010 Jertson et al.
D618,754 S 6/2010 Schweigert et al.
7,744,484 B1 6/2010 Chao
7,798,203 B2 9/2010 Schweigert et al.
7,846,041 B2 12/2010 Beach et al.
D635,626 S 4/2011 Nicolette
D636,893 S 4/2011 Nicholls et al.
D636,896 S 4/2011 Gemma
7,927,229 B2 4/2011 Jertson et al.
D638,893 S 5/2011 Schweigert et al.
D638,896 S 5/2011 Schweigert et al.
7,963,861 B2 6/2011 Beach et al.
8,007,369 B2 8/2011 Soracco
8,012,038 B1 9/2011 Beach et al.
D647,585 S 10/2011 Jertson et al.
8,088,025 B2 1/2012 Wahl et al.
8,096,896 B2 1/2012 Schiell et al.
D661,751 S 6/2012 Nicolette et al.
D661,756 S 6/2012 Nicolette et al.
8,197,357 B1 6/2012 Rice et al.
8,202,175 B2 6/2012 Ban
8,216,087 B2 7/2012 Breier et al.
8,257,196 B1 9/2012 Abbott et al.
8,257,197 B2 9/2012 Schweigert
8,262,506 B2 9/2012 Watson et al.
8,287,402 B2 10/2012 Shiell et al.
D673,630 S 1/2013 Schweigert
D673,632 S 1/2013 Schweigert et al.
8,353,783 B2 1/2013 Soracco
8,353,787 B2 1/2013 Meyer et al.
8,371,957 B2 2/2013 Schweigert et al.
D680,179 S 4/2013 Solheim et al.
8,409,028 B2 4/2013 Wahl et al.
8,414,422 B2 4/2013 Peralta et al.
8,444,506 B2 5/2013 Watson et al.
8,480,512 B2 * 7/2013 Oldknow ..... A63B 53/0466 473/324
8,485,919 B2 7/2013 Rice et al.
8,540,590 B2 9/2013 Tsukada et al.
D691,230 S 10/2013 Chen et al.
8,562,457 B2 10/2013 Beach et al.
8,568,248 B2 10/2013 DeShiell et al.
8,608,587 B2 12/2013 Henrikson et al.
8,628,431 B2 1/2014 Schweigert et al.
8,651,975 B2 2/2014 Soracco
8,663,026 B2 3/2014 Blowers et al.
8,777,778 B2 7/2014 Solheim et al.
8,784,232 B2 7/2014 Jertson et al.
8,790,196 B2 7/2014 Solheim et al.
8,808,108 B2 8/2014 Schweigert
D712,989 S 9/2014 Gillig
8,826,512 B2 9/2014 Schweigert
8,858,362 B1 10/2014 Leposky et al.
8,961,336 B1 2/2015 Parsons et al.
D724,164 S 3/2015 Schweigert et al.
8,979,671 B1 3/2015 Demille et al.
D729,892 S 5/2015 Nicolette et al.
D733,234 S 6/2015 Nicolette
9,192,830 B2 11/2015 Parsons et al.
9,199,140 B1 12/2015 Schweigert et al.

(56) References Cited

U.S. PATENT DOCUMENTS 9,199,143 B1 12/2015 Parsons et al.
D753,251 S 4/2016 Schweigert et al.
D756,471 S 5/2016 Nicolette et al.
9,345,938 B2 5/2016 Parsons et al.
9,352,197 B2 5/2016 Parsons et al.
D760,334 S 6/2016 Schweigert et al.
9,399,157 B2 7/2016 Greensmith et al.
9,399,158 B2 7/2016 Parsons et al.
9,399,352 B2 7/2016 Mizutani et al.
9,427,634 B2 8/2016 Parsons et al.
9,452,325 B2 9/2016 DeShiell et al.
9,550,096 B2 1/2017 Parsons et al.
9,555,294 B2 1/2017 Henrikson et al.
9,555,295 B2 1/2017 Schweigert et al.
9,630,070 B2 4/2017 Parsons et al.
9,636,554 B2 5/2017 Parsons et al.
9,662,547 B2 5/2017 Parsons et al.
9,669,270 B2 6/2017 Schweigert et al.
9,682,295 B1 6/2017 Dawson et al.
9,782,643 B2 10/2017 Parsons et al.
9,795,842 B1 10/2017 Parsons et al.
9,795,843 B2 10/2017 Parsons et al.
9,802,087 B2 10/2017 Schweigert et al.
9,814,945 B2 11/2017 Parsons et al.
9,821,200 B1 11/2017 Parsons et al.
9,821,201 B1 11/2017 Parsons et al.
9,833,667 B1 12/2017 Parsons et al.
9,839,817 B1 * 12/2017 Johnson ..... A63B 60/02
9,839,821 B2 12/2017 DeShiell et al.
9,861,867 B2 1/2018 Parsons et al.
9,895,582 B2 2/2018 Schweigert et al.
9,895,583 B2 2/2018 Parsons et al.
9,914,029 B2 3/2018 Parsons et al.
9,981,160 B2 5/2018 Parsons et al.
9,987,526 B2 6/2018 Parsons et al.
9,999,814 B2 6/2018 Parsons et al.
10,010,770 B2 7/2018 Parsons et al.
10,052,532 B2 8/2018 Parsons et al.
10,099,093 B2 10/2018 Parsons et al.
10,143,899 B2 12/2018 Schweigert et al.
10,195,101 B1 2/2019 Novak
10,213,659 B2 2/2019 Parsons et al.
10,232,234 B2 3/2019 Parsons et al.
10,252,123 B2 4/2019 Parsons et al.
10,293,220 B2 5/2019 Schweigert et al.
10,293,221 B2 5/2019 Parsons et al.
10,335,645 B2 7/2019 Parsons et al.
10,376,754 B2 8/2019 Parsons et al.
10,384,102 B2 8/2019 Parsons et al.
10,413,787 B2 9/2019 Parsons et al.
10,420,989 B2 9/2019 Parsons et al.
10,420,990 B2 9/2019 Parsons et al.
10,441,855 B2 10/2019 Parsons et al.
10,532,257 B2 1/2020 Schweigert et al.
10,543,407 B2 1/2020 Parsons et al.
10,583,336 B2 * 3/2020 Parsons ..... A63B 60/02
10,617,917 B2 4/2020 Parsons et al.
10,617,918 B2 4/2020 Parsons et al.
10,653,928 B2 5/2020 Parsons et al.
10,695,623 B2 6/2020 Parsons et al.
10,695,624 B2 6/2020 Parsons et al.
10,709,942 B2 7/2020 Parsons et al.
10,722,764 B2 7/2020 Parsons et al.
10,722,765 B2 7/2020 Schweigert et al.
10,786,712 B2 9/2020 Parsons et al.
10,821,334 B2 11/2020 Schweigert et al.
10,843,051 B2 11/2020 Parsons et al.
10,898,766 B2 1/2021 Parsons et al.
10,898,768 B2 1/2021 Parsons et al.
10,926,142 B2 2/2021 Parsons et al.
10,967,231 B2 * 4/2021 Parsons ..... A63B 53/04
2002/0019265 A1 2/2002 Allen
2003/0027662 A1 2/2003 Werner et al.
2003/0104878 A1 6/2003 Yabu
2003/0148818 A1 8/2003 Myrhum et al.
2004/0033846 A1 2/2004 Caldwell
2004/0043833 A1 3/2004 Galloway et al.
2004/0087388 A1 5/2004 Beach et al.
2004/0152539 A1 8/2004 Yabu
2004/0192468 A1 9/2004 Onoda et al.
2004/0209704 A1 10/2004 Mahaffey
2005/0096154 A1 5/2005 Chen
2005/0101408 A1 5/2005 Sanchez et al.
2005/0192116 A1 9/2005 Imamoto
2005/0215349 A1 9/2005 Huang et al.
2005/0250596 A1 11/2005 Chuang
2006/0015049 A1 1/2006 Suarez et al.
2006/0052181 A1 3/2006 Serrano et al.
2006/0052185 A1 3/2006 Kawaguchi et al.
2006/0100031 A1 5/2006 Lan
2006/0105856 A1 5/2006 Lo
2006/0111200 A1 5/2006 Poynor
2007/0004527 A1 1/2007 Helmstetter
2007/0129161 A1 6/2007 Matsunaga et al.
2007/0238551 A1 10/2007 Yokota
2007/0293344 A1 12/2007 Davis
2008/0004133 A1 1/2008 Schweigert
2008/0015049 A1 1/2008 Imamoto
2008/0188322 A1 8/2008 Anderson et al.
2008/0261715 A1 10/2008 Carter
2009/0029795 A1 1/2009 Schweigert et al.
2009/0088269 A1 4/2009 Beach et al.
2009/0131199 A1 * 5/2009 Gilbert ..... A63B 60/54 473/332
2010/0075774 A1 3/2010 Ban
2010/0144461 A1 6/2010 Ban
2010/0167837 A1 7/2010 Ban
2010/0323812 A1 12/2010 Boyd et al.
2010/0331102 A1 12/2010 Golden et al.
2011/0143858 A1 6/2011 Peralta et al.
2012/0094782 A1 4/2012 Beach et al.
2012/0142445 A1 6/2012 Burnett et al.
2012/0190479 A1 7/2012 Rice et al.
2012/0202615 A1 8/2012 Beach et al.
2012/0220387 A1 8/2012 Beach et al.
2013/0130826 A1 5/2013 Soracco
2013/0210542 A1 8/2013 Harbert et al.
2013/0303304 A1 11/2013 Sato
2013/0318772 A1 12/2013 Wahl et al.
2013/0324281 A1 12/2013 Boyd et al.
2014/0187346 A1 7/2014 Beno et al.
2014/0235369 A1 8/2014 Willett et al.
2014/0349779 A1 11/2014 Mizutani
2015/0018123 A1 1/2015 Cole et al.
2015/0126305 A1 5/2015 Stokke et al.
2015/0231454 A1 8/2015 Parsons et al.
2015/0231458 A1 8/2015 Petersen et al.
2015/0231806 A1 8/2015 Parsons et al.
2015/0290503 A1 10/2015 Su
2015/0360098 A1 12/2015 Parsons et al.
2016/0038799 A1 2/2016 Cruz et al.
2016/0059088 A1 3/2016 Parsons et al.
2016/0059090 A1 3/2016 Parsons et al.
2016/0256753 A1 9/2016 Westrum et al.
2016/0339308 A1 11/2016 Parsons et al.
2017/0312592 A1 11/2017 Parsons et al.
2018/0056144 A1 3/2018 Parsons et al.
2018/0221725 A1 * 8/2018 Westrum ..... A63B 53/04
2018/0296885 A1 10/2018 Nakamura
2018/0296887 A1 10/2018 Motokawa
2020/0206587 A1 7/2020 Parsons et al.
2020/0215397 A1 7/2020 Parsons et al.
2020/0230471 A1 7/2020 Parsons et al.

OTHER PUBLICATIONS

PCT/US16/17474: International Search Report and Written Opinion dated May 12, 2016 (9 Pages).
PCT/US17/28402: International Search Report and Written Opinion dated Jul. 18, 2017 (10 Pages).
PCT/US17/55155: International Search Report and Written Opinion dated Jan. 25, 2018 (9 Pages).

(56) References Cited

OTHER PUBLICATIONS

PCT/US19/17464: International Search Report and Written Opinion dated Apr. 29, 2019 (9 Pages).
PCT/US19/54104: International Search Report and Written Opinion dated Dec. 30, 2019 (10 Pages).
PCT/US2015/016666: International Search Report and Written Opinion dated May 14, 2015 (8 Pages).
PCT/US2015/042282: International Search Report and Written Opinion dated Oct. 13, 2015 (12 Pages).
PCT/US2017/013513: International Search Report and Written Opinion dated Mar. 17, 2017 (18 Pages).
PCT/US2019/026099: International Search Report and Written Opinion dated May 7, 2019 (7 pages).
PCT/US2020/021869: International Search Report and Written Opinion dated May 14, 2020 (12 Pages).
Spotted: Three New PXG Drivers Appear on the USGA Conforming List (GOLFWRX). Dec. 18, 2017. Retrieved From the Internet on Jan. 16, 2019. URL:http://www.golfwrx.com/482592/spotted-three-new-pxg-drivers-appear-on-the-usga-conforming-list/.
U.S. Appl. No. 29/512,313, Nicolette, "Golf Club Head," filed Dec. 18, 2018.
Wall, Jonathan, "Details: Phil's Prototype Mack Daddy PM-Grind Wedge," (http://www.pgatour.com/equipmentreport/2015/01/21/callaway-wedge.html), www.pgatour.com, PGA Tour, Inc., Published Jan. 21, 2015.

* cited by examiner

GOLF CLUB HEADS AND METHODS TO MANUFACTURE GOLF CLUB HEADS

CROSS REFERENCE

This application is a continuation-in-part of application Ser. No. 16/815,164, filed Mar. 11, 2020, which is a continuation of application Ser. No. 16/375,553, filed Apr. 4, 2019, now U.S. Pat. No. 10,695,623, which is a continuation of application Ser. No. 15/967,117, filed Apr. 30, 2018, now U.S. Pat. No. 10,293,221, which is a continuation application Ser. No. 15/457,618, filed Mar. 13, 2017, now U.S. Pat. No. 9,987,526, which is a continuation of application Ser. No. 15/163,393, filed May 24, 2016, now U.S. Pat. No. 9,662,547, which is a continuation of application Ser. No. 14/667,541, filed Mar. 24, 2015, now U.S. Pat. No. 9,352,197, which is a continuation-in-part of application Ser. No. 14/615,606, filed Feb. 6, 2015, now U.S. Pat. No. 9,199,140, which claims the benefit of U.S. Provisional Application No. 62/042,155, filed Aug. 26, 2014, U.S. Provisional Application No. 62/048,693, filed Sep. 10, 2014, U.S. Provisional Application No. 62/101,543, filed Jan. 9, 2015, U.S. Provisional Application No. 62/105,123, filed Jan. 19, 2015, and U.S. Provisional Application No. 62/109,510, filed Jan. 29, 2015.

This application is a continuation-in-part of application Ser. No. 17/205,887, filed Mar. 18, 2021, which is a continuation of application Ser. No. 16/820,366, filed Mar. 16, 2020, which is a continuation of application Ser. No. 16/418,691, filed May 21, 2019, now U.S. Pat. No. 10,653,928, which is a continuation of application Ser. No. 15/803,157, filed Nov. 3, 2017, now U.S. Pat. No. 10,335,645, which is a continuation of application Ser. No. 15/290,859, filed Oct. 11, 2016, now U.S. Pat. No. 9,814,945, which is a continuation of application Ser. No. 15/040,892, filed Feb. 10, 2016, now U.S. Pat. No. 9,550,096, which claims the benefit of U.S. Provisional Application No. 62/115,024, filed Feb. 11, 2015, U.S. Provisional Application No. 62/120,760, filed Feb. 25, 2015, U.S. Provisional Application No. 62/138,918, filed Mar. 26, 2015, U.S. Provisional Application No. 62/184,757, filed Jun. 25, 2015, U.S. Provisional No. 62/194,135, filed Jul. 17, 2015, and U.S. Provisional Application No. 62/195,211, filed Jul. 21, 2015.

U.S. application Ser. No. 16/820,366, filed Mar. 16, 2020, is a continuation-in-part of application Ser. No. 16/372,009, filed Apr. 1, 2019, now U.S. Pat. No. 10,821,334, which is a continuation of application Ser. No. 15/875,416, filed Jan. 19, 2018, now U.S. Pat. No. 10,293,220, which is a continuation of application Ser. No. 15/446,842, filed Mar. 1, 2017, now U.S. Pat. No. 9,895,582, which is a continuation of application Ser. No. 15/377,120, filed Dec. 13, 2016, now U.S. Pat. No. 9,802,087, which is a continuation of application Ser. No. 14/939,849, filed Nov. 12, 2015, now U.S. Pat. No. 9,555,295, which is a continuation of application Ser. No. 14/615,606, filed Feb. 6, 2015, now U.S. Pat. No. 9,199,140.

U.S. application Ser. No. 16/820,366, filed Mar. 16, 2020, is a continuation-in-part of application Ser. No. 16/290,610, filed Mar. 1, 2019, now U.S. Pat. No. 10,617,918, which is a continuation of application Ser. No. 15/875,496, filed Jan. 19, 2018, now U.S. Pat. No. 10,252,123, which is a continuation of application Ser. No. 15/457,627, filed Mar. 13, 2017, now U.S. Pat. No. 9,895,583, which is a continuation of application Ser. No. 15/189,806, filed Jun. 22, 2016, now U.S. Pat. No. 9,636,554, which is a continuation of application Ser. No. 14/667,546, filed Mar. 24, 2015, now U.S. Pat. No. 9,399,158, which is a continuation-in-part of application Ser. No. 14/615,606, filed Feb. 6, 2015, now U.S. Pat. No. 9,199,140, which claims the benefit of U.S. Provisional Application No. 62/042,155, filed Aug. 26, 2014, U.S. Provisional Application No. 62/048,693, filed Sep. 10, 2014, U.S. Provisional Application No. 62/101,543, filed Jan. 9, 2015, U.S. Provisional Application No. 62/105,123, filed Jan. 19, 2015, and U.S. Provisional Application No. 62/109,510, filed Jan. 29, 2015.

U.S. application Ser. No. 16/820,366, filed Mar. 16, 2020, is a continuation-in-part of application Ser. No. 16/375,553, filed Apr. 4, 2019, now U.S. Pat. No. 10,695,623, which is a continuation of application Ser. No. 15/967,117, filed Apr. 30, 2018, now U.S. Pat. No. 10,293,221, which is a continuation application Ser. No. 15/457,618, filed Mar. 13, 2017, now U.S. Pat. No. 9,987,526, which is a continuation of application Ser. No. 15/163,393, filed May 24, 2016, now U.S. Pat. No. 9,662,547, which is a continuation of application Ser. No. 14/667,541, filed Mar. 24, 2015, now U.S. Pat. No. 9,352,197, which is a continuation-in-part of application Ser. No. 14/615,606, filed Feb. 6, 2015, now U.S. Pat. No. 9,199,140, which claims the benefit of U.S. Provisional Application No. 62/042,155, filed Aug. 26, 2014, U.S. Provisional Application No. 62/048,693, filed Sep. 10, 2014, U.S. Provisional Application No. 62/101,543, filed Jan. 9, 2015, U.S. Provisional Application No. 62/105,123, filed Jan. 19, 2015, and U.S. Provisional Application No. 62/109,510, filed Jan. 29, 2015.

This application is a continuation-in-part application Ser. No. 16/713,942, filed Dec. 13, 2019, which is a continuation of application Ser. No. 16/198,128, filed Nov. 21, 2018, now U.S. Pat. No. 10,532,257, which is a continuation of application Ser. No. 15/583,756, filed May 1, 2017, now U.S. Pat. No. 10,143,899, which is a continuation of application Ser. No. 15/271,574, filed Sep. 21, 2016, now U.S. Pat. No. 9,669,270, which claims the benefit of U.S. Provisional Application No. 62/291,793, filed Feb. 5, 2016.

This application is a continuation-in-part of application Ser. No. 17/138,797, filed Dec. 30, 2020, which is a continuation of application Ser. No. 16/542,548, filed Aug. 16, 2019, now U.S. Pat. No. 10,898,766, which is a continuation of application Ser. No. 15/967,098, filed Apr. 30, 2018, now U.S. Pat. No. 10,420,989, which is a continuation of application Ser. No. 15/687,273, filed Aug. 25, 2017, now U.S. Pat. No. 9,981,160, which claims the benefit of U.S. Provisional Application No. 62/380,727, filed Aug. 29, 2016.

U.S. patent application Ser. No. 16/542,548, filed Aug. 16, 2019 is also a continuation-in-part of application Ser. No. 16/222,580, filed Dec. 17, 2018, now U.S. Pat. No. 10,722,764, which is a continuation of application Ser. No. 15/831,148, filed Dec. 4, 2017, now U.S. Pat. No. 10,195,101, which is a continuation of application Ser. No. 15/453,701, filed Mar. 8, 2017, now U.S. Pat. No. 9,833,667, which claims the benefit of U.S. Provisional Application No. 62/356,539, filed Jun. 30, 2016, and U.S. Provisional Application No. 62/360,802, filed Jul. 11, 2016.

This application is a continuation-in-part of application Ser. No. 15/970,665, filed May 3, 2018, which is a continuation of application Ser. No. 15/667,343, filed Aug. 2, 2017, now U.S. Pat. No. 10,213,659, which claims the benefit of U.S. Provisional Application No. 62/512,275, filed May 30, 2017.

U.S. patent application Ser. No. 15/970,665, filed May 3, 2018, is also a continuation-in-part application Ser. No. 15/808,552, filed Nov. 9, 2017, now U.S. Pat. No. 10,099,093, which is a continuation of application Ser. No. 15/492,711, filed Apr. 20, 2017, now U.S. Pat. No. 9,821,201, which claims the benefit of U.S. Provisional Application No. 62/329,662, filed Apr. 29, 2016.

U.S. patent application Ser. No. 15/970,665, filed May 3, 2018, is also a continuation-in-part of application Ser. No. 15/724,035, filed Oct. 3, 2017, now U.S. Pat. No. 9,999,814 which is a continuation of application Ser. No. 15/440,968, filed Feb. 23, 2017, now U.S. Pat. No. 9,795,842, which claims the benefit of U.S. Provisional Application No. 62/444,671, filed Jan. 10, 2017, and U.S. Provisional Application No. 62/445,878, filed Jan. 13, 2017.

U.S. patent application Ser. No. 15/970,665, filed May 3, 2018, is also a continuation-in-part of application Ser. No. 15/807,201, filed Nov. 8, 2017, now U.S. Pat. No. 10,010,770, which is a continuation of application Ser. No. 15/463,306, filed Mar. 20, 2017, now U.S. Pat. No. 9,821,200, which is a continuation of application Ser. No. 15/249,857, filed Aug. 29, 2016, now U.S. Pat. No. 9,630,070, which claims the benefit of U.S. Provisional Application No. 62/337,184, filed May 16, 2016, and U.S. Provisional Application No. 62/361,988, filed Jul. 13, 2016.

U.S. patent application Ser. No. 15/970,665, filed May 3, 2018, is also a continuation-in-part of application Ser. No. 15/725,900, filed Oct. 5, 2017, now U.S. Pat. No. 10,052,532, which is a continuation of application Ser. No. 15/445,253, filed Feb. 28, 2017, now U.S. Pat. No. 9,795,843, which is a continuation of application Ser. No. 15/227,281, filed Aug. 3, 2016, now U.S. Pat. No. 9,782,643, which claims the benefit of U.S. Provisional Application No. 62/281,639, filed Jan. 21, 2016, U.S. Provisional Application No. 62/296,506, filed Feb. 17, 2016, U.S. Provisional Application No. 62/301,756, filed Mar. 1, 2016, and U.S. Provisional Application No. 62/362,491, filed Jul. 14, 2016.

U.S. patent application Ser. No. 15/970,665, filed May 3, 2018, is also a continuation-in-part of application Ser. No. 15/477,972, filed Apr. 3, 2017, now U.S. Pat. No. 9,914,029, which is a continuation of application Ser. No. 15/406,408, filed Jan. 13, 2017, now U.S. Pat. No. 9,861,867, which claims the benefit of U.S. Provisional Application No. 62/406,856, filed Oct. 11, 2016, U.S. Provisional Application No. 62/412,389, filed Oct. 25, 2016, and U.S. Provisional Application No. 62/419,242, filed Nov. 8, 2016.

This application is a continuation-in-part of application Ser. No. 17/155,486, filed Jan. 22, 2021, which is a continuation of application Ser. No. 16/774,449, filed Jan. 28, 2020, now U.S. Pat. No. 10,926,142, which is a continuation of application Ser. No. 16/179,406, filed Nov. 2, 2018, now U.S. Pat. No. 10,583,336, which claims the benefit of U.S. Provisional Application No. 62/581,456, filed Nov. 3, 2017.

This application is a continuation-in-part of application Ser. No. 16/889,524, filed Jun. 1, 2020, which is a continuation of application Ser. No. 16/419,639, filed May 22, 2019, now U.S. Pat. No. 10,695,624, which is a continuation of application Ser. No. 16/234,169, filed Dec. 27, 2018, now U.S. Pat. No. 10,376,754, which is a continuation of application Ser. No. 16/205,583, filed Nov. 30, 2018, now abandoned, which claims the benefit of U.S. Provisional Application No. 62/662,112, filed Apr. 24, 2018, U.S. Provisional Application No. 62/734,176, filed Sep. 20, 2018, U.S. Provisional Application No. 62/734,922, filed Sep. 21, 2018, U.S. Provisional Application No. 62/740,355, filed Oct. 2, 2018, U.S. Provisional Application No. 62/745,113, filed Oct. 12, 2018, U.S. Provisional Application No. 62/751,456, filed Oct. 26, 2018, U.S. Provisional Application No. 62/772,669, filed Nov. 29, 2018.

U.S. application Ser. No. 16/234,169, filed Dec. 27, 2018, now U.S. Pat. No. 10,376,754, also claims the benefit of U.S. Provisional Application No. 62/621,948, filed Jan. 25, 2018, and U.S. Provisional Application No. 62/655,437, filed Apr. 10, 2018.

U.S. application Ser. No. 16/419,639, filed May 22, 2019, now U.S. Pat. No. 10,695,624, is a continuation-in-part of application Ser. No. 15/981,094, filed May 16, 2018, now U.S. Pat. No. 10,384,102, which is a continuation of application Ser. No. 15/724,035, filed Oct. 3, 2017, now U.S. Pat. No. 9,999,814 which is a continuation of application Ser. No. 15/440,968, filed Feb. 23, 2017, now U.S. Pat. No. 9,795,842, which claims the benefit of U.S. Provisional Application No. 62/444,671, filed Jan. 10, 2017, and U.S. Provisional Application No. 62/445,878, filed Jan. 13, 2017.

U.S. application Ser. No. 16/889,524 is a continuation-in-part of application Ser. No. 16/533,352, filed Aug. 6, 2019, now U.S. Pat. No. 10,843,051, which is a continuation of application Ser. No. 16/030,403, filed Jul. 9, 2018, now U.S. Pat. No. 10,413,787, which claims the benefit of U.S. Provisional Application No. 62/530,734, filed Jul. 10, 2017, and U.S. Provisional Application No. 62/624,294, filed Jan. 31, 2018.

This application is a continuation-in-part of application Ser. No. 16/930,716, filed Jul. 16, 2020, which is a continuation of application Ser. No. 16/422,661, filed May 24, 2019, now U.S. Pat. No. 10,722,765, which claims the benefit of U.S. Provisional Application No. 62/850,292, filed May 20, 2019, U.S. Provisional Application No. 62/676,860, filed May 25, 2018, U.S. Provisional Application No. 62,786,371, filed Dec. 29, 2018, U.S. Provisional Application No. 62/820,728, filed Mar. 19, 2019, U.S. Provisional Application No. 62/816,418, filed Mar. 11, 2019, and U.S. Provisional Application No. 62/837,592, filed Apr. 23, 2019.

This application is a continuation-in-part of application Ser. No. 17/198,906, filed Mar. 11, 2021, which is a continuation of application Ser. No. 16/813,453, filed Mar. 9, 2020, now U.S. Pat. No. 10,967,231, which claims the benefit of U.S. Provisional Application No. 62/816,418, filed Mar. 11, 2019, U.S. Provisional Application No. 62/957,757, filed Jan. 6, 2020, U.S. Provisional Application No. 62/837,592, filed Apr. 23, 2019, U.S. Provisional Application No. 62/873,773, filed Jul. 12, 2019, and U.S. Provisional Application No. 62/897,015, filed Sep. 6, 2019.

This application is a continuation-in-part of application Ser. No. 17/198,770, filed Mar. 11, 2021, which is a continuation of application Ser. No. 16/807,591, filed Mar. 3, 2020, now U.S. Pat. No. 10,960,274, which claims the benefit of U.S. Provisional Application No. 62/837,592, filed Apr. 23, 2019, U.S. Provisional Application No. 62/873,773, filed Jul. 12, 2019, U.S. Provisional Application No. 62/897,015, filed Sep. 6, 2019, U.S. Provisional Application No. 62/820,728, filed Mar. 19, 2019, U.S. Provisional Application No. 62/816,418, filed Mar. 11, 2019, and U.S. Provisional Application No. 62/957,757, filed Jan. 6, 2020.

This application is a continuation-in-part of application Ser. No. 17/149,954, filed Jan. 15, 2021, which claims the benefit of U.S. Provisional Application No. 62/963,430, filed Jan. 20, 2020.

This application claims the benefit of U.S. Provisional Application No. 63/010,036, filed Apr. 14, 2020.

This application claims the benefit of U.S. Provisional Application No. 63/057,252, filed Jul. 27, 2020.

The disclosures of the above listed applications are incorporated by reference herein in their entirety.

COPYRIGHT AUTHORIZATION

The present disclosure may be subject to copyright protection. The copyright owner has no objection to the facsimile reproduction by anyone of the present disclosure and its related documents, as they appear in the Patent and Trademark Office patent files or records, but otherwise reserves all applicable copyrights.

FIELD

The present disclosure generally relates to sports equipment, and more particularly, to golf club heads and methods to manufacture golf club heads.

BACKGROUND

In golf, various factors may affect the distance and direction that a golf ball may travel. In particular, the center of gravity (CG) and/or the moment of inertia (MOI) of a golf club head may affect the launch angle, the spin rate, and the direction of the golf ball at impact. Such factors may vary significantly based the type of golf swing.

Figure 1:
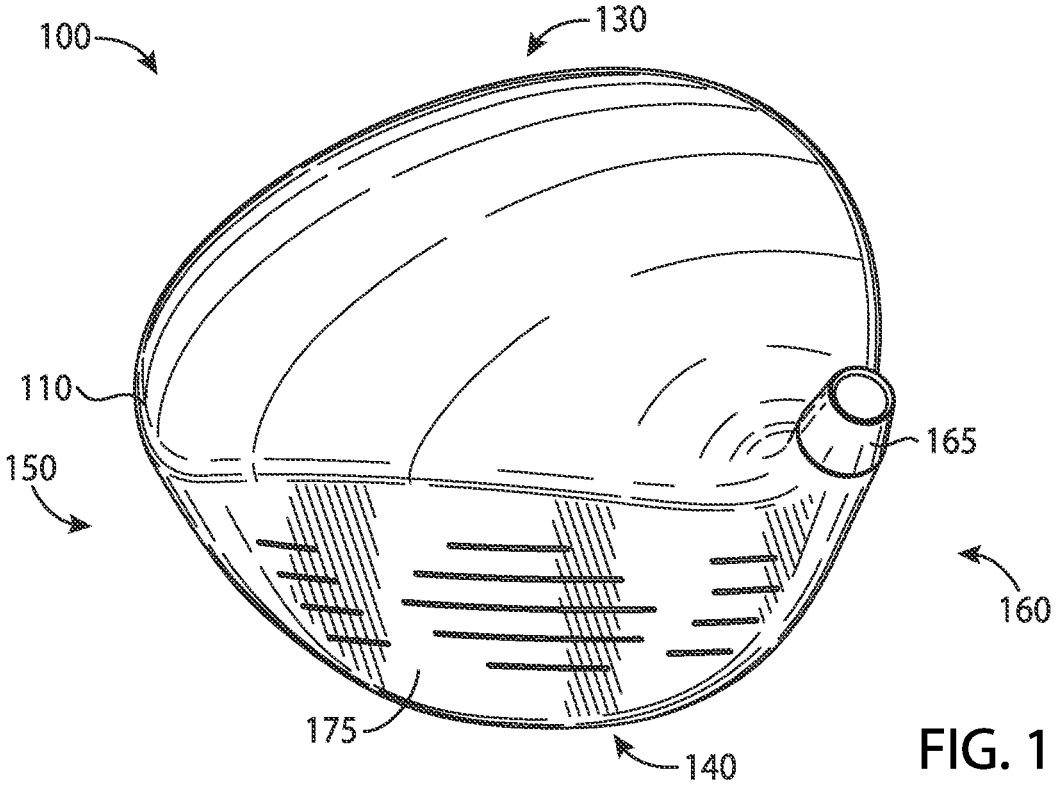
FIG. 1 is top perspective view of an example golf club head according to an embodiment of the apparatus, methods, and articles of manufacture described herein.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure.

DESCRIPTION

In general, golf club heads and methods to manufacture golf club heads are described herein. The apparatus, methods, and articles of manufacture described herein are not limited in this regard.

Figure 2:
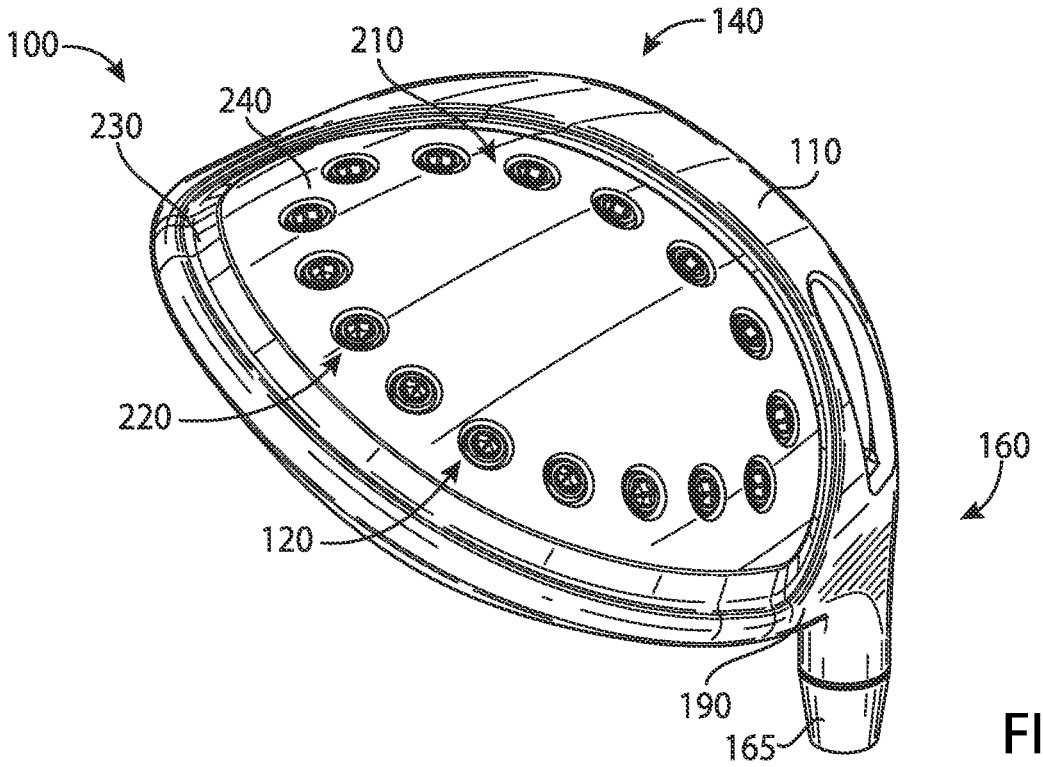
FIG. 2 depicts a bottom perspective view of the example golf club head of FIG. 1.
Figure 3:
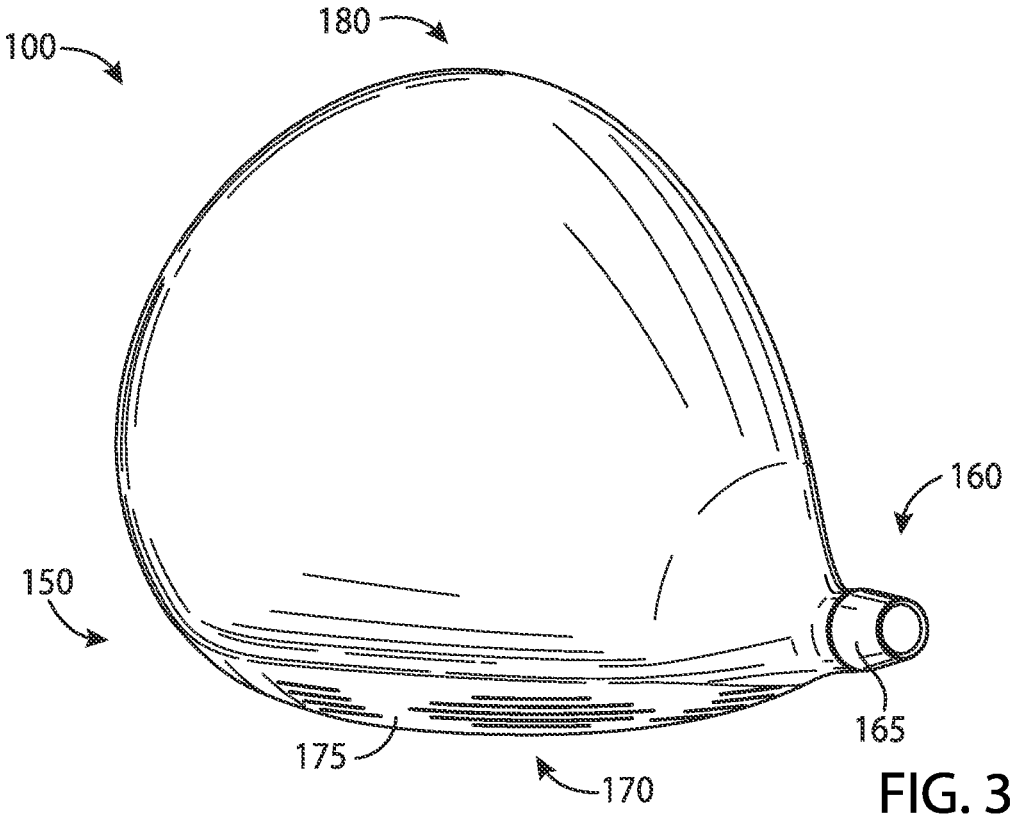
FIG. 3 depicts a top view of the example golf club head of FIG. 1.

In the example of FIGS. 1-13, a golf club head 100 may include a body portion 110, and a plurality of weight portions 120, generally, shown as a first set of weight portions 210 (FIG. 2) and a second set of weight portions 220 (FIG. 2). The body portion 110 may include a top portion 130, a bottom portion 140, a toe portion 150, a heel portion 160, a front portion 170, and a rear portion 180. The bottom portion 140 may include a skirt portion 190 defined as a side portion of the golf club head 100 between the top portion 130 and the bottom portion 140 excluding the front portion 170 and extending across a periphery of the golf club head 100 from the toe portion 150, around the rear portion 180, and to the heel portion 160.

The bottom portion 140 may include a transition region 230 and a weight port region 240. For example, the weight port region 240 may be a D-shape region. The weight port region 240 may include a plurality of weight ports 900 (FIG. 9) to receive the plurality of weight portions 120. The front portion 170 may include a face portion 175 to engage a golf ball (not shown). The body portion 110 may also include a hosel portion 165 to receive a shaft (not shown). Alternatively, the body portion 110 may include a bore instead of the hosel portion 165. For example, the body portion 110 may be made partially or entirely of an aluminum-based material, a magnesium-type material, a steel-based material, a titanium-based material, any combination thereof, or any other suitable material. In another example the body portion 110 may be made partially or entirely of a non-metal material such as a ceramic material, a composite material, any combination thereof, or any other suitable material.

The golf club head 100 may have a club head volume greater than or equal to 300 cubic centimeters ($cm^3$ or cc). In one example, the golf club head 100 may be about 460 cc. Alternatively, the golf club head 100 may have a club head volume less than or equal to 300 cc. In particular, the golf club head 100 may have a club head volume between 100 cc and 200 cc. The club head volume of the golf club head 100 may be determined by using the weighted water displacement method (i.e., Archimedes Principle). For example, procedures defined by golf standard organizations and/or governing bodies such as the United States Golf Association (USGA) and/or the Royal and Ancient Golf Club of St. Andrews (R&A) may be used for measuring the club head volume of the golf club head 100. Although FIG. 1 may depict a particular type of club head (e.g., a driver-type club head), the apparatus, methods, and articles of manufacture described herein may be applicable to other types of club head (e.g., a fairway wood-type club head, a hybrid-type club head, an iron-type club head, a putter-type club head, etc.). The apparatus, methods, and articles of manufacture described herein are not limited in this regard.

Each of the first set of weight portions 210, generally shown as 405, 410, 415, 420, 425, 430, and 435 (FIG. 4), may be associated with a first mass. Each of the second set of weight portions 220, generally shown as 440, 445, 450, 455, 460, 465, 470, 475, and 480 (FIG. 4), may be associated with a second mass. The first mass may be greater than the second mass or vice versa. In one example, the first set of weight portions 210 may be made of a tungsten-based material whereas the second set of weight portions 220 may be made of an aluminum-based material. As described in detail below, the first and second set of weight portions 210 and 220, respectively, may provide various weight configurations (e.g., FIGS. 15-18).

Figure 9:
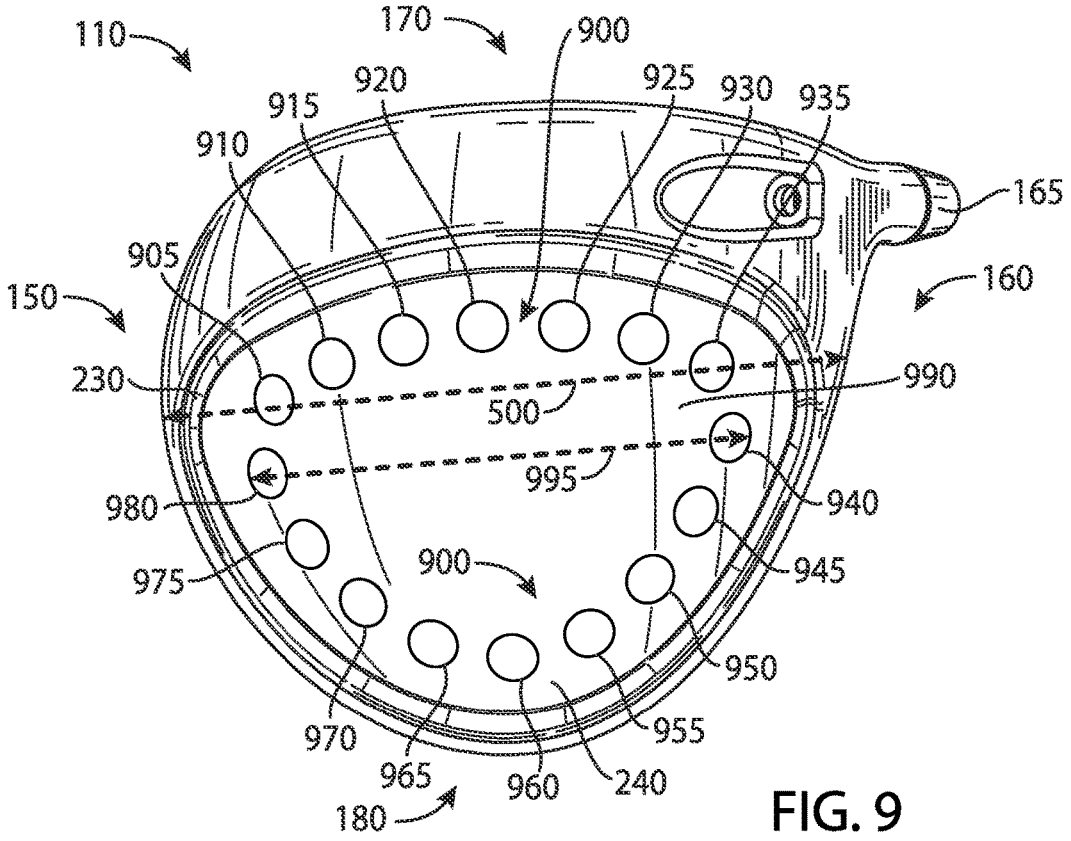
FIG. 9 depicts a bottom view of an example body portion of the example golf club head of FIG. 1.
Figure 10:
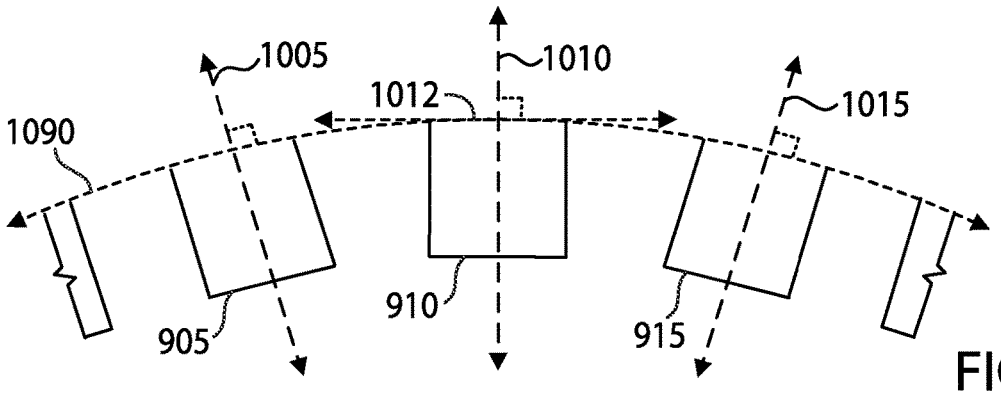
FIG. 10 depicts a cross-sectional view of the example body portion of the example golf club head of FIG. 1.
Figure 11:
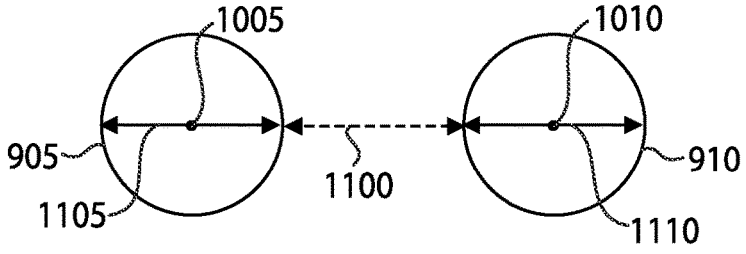
FIG. 11 depicts two weight ports of the example golf club head of FIG. 1.

Referring to FIGS. 9-11, for example, the bottom portion 140 of the body portion 110 may include a plurality of weight ports 900. The plurality of weight ports 900, generally shown as 905, 910, 915, 920, 925, 930, 935, 940, 945, 950, 955, 960, 965, 970, 975, and 980, may be located along a periphery of the weight port region 240 of the bottom portion 140. The plurality of weight ports 900 may extend across the bottom portion 140. In particular, the plurality of weight ports 900 may extend between the toe and heel portions 150 and 160, respectively, across the bottom portion 140. The plurality of weight ports 900 may also extend between the front and rear portions 170 and 180, respectively, across the bottom portion 140. The plurality of weight ports 900 may be arranged across the bottom portion 140 along a path that defines a generally D-shaped loop. In one example, the plurality of weight ports 900 may extend more than 50% of a maximum toe-to-heel distance 500 between of the toe and heel portions 150 and 160, respectively, across the bottom portion 140. The maximum toe-to-heel distance 500 of the golf club head 100 may be measured from transition regions between the top and bottom portions 130 and 140, respectively, at the toe and heel portions 150 and 160, respectively. Alternatively, the maximum toe-to-heel distance 500 may be a horizontal distance between vertical projections of the outermost points of the toe and heel portions 150 and 160, respectively. For example, the maximum toe-to-heel distance 500 may be measured when the golf club head 100 is at a lie angle 510 of about 60 degrees. If the outermost point of the heel portion 160 is not readily defined, the outermost point of the heel portion 160 may be located at a height 520 of about 0.875 inches (22.23 millimeters) above a ground plane 530 (i.e., a horizontal plane on which the golf club head 100 is lying on). The plurality of weight ports 900 may extend more than 50% of a maximum toe-to-heel club head distance 500 of the golf club head 100. In particular, the plurality of weight ports 900 may extend between the toe portion 150 and the heel portion 160 at a maximum toe-to-heel weight port distance 995, which may be more than 50% of the maximum toe-to-heel club head distance 500 of the golf club head 100. In one example, the maximum toe-to-heel club head distance 500 of the golf club head 100 may be no more than 5 inches (127 millimeters). Accordingly, the plurality of weight ports 900 may extend a weight port maximum toe-to-heel weight port distance of at least 2.5 inches between the toe and heel portions 150 and 160, respectively. A maximum toe-to-heel weight port distance 995 may be the maximum distance between the heel-side boundary of the weight port farthest from the toe portion 150 and the toe-side boundary of the weight port farthest from the heel portion 160. In the example of FIG. 9, the weight port maximum toe-to-heel weight port distance 995 may be the maximum distance between the heel-side boundary of the weight port 940 and toe-side boundary of the weight port 980. For example, the maximum toe-to-heel weight port distance 995 may be about 3.7 inches. As the rules of golf may change from time to time (e.g., new regulations may be adopted or old rules may be eliminated or modified by golf standard organizations and/or governing bodies), the lie angle 510 and/or the height 520 for measuring the maximum toe-to-heel club head distance 500 may also change. The apparatus, methods, and articles of manufacture described herein are not limited in this regard.

Each of the plurality of weight ports 900 may be associated with a port diameter ($D_{port}$) (e.g., two shown as 1105 and 1110 in FIG. 11). For example, the port diameter of each weight port of the plurality of weight ports 900 may be about 0.3 inch (7.65 millimeters). Alternatively, the port diameters of adjacent weight ports may be different. In one example, the weight port 905 may be associated with a port diameter 1105, and the weight port 910 may be associated with a port diameter 1110. In particular, the port diameter 1105 of the weight port 905 may be larger than the port diameter 1110 of the weight port 910 or vice versa. The apparatus, methods, and articles of manufacture described herein are not limited in this regard.

The bottom portion 140 may also include an outer surface 990. As illustrated in FIG. 10, for example, the plurality of weight ports 900 may be formed on the bottom portion 140 relative to an outer surface curve 1090 formed by the outer surface 990. In particular, each of the plurality of weight ports 900 may be associated with a port axis generally shown as 1005, 1010, and 1015. A center of a weight port may define the port axis of the weight port. Each port axis may be perpendicular or substantially perpendicular to a plane that is tangent to the outer surface curve 1090 at the point of intersection of the port axis and the outer surface curve 1090. In one example, substantially perpendicular may refer to a deviation of ±5° from perpendicular. In another example, substantially perpendicular may refer to a deviation of ±3° from perpendicular. The deviation from perpendicular may depend on manufacturing tolerances.

In one example, the port axis 1010 may be perpendicular or substantially perpendicular (i.e., normal) to a tangent plane 1012 of the outer surface curve 1090. Multiple fixtures may be used to manufacture the plurality of weight ports 900 by positioning the golf club head 100 in various positions. Alternatively, the weight ports may be manufactured by multiple-axis machining processes, which may be able to rotate the golf club head around multiple axes to mill away excess material (e.g., by water jet cutting and/or laser cutting) to form the plurality of weight ports 900. Further, multiple-axis machining processes may provide a suitable surface finish because the milling tool may be moved tangentially about a surface. Accordingly, the apparatus, methods, and articles of manufacture described herein may use a multiple-axis machining process to form each of the plurality of weight ports 900 on the bottom portion 140. For example, a five-axis milling machine may form the plurality of weight ports 900 so that the port axis 1000 of each of the plurality weight ports 900 may be perpendicular or substantially perpendicular to the outer surface curve 1090. The tool of the five-axis milling machine may be moved tangentially about the outer surface curve 1090 of the outer surface 990.

Turning to FIG. 11, for example, two adjacent weight ports may be separated by a port distance 1100, which may be the shortest distance between two adjacent weight ports on the outer surface 990. In particular, the port distance 1100 may be less than or equal to the port diameter of any of the two adjacent weight ports. In one example, the port distance 1100 between the weight ports 905 and 910 may be less than or equal to either the port diameter 1105 or the port diameter 1110. The apparatus, methods, and articles of manufacture described herein are not limited in this regard.

The plurality of weight portions 120 may have similar or different physical properties (e.g., density, shape, mass, volume, size, color, etc.). In one example, the first set of weight portions 210 may be a black color whereas the second set of weight portions 220 may be a gray color or a steel color. Some or all of the plurality of weight portions 120 may be partially or entirely made of a metal material such as a steel-based material, a tungsten-based material, an aluminum-based material, any combination thereof or suitable types of materials. Alternatively, some or all of the plurality of weight portions 120 may be partially or entirely made of a non-metal material (e.g., composite, plastic, etc.).

Figure 12:
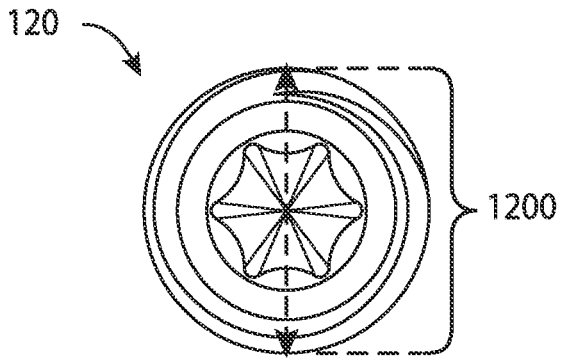
FIG. 12 depicts a top view of an example weight portion of the example golf club head of FIG. 1.
Figure 13:
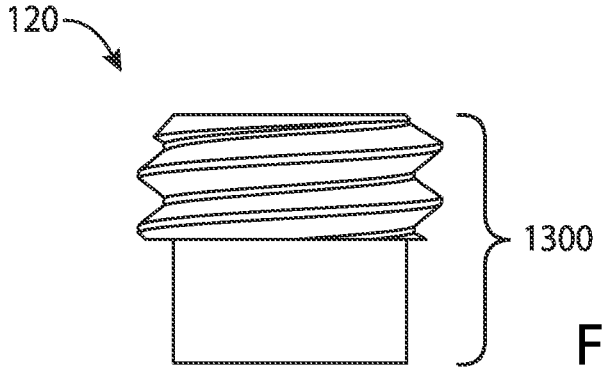
FIG. 13 depicts a side view of the example weight portion of FIG. 10.

In the illustrated example as shown in FIGS. 12 and 13, each weight portion of the plurality of weight portions 120 may have a cylindrical shape (e.g., a circular cross section). Although the above examples may describe weight portions having a particular shape, the apparatus, methods, and articles of manufacture described herein may include weight portions of other suitable shapes (e.g., a portion of or a whole sphere, cube, cone, cylinder, pyramid, cuboidal, prism, frustum, or other suitable geometric shape). Each weight portion of the plurality of weight portions 120 may be associated with a diameter 1200 and a height 1300. In one example, each weight portion of the plurality of weight portions 120 may have a diameter of about 0.3 inch (7.62 millimeters) and a height of about 0.2 inch (5.08 millimeters). Alternatively, the first and second sets of weight portions 210 and 220, respectively, may be different in width and/or height.

Instead of a rear-to-front direction as in other golf club heads, each weight portion of the plurality of weight portions 120 may engage one of the plurality of weight ports 400 in a bottom-to-top direction. The plurality of weight portions 120 may include threads to secure in the weight ports. For example, each weight portion of the plurality of weight portions 120 may be a screw. The plurality of weight portions 120 may not be readily removable from the body portion 110 with or without a tool. Alternatively, the plurality of weight portions 120 may be readily removable (e.g., with a tool) so that a relatively heavier or lighter weight portion may replace one or more of the plurality of weight portions 120. In another example, the plurality of weight portions 120 may be secured in the weight ports of the body portion 110 with epoxy or adhesive so that the plurality of weight portions 120 may not be readily removable. In yet another example, the plurality of weight portions 120 may be secured in the weight ports of the body portion 110 with both epoxy and threads so that the plurality of weight portions 120 may not be readily removable. The apparatus, methods, and articles of manufacture described herein are not limited in this regard.

Figure 14:
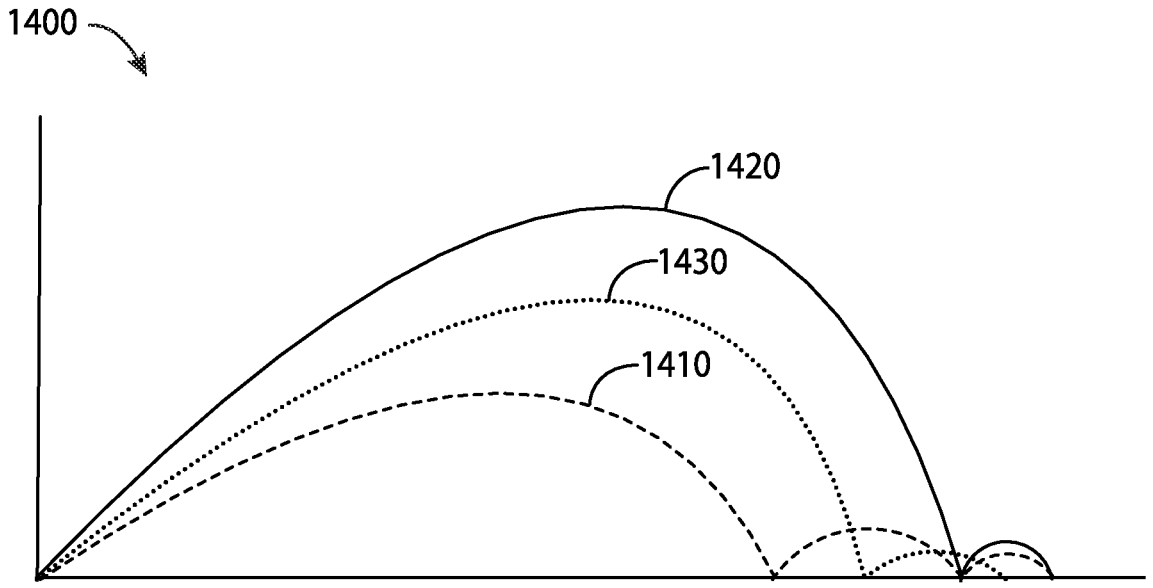
FIG. 14 depicts example launch trajectory profiles of the example golf club head of FIG. 1.
Figure 15:
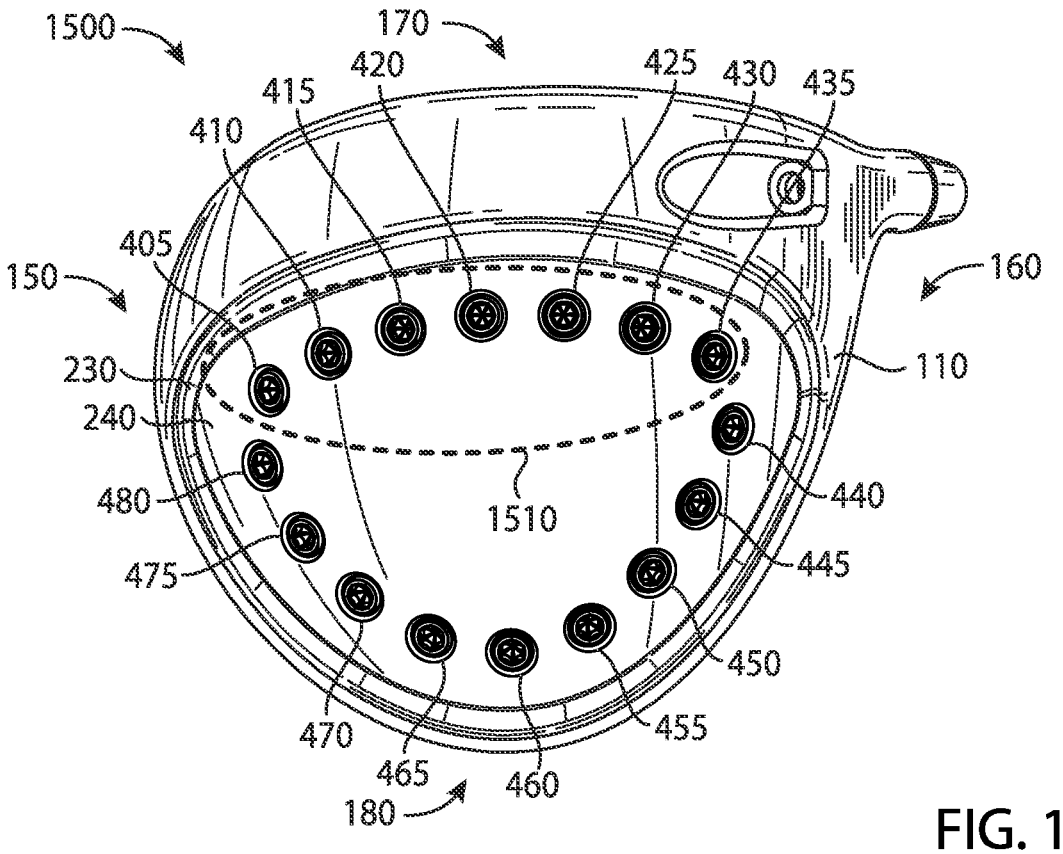
FIG. 15 depicts a first weight configuration of the example weight portions.

In contrast to other golf club heads, the golf club head 100 may accommodate at least four different types of golf swings. As illustrated in FIG. 14, for example, each weight configuration may be associated with one of the plurality of launch trajectory profiles 1400, generally shown as 1410, 1420, and 1430. Referring to FIG. 15, for example, a first weight configuration 1500 may be associated with a configuration of a first set of weight ports 1510. The first set of weight ports 1510 may be located at or proximate to the front portion 170 (e.g., weight ports 905, 910, 915, 920, 925, 930, and 935 shown in FIG. 9). In the first weight configuration 1500, a first set of weight portions may be disposed toward the front portion 170 according to the configuration of the first set of weight ports 1510, whereas a second set of weight portions may be disposed toward the rear portion 180. In particular, the first set of weight portions may form a cluster according to the configuration of the first set of weight ports 1510 at or proximate to the front portion 170. The weight portions 405, 410, 415, 420, 425, 430, and 435 may define the first set of weight portions and may be disposed in weight ports 905, 910, 915, 920, 925, 930, and 935, respectively. The weight portions 440, 445, 450, 455, 460, 465, 470, 475, and 480 may define the second set of weight portions and may be disposed in weight ports 940, 945, 950, 955, 960, 965, 970, 975, and 980, respectively. The first weight configuration 1500 may be associated with the first launch trajectory profile 1410 (FIG. 14). In particular, the first weight configuration 1500 may decrease spin rate of a golf ball. By placing relatively heavier weight portions (i.e., the first set of weight portions) towards the front portion 170 of the golf club head 100 according to the configuration of the first set of weight ports 1510, the center of gravity (GC) of the golf club head 100 may move relatively forward and lower to produce a relatively lower launch and spin trajectory. As a result, the first launch trajectory profile 1410 may be associated with a relatively greater roll distance (i.e., distance after impact with the ground). While the above example may describe the weight portions being disposed in certain weight ports, any weight portion of the first set of weight portions 210 may be disposed in any weight port of the first set of weight ports 1510.

Figure 16:
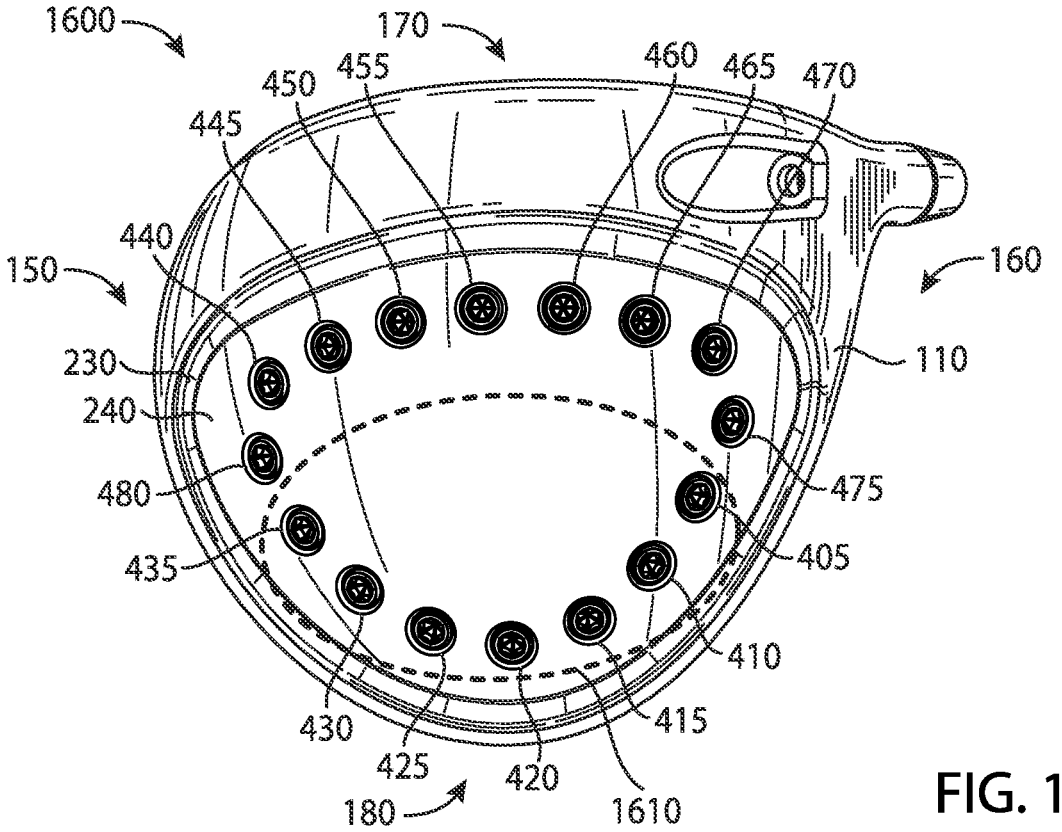
FIG. 16 depicts a second weight configuration of the example weight portions.

Turning to FIG. 16, for example, a second weight configuration 1600 may be associated with a configuration of a second set of weight ports 1610. The second set of weight ports 1610 may be located at or proximate to the rear portion 180 (e.g., weight ports, 945, 950, 955, 960, 965, 970, and 975 shown in FIG. 9). In a second weight configuration 1600 as illustrated in FIG. 16, for example, a first set of weight portions may be disposed toward the rear portion 180 whereas a second set of weight portions may be disposed toward the front portion 170. In particular, the first set of weight portions may form a cluster at or proximate to the rear portion 180 according to the configuration of the second set of weight ports 1610. The weight portions 405, 410, 415, 420, 425, 430, and 435 may define the first set of weight portions and may be disposed in weight ports 945, 950, 955, 960, 965, 970, and 975, respectively. The weight portions 440, 445, 450, 455, 460, 465, 470, 475, and 480 may define the second set of weight portions and may be disposed in weight ports 905, 910, 915, 920, 925, 930, 935, 940, and 980, respectively. The second weight configuration 1600 may be associated with the second launch trajectory profile 1420 (FIG. 14). In particular, the second weight configuration 1600 may increase launch angle of a golf ball and maximize forgiveness. By placing the relatively heavier weight portion (i.e., the first set of weight portions) towards the rear portion 180 of the golf club head 100 according to the configuration of the second set of weight ports 1610, the center of gravity (GC) of the golf club head 100 may move relatively back and up to produce a relatively higher launch and spin trajectory. Further, the moment of inertia (MOI) of the golf club head 100 may increase in both the horizontal (front-to-back axis) and vertical axes (top-to-bottom axis), which in turn, provides relatively more forgiveness on off-center hits. As a result, the second launch trajectory profile 1420 may be associated with a relatively greater carry distance (i.e., in-the-air distance).

Figure 17:
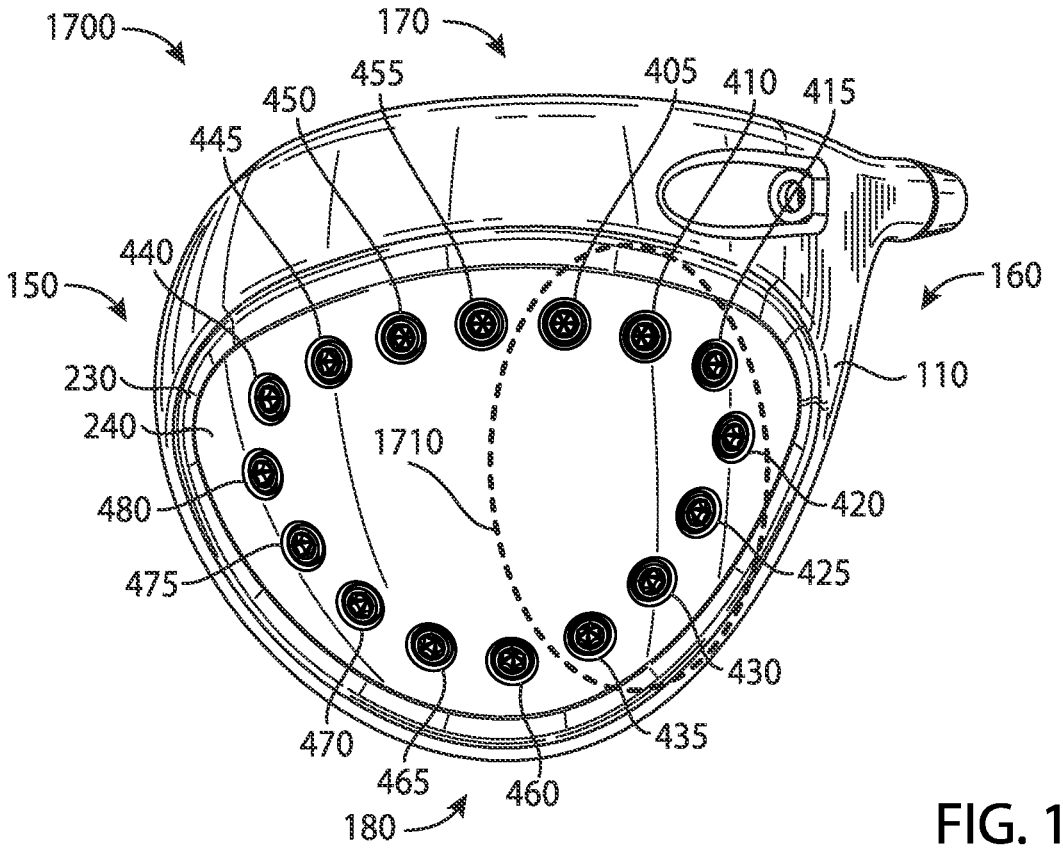
FIG. 17 depicts a third weight configuration of the example weight portions.

Turning to FIG. 17, for example, a third weight configuration 1700 may be associated with a configuration of a third set of weight ports 1710. In the third weight configuration 1700, for example, a first set of weight portions may be disposed toward the heel portion 160 whereas a second set of weight portions may be disposed toward the toe portion 150. In particular, the first set of weight portions may form a cluster of weight portions at or proximate to the heel portion 160 according to the configuration of the third set of weight ports 1710. The weight portions 405, 410, 415, 420, 425, 430, and 435 may define the first set of weight portions and may be disposed in weight ports 925, 930, 935, 940, 945, 950, and 955, respectively. The weight portions 440, 445, 450, 455, 460, 465, 470, 475, and 480 may define the second set of weight portions and may be disposed in weight ports 905, 910, 915, 920, 960, 965, 970, 975, and 980, respectively. The third weight configuration 1700 may be associated with a third launch trajectory profile 1430 (FIG. 14). In particular, the third weight configuration 1700 may allow an individual to turn over the golf club head 100 relatively easier (i.e., square up the face portion 175 to impact a golf ball). By placing the relatively heavier weight portions (i.e., the first set of weight portions) towards the heel portion 160 of the golf club head 100, the center of gravity (GC) of the golf club head 100 may move relatively closer to the axis of the shaft.

Figure 18:
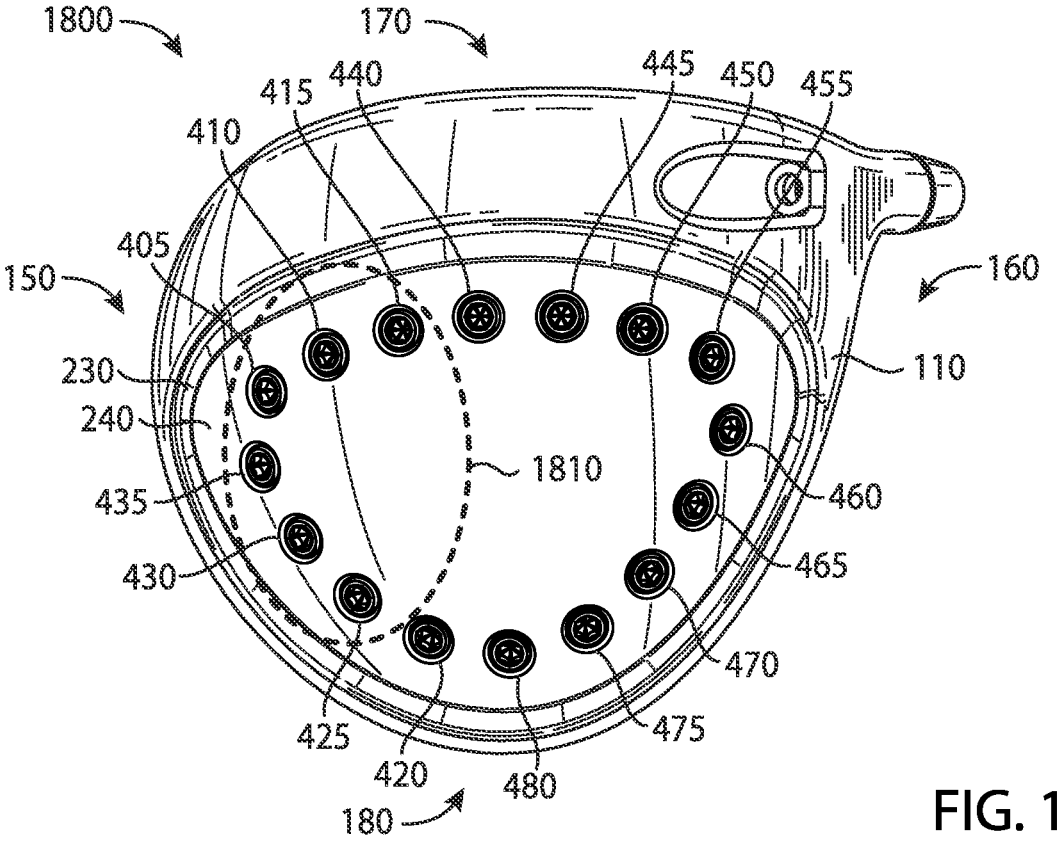
FIG. 18 depicts a fourth weight configuration of the example weight portions.
Figure 19:
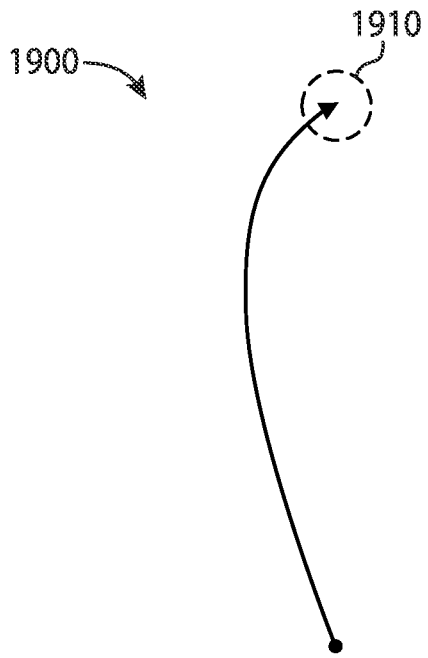
FIG. 19 depicts an example launch trajectory profile of the example golf club head of FIG. 18.

Turning to FIG. 18, for example, a fourth weight configuration 1800 may be associated with a configuration of a fourth set of weight ports 1810. In a fourth weight configuration 1800, for example, a first set of weight portions may be disposed toward the toe portion 150 whereas a second set of weight portions may be disposed toward the heel portion 160. In particular, the first set of weight portions may form a cluster of weight portions at or proximate to the toe portion 150 according to the configuration of the fourth set of weight ports 1810. The weight portions 405, 410, 415, 420, 425, 430, and 435 may define the first set of weight portions and may be disposed in weight ports 905, 910, 915, 965, 970, 975, and 980, respectively. The weight portions 440, 445, 450, 455, 460, 465, 470, 475, and 480 may define the second set of weight portions and may be disposed in weight ports 920, 925, 930, 935, 940, 945, 950, 955, and 960, respectively. The fourth weight configuration 1800 may be associated with the third launch trajectory profile 1430 (FIG. 14). In particular, the fourth weight configuration 1800 may prevent an individual from turning over the golf club head 100 (i.e., the face portion 175 may be more open to impact a golf ball). By placing the relatively heavier weight portions (i.e., the first set of weight portions) towards the toe portion 150 of the golf club head 100, the center of gravity (GC) of the golf club head 100 may move relatively farther away from the axis of the shaft. The fourth weight configuration 1800 may result in a fade golf shot (as shown in FIG. 19, for example, a trajectory or ball flight in which a golf ball travels to the left of a target 1910 and curving back to the right of the target for a right-handed individual). The apparatus, methods, and articles of manufacture described herein are not limited in this regard.

Figure 20:
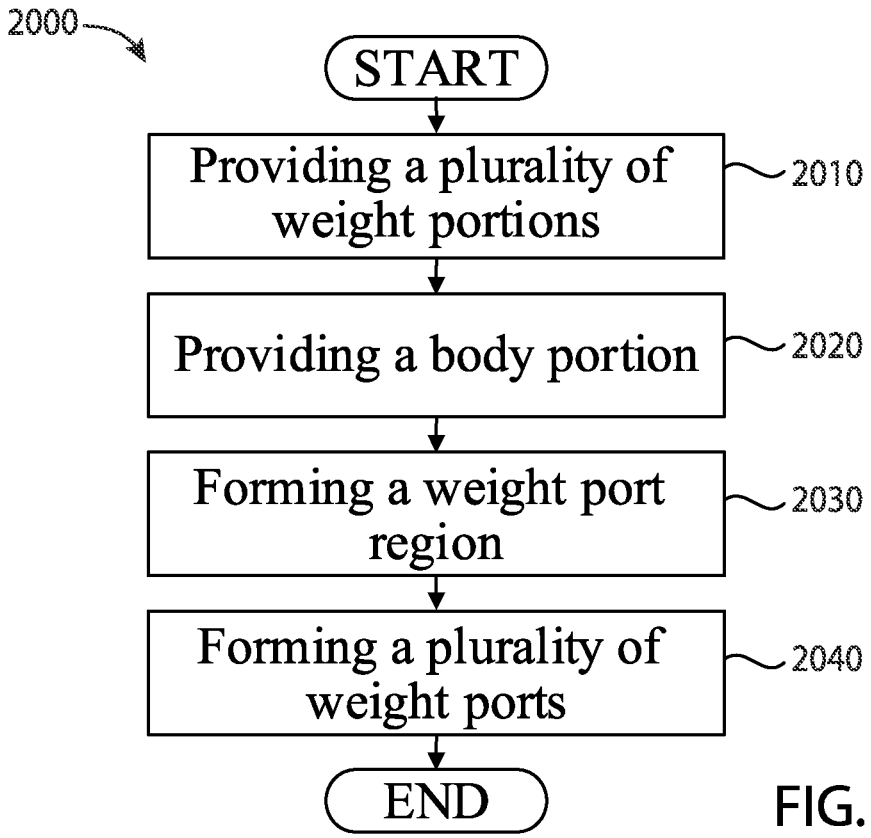
FIG. 20 depicts one manner in which the example golf club heads described herein may be manufactured.

FIG. 20 depicts one manner in which the golf club head 100 may be manufactured. In the example of FIG. 20, the process 2000 may begin with providing a plurality of weight portions (block 2010). The plurality of weight portions may include a first set of weight portions and a second set of weight portions. Each weight portion of the first set of weight portions may be associated with a first mass whereas each weight portion of the second set of weight portions may be associated with a second mass. The first mass may be greater than the second mass. In one example, each weight portion of the first set of weight portions may be made of a tungsten-based material with a mass 2.6 grams whereas each weight portion of the second set of weight portions may be made of an aluminum-based material with a mass of 0.4 grams. The first set of weight portions may have a gray color or a steel color whereas the second set of weight portions may have a black color.

The process 2000 may provide a body portion of a golf club head (block 2020). The body portion may include a front portion, a rear portion, a toe portion, a heel portion, a top portion, a bottom portion having an outer surface associated with outer surface curve, and a skirt portion between the top and bottom portion.

The process 2000 may form a weight port region located at or proximate to the bottom and skirts portions (block 2030). A transition region may surround the weight port region.

The process 2000 may form a plurality of weight ports along a periphery of the weight port region (block 2040). Each weight port of the plurality of weight ports may be associated with a port diameter and configured to receive at least one weight portion of the plurality of weight portions. Two adjacent weight ports may be separated by less than or equal to the port diameter. Further, each weight port of the plurality of weight ports may be associated with a port axis. The port axis may be perpendicular or substantially perpendicular relative to a tangent plane of the outer surface curve of the bottom portion of the golf club head.

The example process 2000 of FIG. 20 is merely provided and described in conjunction with FIGS. 1-19 as an example of one way to manufacture the golf club head 100. While a particular order of actions is illustrated in FIG. 20, these actions may be performed in other temporal sequences. For example, two or more actions depicted in FIG. 20 may be performed sequentially, concurrently, or simultaneously. Although FIG. 20 depicts a particular number of blocks, the process may not perform one or more blocks. The apparatus, methods, and articles of manufacture described herein are not limited in this regard.

Figure 4:
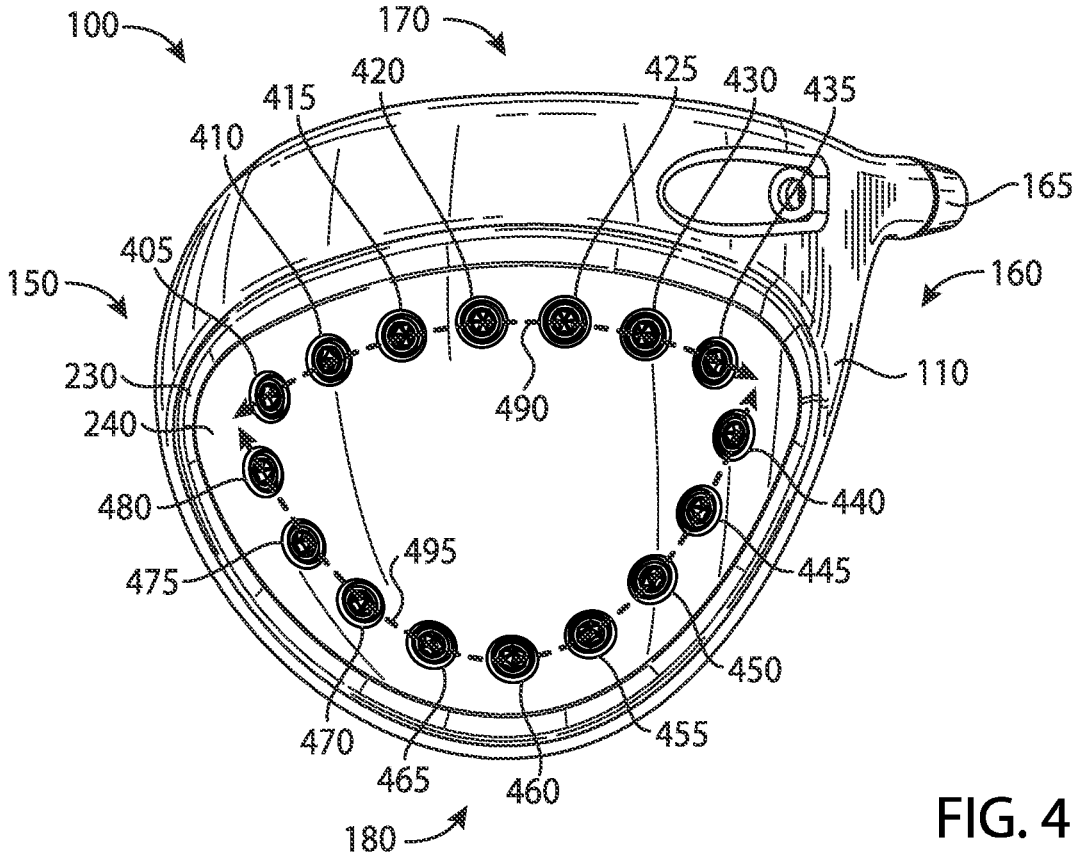
FIG. 4 depicts a bottom view of the example golf club head of FIG. 1.
Figure 5:
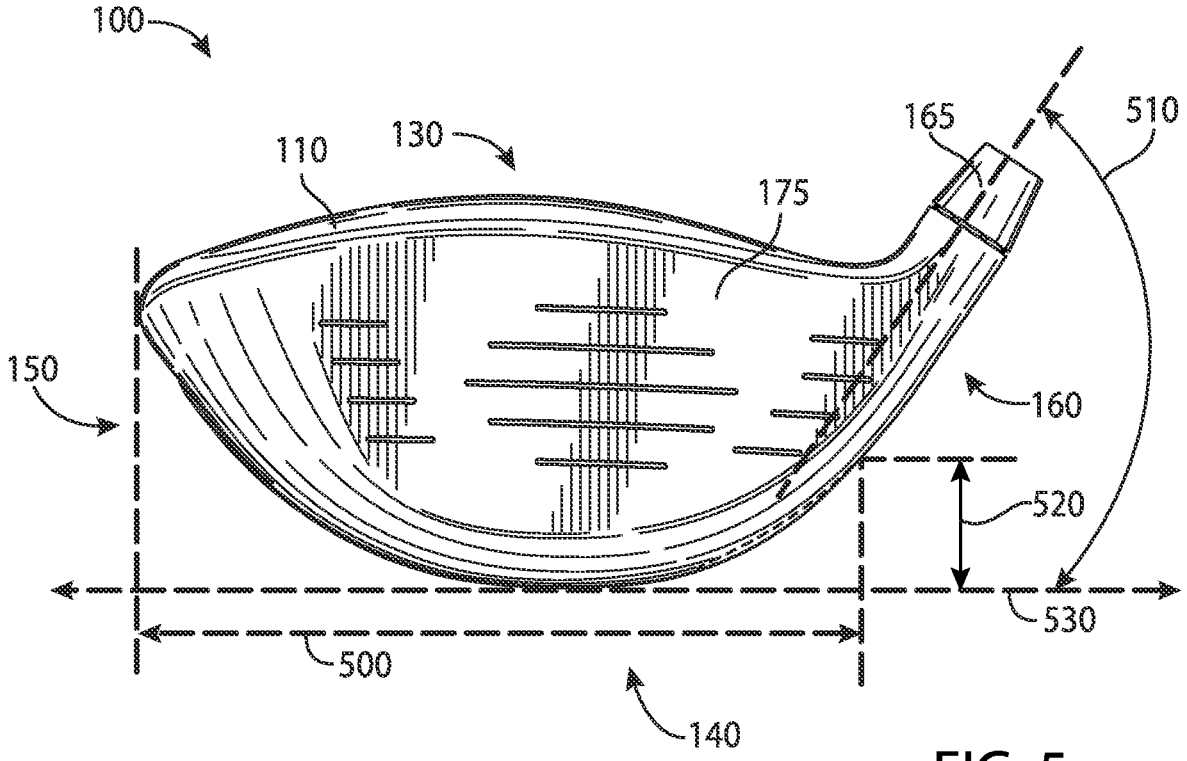
FIG. 5 depicts a front view of the example golf club head of FIG. 1.
Figure 6:
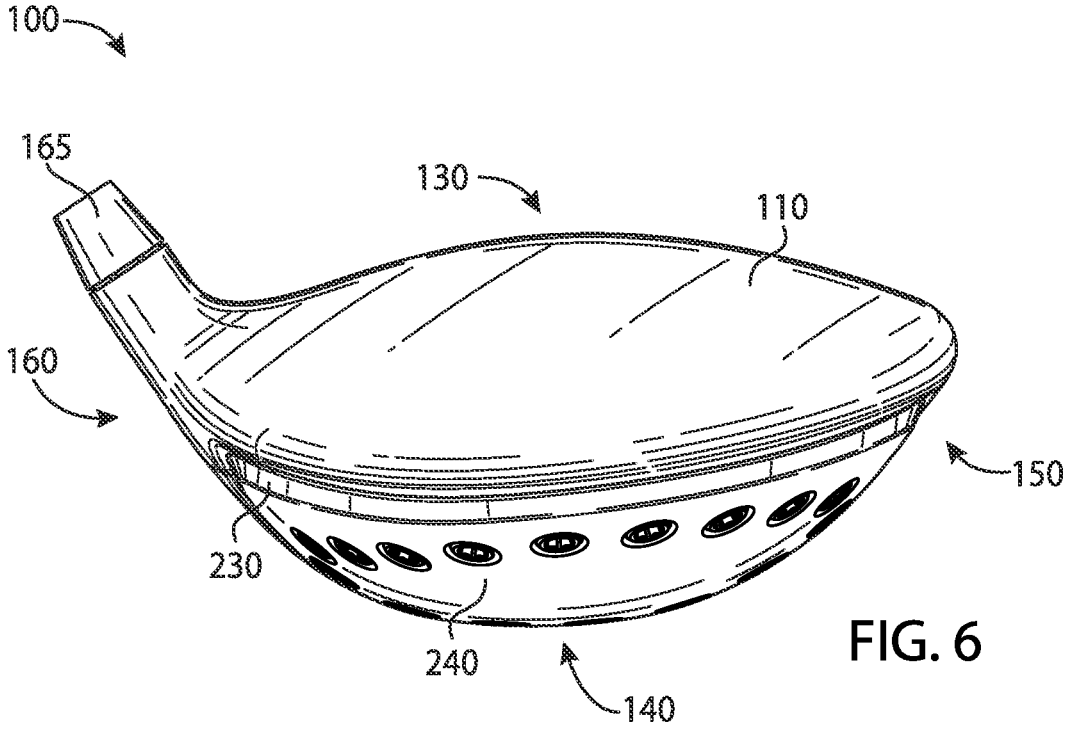
FIG. 6 depicts a rear view of the example golf club head of FIG. 1.
Figure 7:
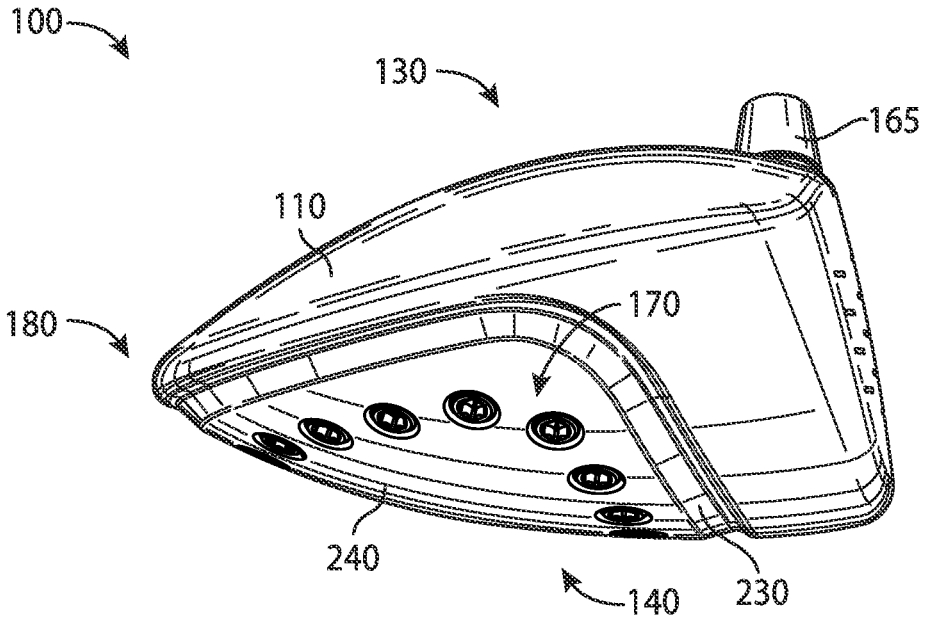
FIG. 7 depicts a toe view of the example golf club head of FIG. 1.
Figure 8:
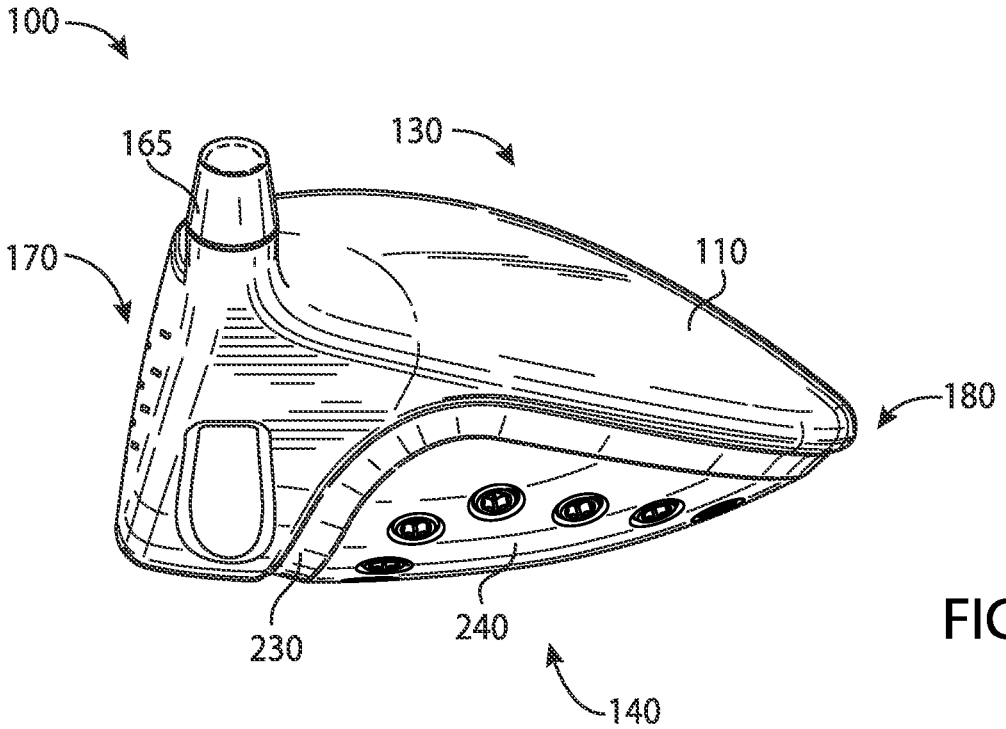
FIG. 8 depicts a heel view of the example golf club head of FIG. 1.

As shown in the above examples, the plurality of weight portions 120 and the plurality of weight ports 900 may be located on a periphery of the weight port region 240 along a path that defines a generally D-shaped loop formed with two arcs, generally shown as 490 and 495 in FIG. 4. For example, the weight portions 405, 410, 415, 420, 425, 430, and 435 (FIG. 4), and the weight ports 905, 910, 915, 920, 925, 930, and 935 (FIG. 9) may form the first arc 490. In particular, the first arc 490 may extend between the toe and heel portions 150 and 160, respectively, across the bottom portion 140. The weight portions 440, 445, 450, 455, 460, 465, 470, 475, and 480 (FIG. 4), the weight ports 940, 945, 950, 955, 960, 965, 970, 975, and 980 (FIG. 9) may form the second arc 495. The second arc 495 may generally follow the contour of the rear portion 180 of the body portion 110. Alternatively, the first and second arcs 490 and 495 may define loops with other shapes that extend across the bottom portion 140 (e.g., a generally O-shaped loop). The apparatus, methods, and articles of manufacture described herein are not limited in this regard.

Figure 21:
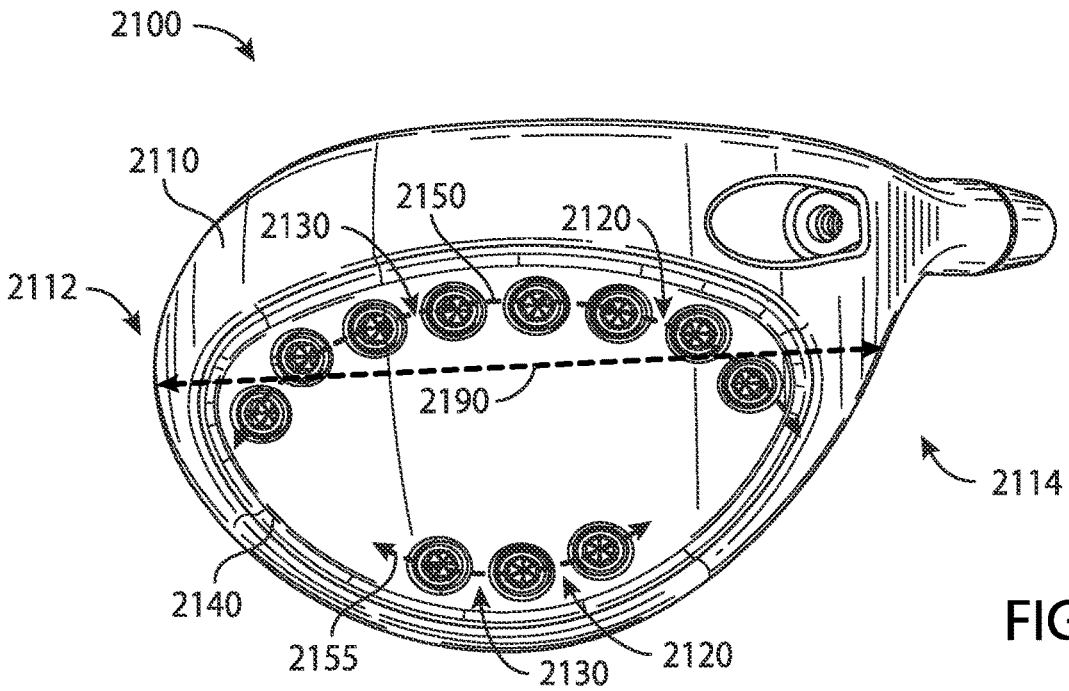
FIG. 21 depicts a bottom view of another example golf club head.

Although the above examples may depict the plurality of weight portions 120 and the plurality of weight ports 900 forming a particular geometric shape, the apparatus, methods, and articles of manufacture described herein may have weight portions and weight ports located along a periphery of a weight portion region to form other geometric shapes. Turning to FIG. 21, for example, a golf club head 2100 may include a bottom portion 2110, and a plurality of weight portions 2120 disposed in a plurality of weight ports 2130. The plurality of weight ports 2130 may be located along a periphery of a weight port region 2140 of the bottom portion 2110 (i.e., the plurality of weight ports 2130 may extend between the toe and heel portions 2112 and 2114, respectively, across the bottom portion 2110). In contrast to the plurality of weight portions 120 and the plurality of weight ports 900 (e.g., FIGS. 4 and 9), the plurality of weight ports 2130 may form two discrete arcs, generally shown as 2150 and 2155, extending across the bottom portion 2110.

The first arc 2150 may extend between the toe portion 2112 and the heel portion 2114. The first arc 2150 may curve toward the front portion 2170 of the golf club head 2100 (i.e., concave relative to the front portion 2170). According to the example of FIG. 21, the first arc 2150 may extend from a region proximate the toe portion 2112 to a region proximate to the front portion 2170 and from the region proximate to the front portion 2170 to a region proximate to the heel portion 2114 (i.e., concave relative to the front portion 2170). Accordingly, the first arc 2150 may appear as a C-shaped arc facing the rear portion 2180 of the golf club head 2100 that extends between the toe portion 2112 and the heel portion 2114. The second arc 2155 may also extend between the toe portion 2112 and the heel portion 2114. The second arc 2155 may curve toward the rear portion 2180 of the golf club head 2100 (i.e., concave relative to the rear portion 2180). Accordingly, the second arc 2155 may appear as a C-shaped arc facing the front portion 2170 of the golf club head 2100 that extends between the toe portion 2112 and the heel portion 2114. Further, the first arc 2150 may be closer to the front portion 2170 than the second arc 2155. The first arc 2150 and the second arc 2155 may be discrete so that the first and second arcs 2150 and 2155, respectively, may be spaced apart along the periphery of the bottom portion 2110. Accordingly, the bottom portion 2110 may include gaps 2190 and 2192 along the periphery of the bottom portion 2110 between the weight ports 2130 of the first arc 2150 and the weight ports 2130 of the second arc 2155. The gaps 2190 and/or 2192 may be greater than or equal to the port diameter of any of the weight ports 2130 such as the weight ports 2130 that are adjacent to the gaps 2190 and/or 2192. According to one example as shown in FIG. 21, the gaps 2190 and 2192 may be several orders or magnitude larger than the diameters of the weight ports 2130 that are adjacent to the gaps 2190 and 2192. The apparatus, methods, and articles of manufacture described herein are not limited in this regard.

Referring to FIG. 21, for example, the first arc 2150 may include a greater number of weight ports 2130 than the second arc 2155, which may be suitable for certain golf club heads (e.g., a fairway wood-type golf club head and/or a hybrid-type golf club head). Alternatively, the second arc 2155 may include the same or a greater number of weight ports 2130 than the first arc 2150. The number of weight ports 2130 in each of the first and second arcs 2150 and 2155, respectively, the weight portions 2120 associated with each weight port 2130 and the spacing between adjacent weight ports 2130 may be determined based on the type of golf club, a preferred weight distribution of the golf club head 2100, and/or a center of gravity location of the golf club head 2100.

The weight ports 2130 of the first arc 2150 and/or the second arc 2155 may be spaced from each other at the same or approximately the same distance along the first arc 2150 and/or the second arc 2155, respectively. Any variation in the spacing between the weight ports 2130 of the first arc 2150 or the second arc 2155 or any of the weight ports described herein may be due to different manufacturing considerations, such as manufacturing tolerances and/or cost effectiveness associated with manufacturing precision. For example, the variation in the spacing between the weight ports 2130 of the first arc 2150 and/or the second arc 2155 may be between 1/16 of an inch to 0.001 inch. As described herein, the distance between adjacent weight ports 2130 (i.e., port distance) may be less than or equal to the port diameter of any of the two adjacent weight ports. The plurality of weight ports 2130 may extend between the toe portion 2112 and the heel portion 2114 at a maximum toe-to heel weight port distance that is more than 50% of a maximum toe-to-heel club head distance 2195 of the golf club head 2100. The maximum toe-to-heel weight port distance may be the maximum distance between the heel-side boundary of the weight port farthest from the toe portion 2112 and the toe-side boundary of the weight port farthest from the heel portion 2114.

In particular, the golf club head 2100 may have a volume of less than 430 cc. In example, the golf club head 2100 may have a volume ranging from 100 cc to 400 cc. In another example, the golf club head 2100 may have a volume ranging from 150 cc to 350 cc. In yet another example, the golf club head 2100 may have a volume ranging from 200 cc to 300 cc. The golf club head 2100 may have a mass ranging from 100 grams to 350 grams. In another example, the golf club head 2100 may be have a mass ranging from 150 grams to 300 grams. In yet another example, the golf club head 2100 may have a mass ranging from 200 grams to 250 grams. The golf club head 2100 may have a loft angle ranging from 10° to 30°. In another example, the golf club head 2100 may have a loft angle ranging from 13° to 27°. For example, the golf club head 2100 may be a fairway wood-type golf club head. Alternatively, the golf club head 2100 may be a smaller driver-type golf club head (i.e., larger than a fairway wood-type golf club head but smaller than a driver-type golf club head). The apparatus, methods, and articles of manufacture described herein are not limited in this regard.

Figure 22:
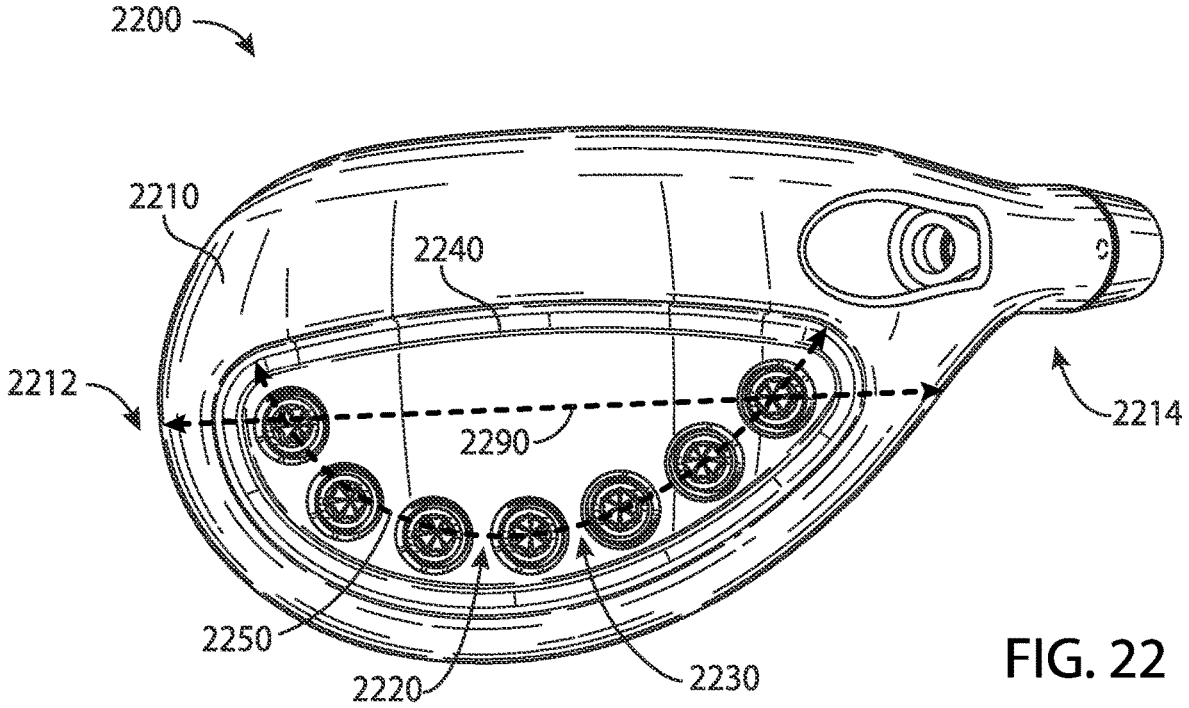
FIG. 22 depicts a bottom view of yet another example golf club head.

As illustrated in FIG. 22, for example, a golf club head 2200 may include a bottom portion 2210, and a plurality of weight portions 2220 disposed in a plurality of weight ports 2230. The plurality of weight ports 2230 located along a periphery of a weight port region 2240 may be arranged along a path that defines an arc, generally shown as 2250, extending across the bottom portion 2210 (i.e., the plurality of weight ports 2230 may extend between the toe and heel portions 2212 and 2214, respectively, across the bottom portion 2210). The arc 2250 may curve toward the rear portion 2280 of the golf club head 2200 (i.e., concave relative to the rear portion 2280). According to the example of FIG. 22, the arc 2250 may extend from a region proximate the toe portion 2212 to a region proximate to the rear portion 2280 and from the region proximate to the rear portion 2280 to a region proximate to the heel portion 2214 (i.e., concave relative to the rear portion 2280). Accordingly, the arc 2250 may appear as a C-shaped arc facing the front portion 2270 of the golf club head 2200 that extends from near the heel portion 2214 to near the toe portion 2212. Further, the curvature of the arc 2250 is substantially similar to or generally follows the contour of the rear portion 2280 of the golf club head 2200. The number of weight ports 2230 in the arc 2250, the weight portions 2220 associated with each weight port 2230 and the spacing between adjacent weight ports 2230 may be determined based on the type of golf club, a preferred weight distribution of the golf club head 2200, and/or a center of gravity location of the golf club head 2200.

The weight ports 2230 of the arc 2250 may be spaced from each other at the same or approximately the same distance along the arc 2250 (e.g., the weight ports 2230 may be substantially similarly spaced apart from each other). Any variation in the spacing between the weight ports 2230 of the arc 2250 or any of the weight ports described herein may be due to different manufacturing considerations, such as manufacturing tolerances and/or cost effectiveness associated with manufacturing precision. For example, the variation in the spacing between the weight ports 2130 of the arc 2250 may be between 1/16 of an inch to 0.001 inch. As described herein, the distance between adjacent weight ports 2230 (i.e., port distance) may be less than or equal to the port diameter of any of the two adjacent weight ports. The plurality of weight ports 2230 may extend between the toe portion 2212 and the heel portion 2214 at a maximum toe-to heel weight port distance that is more than 50% of a maximum toe-to-heel club head distance of 2290 the golf club head 2200. The maximum toe-to-heel weight port distance may be the maximum distance between the heel-side boundary of the weight port farthest from the toe portion 2212 and the toe-side boundary of the weight port farthest from the heel portion 2214.

In particular, the golf club head 2200 may have a volume of less than 200 cc. In example, the golf club head 2200 may have a volume ranging from 50 cc to 150 cc. In another example, the golf club head 2200 may have a volume ranging from 60 cc to 120 cc. In yet another example, the golf club head 2200 may have a volume ranging from 70 cc to 100 cc. The golf club head 2200 may have a mass ranging from 180 grams to 275 grams. In another example, the golf club head 2200 may have a mass ranging from 200 grams to 250 grams. The golf club head 2200 may have a loft angle ranging from 15° to 35°. In another example, the golf club head 2200 may have a loft angle ranging from 17° to 33°. For example, the golf club head 2200 may be a hybrid-type golf club head. The apparatus, methods, and articles of manufacture described herein are not limited in this regard.

Figure 23:
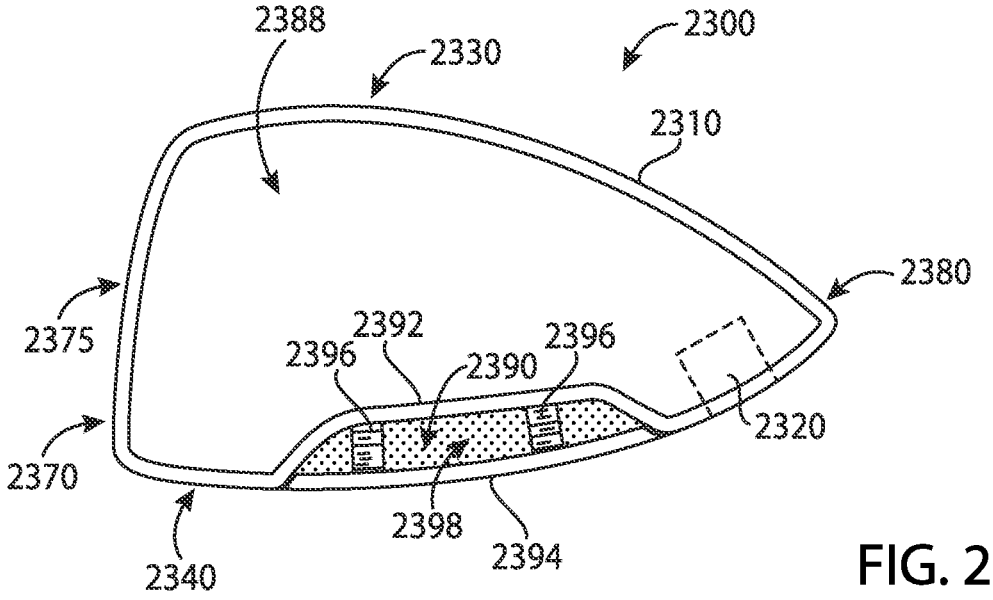
FIG. 23 depicts a schematic cross-sectional view of yet another example golf club head.

In the example of FIG. 23, a golf club head 2300 may include a body portion 2310. The golf club head 2300 may include a plurality of weight ports (e.g., one is generally shown as 2320) and a plurality of weight portions that may be similar in many respects to the weight ports and weight portions, respectively, of the golf club heads described herein. Accordingly, a detailed description of the weight ports and the weight portions of the golf club head 2300 is not provided. Alternatively, the golf club head 2300 may not include any weight ports or weight portions. The body portion 2310 may include a top portion 2330, a bottom portion 2340, a toe portion (not shown), a heel portion (not shown), a front portion 2370, and a rear portion 2380. The bottom portion 2340 may include a skirt portion (not shown) defined as a side portion of the golf club head 2300 between the top portion 2330 and the bottom portion 2340 excluding the front portion 2370 and extending across a periphery of the golf club head 2300 from the toe portion, around the rear portion 2380, and to the heel portion. The bottom portion 2340 may include one or more weight port regions (not shown). For example, a weight port region may include a plurality of weight ports, one of which is generally shown as 2320, to receive a plurality of weight portions (not shown). The front portion 2370 may include a face portion 2375 to engage a golf ball (not shown). The body portion 2310 may also include a hosel portion (not shown) to receive a shaft (not shown). Alternatively, the body portion 2310 may include a bore (not shown) instead of a hosel portion (not shown). For example, the body portion 2310 may be made partially or entirely of an aluminum-based material, a magnesium-type material, a steel-based material, a titanium-based material, any combination thereof, or any other suitable material. In another example the body portion 2310 may be made partially or entirely of a non-metal material such as a ceramic material, a composite material, any combination thereof, or any other suitable material.

The golf club head 2300 may have a club head volume greater than or equal to 300 cubic centimeters ($cm^3$ or cc). In one example, the golf club head 2300 may be about 460 cc. Alternatively, the golf club head 2300 may have a club head volume less than or equal to 300 cc. In particular, the golf club head 2300 may have a club head volume between 100 cc and 200 cc. The club head volume of the golf club head 2300 may be determined by using the weighted water displacement method (i.e., Archimedes Principle). For example, procedures defined by golf standard organizations and/or governing bodies such as the United States Golf Association (USGA) and/or the Royal and Ancient Golf Club of St. Andrews (R&A) may be used for measuring the club head volume of the golf club head 2300. Although FIG. 23 may depict a particular type of club head (e.g., a driver-type club head), the apparatus, methods, and articles of manufacture described herein may be applicable to other types of club head (e.g., a fairway wood-type club head, a hybrid-type club head, an iron-type club head, a putter-type club head, etc.). Accordingly, the golf club head 2300 may be any type of club head such as any of the club heads described herein. The apparatus, methods, and articles of manufacture described herein are not limited in this regard.

The body portion 2310 may be a hollow body including a first interior cavity 2388 that may extend from the front portion 2370 to the rear portion 2380 and from the toe portion to the heel portion. The body portion 2310 may include a second interior cavity 2390 near the bottom portion 2340 or at the bottom portion 2340 and extending between the front portion 2370 and the rear portion 2380. The second interior cavity 2390 may extend between the top portion 2330 and the bottom portion 2340. The first interior cavity 2388 and the second interior cavity 2390 may be separated by a cavity wall 2389. In the example of FIG. 23, the second interior cavity 2390 may be defined by a recessed portion 2392 of the bottom portion 2340 that is covered with a bottom cover 2394. Accordingly, in the example of FIG. 23, the cavity wall 2389 may be defined by the recessed portion 2392 of the bottom portion 2340. The bottom cover 2394 may be attached to the bottom portion 2340 with one or more fasteners, two of which are generally shown as 2396. Thus, the space between the recessed portion 2392 of the bottom portion 2340 and the bottom cover 2394 may define the second interior cavity 2390.

In one example, the second interior cavity 2390 may be unfilled (i.e., empty space). Alternatively, the second interior cavity 2390 may be partially or entirely filled with an elastic polymer or elastomer material (e.g., a viscoelastic urethane polymer material such as Sorbothane® material manufactured by Sorbothane, Inc., Kent, Ohio), a thermoplastic elastomer material (TPE), a thermoplastic polyurethane material (TPU), and/or other suitable types of materials to absorb shock, isolate vibration, and/or dampen noise. For example, at least 50% of the second interior cavity 2390 may be filled with a TPE material to absorb shock, isolate vibration, and/or dampen noise when the golf club head 2300 strikes a golf ball via the face portion 2375. The apparatus, methods, and articles of manufacture described herein are not limited in this regard.

In one example, the interior cavity may be filled with an elastic polymer or elastomer material (e.g., shown as 2398) by filling the recessed portion 2392 of the bottom portion 2340 with elastomer polymer or elastomer material, and then attaching the bottom cover 2394 over the recessed portion 2392 with the fasteners 2396. Alternatively, the bottom cover 2394 may be initially placed over the recessed portion 2392 and then attached to the bottom portion 2340 with one of the fasteners 2396. Elastic polymer or elastomer material may then be injected into the interior cavity 2392 through a fastener port or another one of the fasteners 2396 for the bottom cover 2394. After the interior cavity 2392 is filled, all of the fasteners for the bottom cover 2394 may fastened to completely attach the bottom cover 2394 over the recessed portion 2392. Alternatively, a combination of the methods described herein including the methods described below may be used to fill the interior cavity 2392 with an elastic polymer or elastomer material. The apparatus, methods, and articles of manufacture described herein are not limited in this regard.

Figure 24:
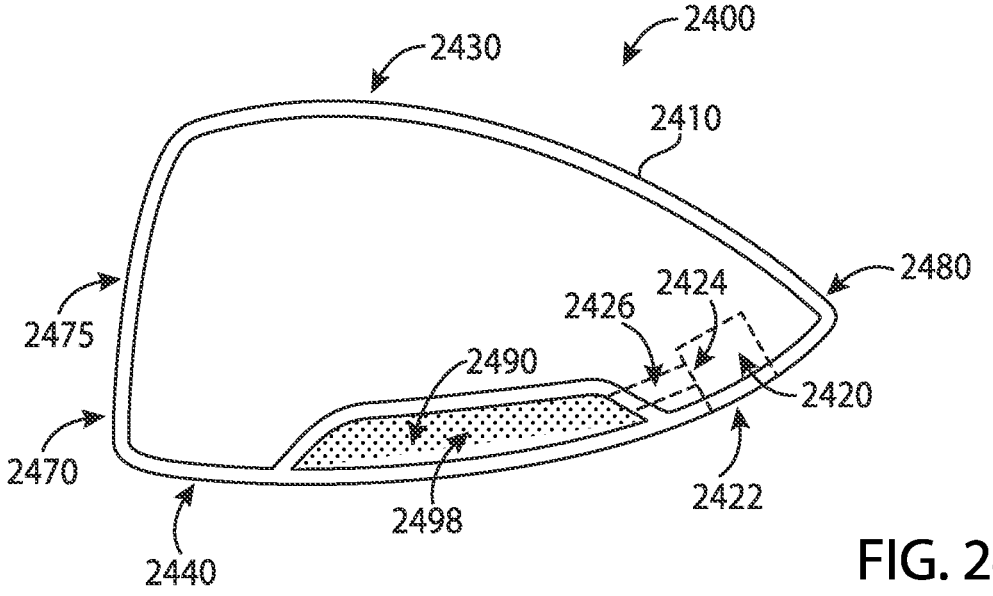
FIG. 24 depicts a schematic cross-sectional view of yet another example golf club head.

In the example of FIG. 24, a golf club head 2400 may include a body portion 2410. The golf club head 2400 may include a plurality of weight ports (e.g. one is generally shown as 2420) and a plurality of weight portions that may be similar in many respects to the weight ports and weight portions of the golf club heads described herein. Accordingly, a detailed description of the weight ports and the weight portions of the golf club head 2400 is not provided. Alternatively, the golf club head 2400 may not include any weight ports or weight portions. The body portion 2410 may include a top portion 2430, a bottom portion 2440, a toe portion (not shown), a heel portion (not shown), a front portion 2470, and a rear portion 2480. The bottom portion 2440 may include a skirt portion (not shown) defined as a side portion of the golf club head 2400 between the top portion 2430 and the bottom portion 2440 excluding the front portion 2470 and extending across a periphery of the golf club head 2400 from the toe portion, around the rear portion 2480, and to the heel portion. The bottom portion 2440 may include one or more weight port regions (not shown). For example, a weight port region may include a plurality of weight ports, one of which is generally shown as 2420, to receive a plurality of weight portions (not shown). The front portion 2470 may include a face portion 2475 to engage a golf ball (not shown). The body portion 2410 may also include a hosel portion (not shown) to receive a shaft (not shown). Alternatively, the body portion 2410 may include a bore (not shown) instead of a hosel portion (not shown). For example, the body portion 2410 may be made partially or entirely of an aluminum-based material, a magnesium-type material, a steel-based material, a titanium-based material, any combination thereof, or any other suitable material. In another example the body portion 2410 may be made partially or entirely of a non-metal material such as a ceramic material, a composite material, any combination thereof, or any other suitable material.

The golf club head 2400 may have a club head volume greater than or equal to 300 cubic centimeters ($cm^3$ or cc). In one example, the golf club head 2400 may be about 460 cc. Alternatively, the golf club head 2400 may have a club head volume less than or equal to 300 cc. In particular, the golf club head 2400 may have a club head volume between 100 cc and 200 cc. The club head volume of the golf club head 2400 may be determined by using the weighted water displacement method (i.e., Archimedes Principle). For example, procedures defined by golf standard organizations and/or governing bodies such as the United States Golf Association (USGA) and/or the Royal and Ancient Golf Club of St. Andrews (R&A) may be used for measuring the club head volume of the golf club head 2400. Although FIG. 24 may depict a particular type of club head (e.g., a driver-type club head), the apparatus, methods, and articles of manufacture described herein may be applicable to other types of club head (e.g., a fairway wood-type club head, a hybrid-type club head, an iron-type club head, a putter-type club head, etc.). Accordingly, the golf club head 2400 may be any type of club head such as the club heads described herein. The apparatus, methods, and articles of manufacture described herein are not limited in this regard.

The body portion 2410 may be a hollow body including the interior cavity 2490 near the bottom portion 2440 or at the bottom portion 2440 and extending between the front portion 2470 and the rear portion 2480. The interior cavity 2490 may extend between the top portion 2430 and the bottom portion 2440. In one example, the interior cavity 2490 may be unfilled (i.e., empty space). Alternatively, the interior cavity 2490 may be partially or entirely filled with an elastic polymer or elastomer material (e.g., a viscoelastic urethane polymer material such as Sorbothane® material manufactured by Sorbothane, Inc., Kent, Ohio), a thermoplastic elastomer material (TPE), a thermoplastic polyurethane material (TPU), and/or other suitable types of materials to absorb shock, isolate vibration, and/or dampen noise. For example, at least 50% of the interior cavity 2490 may be filled with a TPE material to absorb shock, isolate vibration, and/or dampen noise when the golf club head 2300 strikes a golf ball via the face portion 2475. The apparatus, methods, and articles of manufacture described herein are not limited in this regard.

In one example, the interior cavity may be filled with an elastic polymer or elastomer material through at least one of the weight ports such as the weight port shown as 2420. As illustrated in FIG. 24, for example, the golf club head 2400 may include one or more weight ports (e.g., one shown as 2420) with a first opening 2422 and a second opening 2424. The second opening 2424 may be used to access the interior cavity 2490 through a conduit an interior port 2426. In one example, the interior cavity 2490 may be filled with an elastic polymer material (e.g., generally shown as 2498) by injecting the elastic polymer material into the interior cavity 2490 from the first opening 2422 via the second opening 2424 and through the interior port 2426. The first and second openings 2422 and 2424, respectively, may be same or different in size and/or shape. While the above example may describe and depict a particular weight port with a second opening, any other weight ports (not shown) of the golf club head 2400 may include a second opening The apparatus, methods, and articles of manufacture described herein are not limited in this regard.

Figure 25:
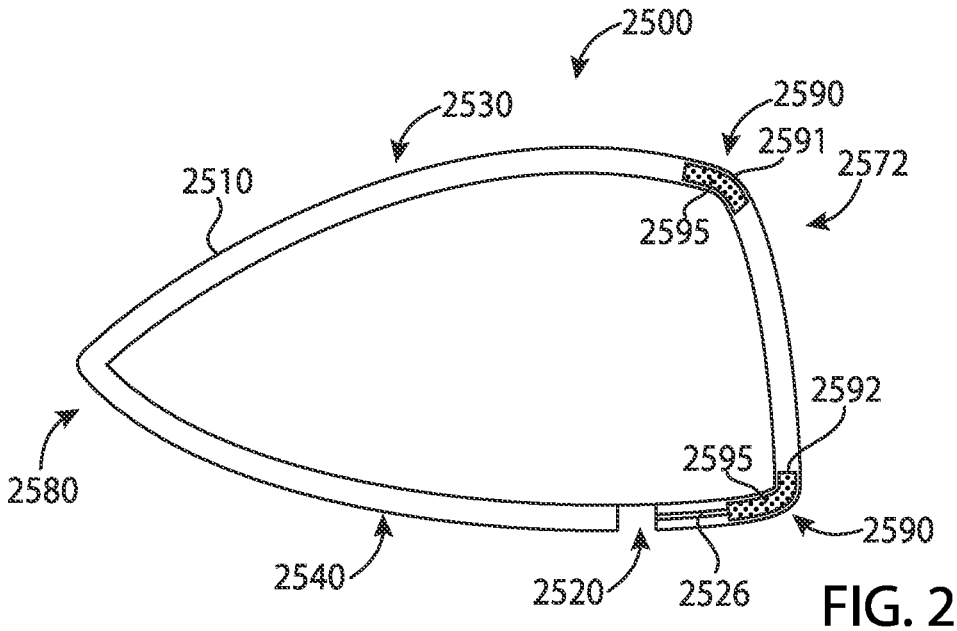
FIG. 25 depicts a schematic side cross-sectional view of another example golf club head.
Figure 26:
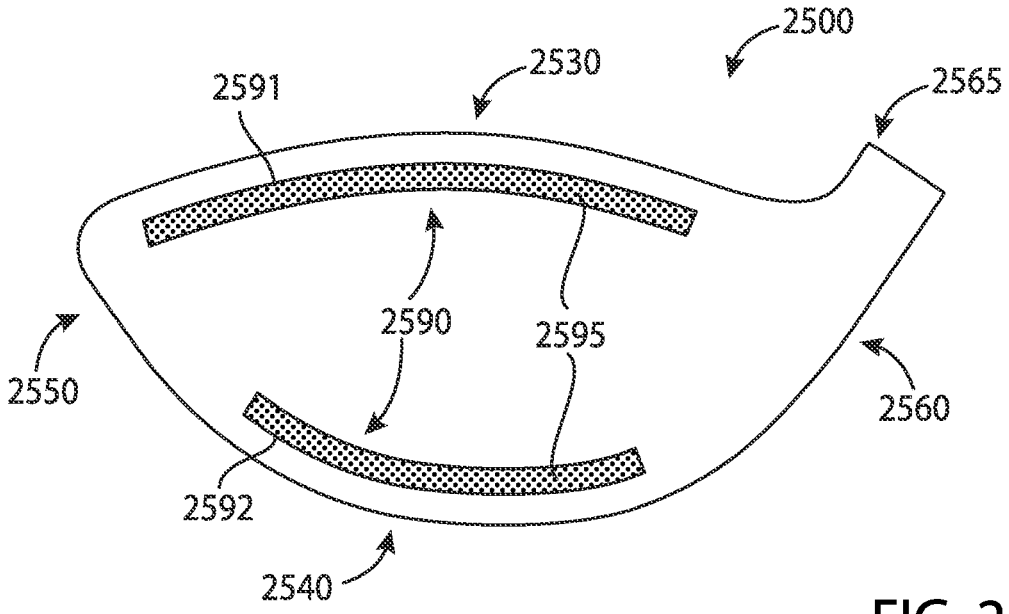
FIG. 26 depicts a schematic front cross-section view of the golf club head of FIG. 25.

In the example of FIGS. 25 and 26, a golf club head 2500 may include a body portion 2510. The golf club head 2500 may include a plurality of weight ports (e.g. one is generally shown as 2520) and a plurality of weight portions, which may be similar in many respects to the weight ports and weight portions of the golf club heads described herein. Accordingly, a detailed description of the weight ports and the weight portions of the golf club head 2500 is not provided. Alternatively, the golf club head 2500 may not include any weight ports and/or weight portions. The body portion 2510 may include a top portion 2530, a bottom portion 2540, a toe portion 2550, a heel portion 2560, a front portion 2570, and a rear portion 2580. The bottom portion 2540 may include a skirt portion (not shown) defined as a side portion of the golf club head 2500 between the top portion 2530 and the bottom portion 2540 excluding the front portion 2570 and extending across a periphery of the golf club head 2500 from the toe portion, around the rear portion 2580, and to the heel portion 2560. The bottom portion 2540 may include one or more weight port regions (not shown). For example, a weight port region may include a plurality of weight ports, one of which is generally shown as 2520, to receive a plurality of weight portions (not shown). The front portion 2570 may include a face portion 2575 to engage a golf ball (not shown). The body portion 2510 may also include a hosel portion 2565 to receive a shaft (not shown). Alternatively, the body portion 2510 may include a bore (not shown) instead of a hosel portion 2565. For example, the body portion 2510 may be made partially or entirely of an aluminum-based material, a magnesium-type material, a steel-based material, a titanium-based material, any combination thereof, or any other suitable material. In another example the body portion 2510 may be made partially or entirely of a non-metal material such as a ceramic material, a composite material, any combination thereof, or any other suitable material.

The golf club head 2500 may have a club head volume greater than or equal to 300 cubic centimeters ($cm^3$ or cc). In one example, the golf club head 2500 may be about 460 cc. Alternatively, the golf club head 2500 may have a club head volume less than or equal to 300 cc. In particular, the golf club head 2500 may have a club head volume between 100 cc and 200 cc. The club head volume of the golf club head 2500 may be determined by using the weighted water displacement method (i.e., Archimedes Principle). For example, procedures defined by golf standard organizations and/or governing bodies such as the United States Golf Association (USGA) and/or the Royal and Ancient Golf Club of St. Andrews (R&A) may be used for measuring the club head volume of the golf club head 2500. Although FIGS. 25 and 26 may depict a particular type of club head (e.g., a driver-type club head), the apparatus, methods, and articles of manufacture described herein may be applicable to other types of club head (e.g., a fairway wood-type club head, a hybrid-type club head, an iron-type club head, a putter-type club head, etc.). Accordingly, the golf club head 2500 may be any type of club head such as the club heads described herein. The apparatus, methods, and articles of manufacture described herein are not limited in this regard.

The body portion 2510 may be a hollow body including one or more interior cavities 2590, which may be located in a transition region between the top portion 2530 and the front portion 2570, in a transition region between the bottom portion 2540 and the front portion 2570, in a transition region between the toe portion 2550 and the front portion 2570, and/or in a transition region between the heel portion 2560 and the front portion 2570. In FIGS. 25 and 26, the body portion 2510 includes two interior cavities that are generally shown as interior cavities 2591 and 2592. The interior cavity 2591 may extend between the top portion 2530 and the front portion 2570. The interior cavity 2591 may be in a transition region between the top portion 2530 and the front portion 2570. The interior cavity 2592 may extend between the bottom portion 2540 and the front portion 2570. The interior cavity 2592 may be in a transition region between the bottom portion 2540 and the front portion 2570. In one example, any one or both of the interior cavities 2591 and 2592 may be unfilled (i.e., empty space). Alternatively, the interior cavities 2591 and 2592 may be partially or entirely filled with an elastic polymer or elastomer material (e.g., a viscoelastic urethane polymer material such as Sorbothane® material manufactured by Sorbothane, Inc., Kent, Ohio), a thermoplastic elastomer material (TPE), a thermoplastic polyurethane material (TPU), and/or other suitable types of materials to absorb shock, isolate vibration, and/or dampen noise. The elastic polymer or elastomer material is generally shown as 2595. For example, at least 50% of the interior cavities 2591 and 2592 may be filled with a TPE material to absorb shock, isolate vibration, and/or dampen noise when the golf club head 2500 strikes a golf ball via the face portion 2575. At least partially or filling the interior cavities 2591 and 2592 may also change the feel and sound of the golf club to an individual when striking a golf ball. The elastomer material may also provide structural support for the body portion 2510 near the interior cavities 2591 and 2592. The elastomer material may be a non-foaming injection moldable elastomer material that can provide structural support for adjacent portions of the body portion. The apparatus, methods, and articles of manufacture described herein are not limited in this regard.

In one example, the interior cavities 2591 and 2592 may be filled with an elastic polymer or elastomer material through at least one of the weight ports such as the weight port shown as 2520. For example, the weight port 2520 may include an interior port 2526 connecting the weight port 2520 to the interior cavity 2591. The interior cavities 2591 and 2592 may be also filled with an elastic polymer or elastomer material through the hosel portion 2565. Alternatively, the body portion 2510 may include one or more openings (not shown) near the interior cavities 2591 and 2592. An elastic polymer or elastomer material may be injected into the interior cavities 2591 and 2592 through the one or more openings. The openings may then be closed after the process of injecting the elastic polymer or elastomer material into the interior cavities 2591 and 2592 is complete. The apparatus, methods, and articles of manufacture described herein are not limited in this regard.

Figure 27:
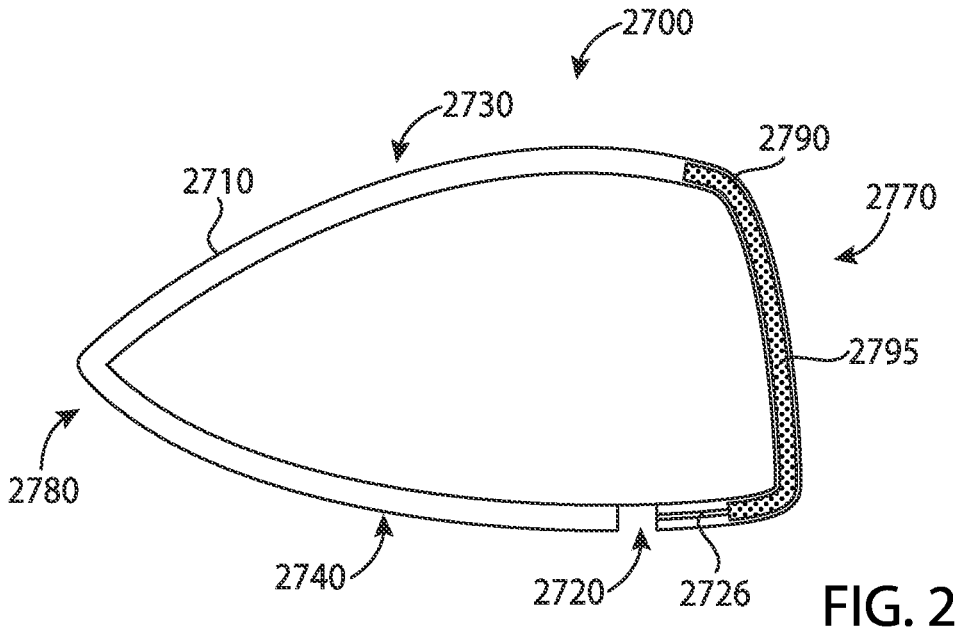
FIG. 27 depicts a schematic side cross-sectional view of another example golf club head.
Figure 28:
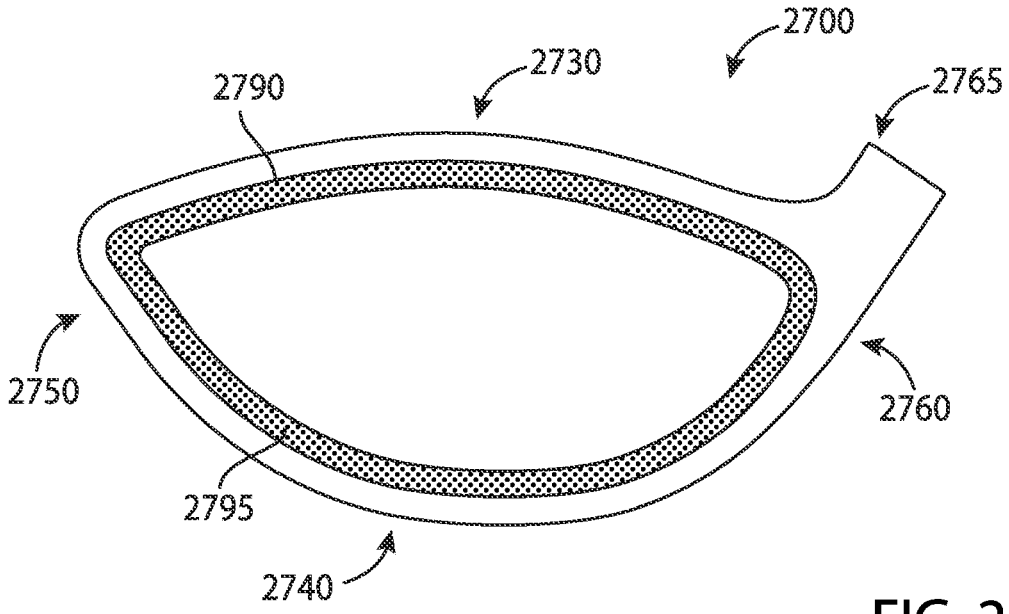
FIG. 28 depicts a schematic front cross-sectional view of the golf club head of FIG. 27.

In the example of FIGS. 27 and 28, a golf club head 2700 may include a body portion 2710. The golf club head 2700 may include a plurality of weight ports (e.g. one is generally shown as 2720) and a plurality of weight portions that may be similar in many respects to the weight ports and weight portions of the golf club heads described herein. Accordingly, a detailed description of the weight ports and the weight portions of the golf club head 2700 is not provided. Alternatively, the golf club head 2700 may not include any weight ports or weight portions. The body portion 2710 may include a top portion 2730, a bottom portion 2740, a toe portion 2750, a heel portion 2760, a front portion 2770, and a rear portion 2780.

The bottom portion 2740 may include a skirt portion (not shown) defined as a side portion of the golf club head 2700 between the top portion 2730 and the bottom portion 2740 excluding the front portion 2770 and extending across a periphery of the golf club head 2700 from the toe portion, around the rear portion 2780, and to the heel portion 2760. The bottom portion 2740 may include one or more weight port regions (not shown). For example, a weight port region may include a plurality of weight ports, one of which is generally shown as 2720, to receive a plurality of weight portions (not shown). The front portion 2770 may include a face portion 2775 to engage a golf ball (not shown). The body portion 2710 may also include a hosel portion 2765 to receive a shaft (not shown). Alternatively, the body portion 2710 may include a bore (not shown) instead of a hosel portion 2765. For example, the body portion 2710 may be made partially or entirely of an aluminum-based material, a magnesium-type material, a steel-based material, a titanium-based material, any combination thereof, or any other suitable material. In another example the body portion 2710 may be made partially or entirely of a non-metal material such as a ceramic material, a composite material, any combination thereof, or any other suitable material.

The golf club head 2700 may have a club head volume greater than or equal to 300 cubic centimeters ($cm^3$ or cc). In one example, the golf club head 2700 may be about 460 cc. Alternatively, the golf club head 2700 may have a club head volume less than or equal to 300 cc. In particular, the golf club head 2700 may have a club head volume between 100 cc and 200 cc. The club head volume of the golf club head 2700 may be determined by using the weighted water displacement method (i.e., Archimedes Principle). For example, procedures defined by golf standard organizations and/or governing bodies such as the United States Golf Association (USGA) and/or the Royal and Ancient Golf Club of St. Andrews (R&A) may be used for measuring the club head volume of the golf club head 2700. Although FIGS. 27 and 28 may depict a particular type of club head (e.g., a driver-type club head), the apparatus, methods, and articles of manufacture described herein may be applicable to other types of club head (e.g., a fairway wood-type club head, a hybrid-type club head, an iron-type club head, a putter-type club head, etc.). Accordingly, the golf club head 2700 may be any type of club head such as the club heads described herein. The apparatus, methods, and articles of manufacture described herein are not limited in this regard.

The body portion 2710 may be a hollow body including one or more interior cavities 2790, which may be located in a transition region between the top portion 2730 and the front portion 2770, in a transition region between the toe portion 2750 and the front portion 2770, in a transition region between the bottom portion 2740 and the front portion 2770, and/or in a transition region between the heel portion 2760 and the front portion 2770. In FIGS. 27 and 28, the body portion 2710 includes an interior cavity 2790 that extends near the entire perimeter of the front portion 2770 in a transition region between the top portion 2730, the bottom portion 2740, the toe portion 2750, the heel portion 2760, and the front portion 2770. Accordingly, as shown in FIG. 28, the interior cavity 2790 may resemble a loop having generally the same shape as the perimeter of the front portion 2770.

In one example, the interior cavity 2790 may be unfilled (i.e., empty space). Alternatively, the interior cavity 2790 may be partially or entirely filled with an elastic polymer or elastomer material (e.g., a viscoelastic urethane polymer material such as Sorbothane® material manufactured by Sorbothane, Inc., Kent, Ohio), a thermoplastic elastomer material (TPE), a thermoplastic polyurethane material (TPU), and/or other suitable types of materials to absorb shock, isolate vibration, and/or dampen noise. The elastic polymer or elastomer material is generally shown as 2795. For example, at least 50% of the interior cavity 2790 may be filled with a TPE material to absorb shock, isolate vibration, and/or dampen noise when the golf club head 2700 strikes a golf ball via the face portion 2775. At least partially or filling the interior cavity 2790 may also change the feel and sound of the golf club to an individual when striking a golf ball. The elastomer material may also provide structural support for the body portion 2710 near the interior cavity 2790. The elastomer material may be a non-foaming injection moldable elastomer material that can provide structural support for adjacent portions of the body portion. The apparatus, methods, and articles of manufacture described herein are not limited in this regard.

In one example, the interior cavity 2790 may be filled with an elastic polymer or elastomer material through at least one of the weight ports such as the weight port shown as 2720. For example, the weight port 2720 may include an interior port 2726 connecting the weight port 2720 to the interior cavity 2790. The interior cavity 2790 may be also filled with an elastic polymer or elastomer material through the hosel portion 2765. Alternatively, the body portion 2710 may include one or more openings (not shown) near the interior cavity 2790. An elastic polymer or elastomer material may be injected into the interior cavity 2790 through the one or more openings. The openings may then be closed after the process of injecting the elastic polymer with elastomer material into the interior cavity 2790 is complete. The apparatus, methods, and articles of manufacture described herein are not limited in this regard.

Figure 29:
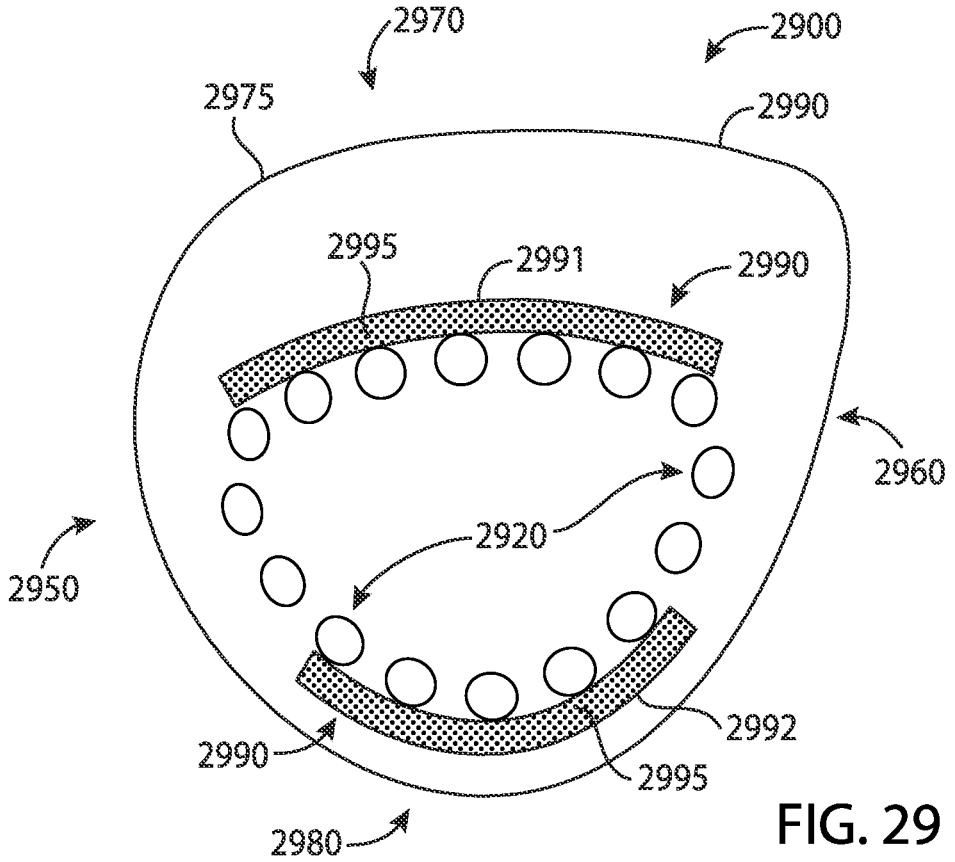
FIG. 29 depicts a schematic bottom cross-sectional view of another example golf club head.
Figure 30:
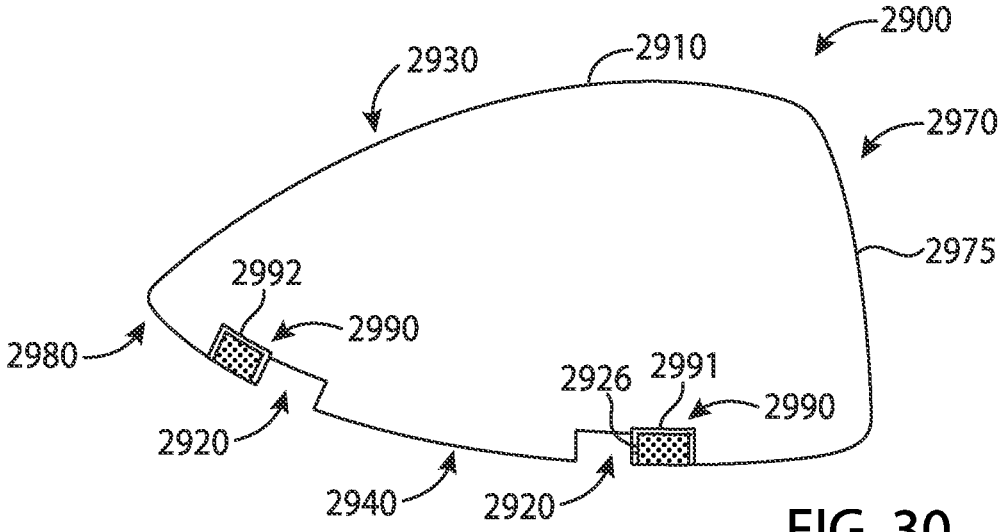
FIG. 30 depicts a schematic side cross-sectional view of the golf club head of FIG. 29.

In the example of FIGS. 29 and 30, a golf club head 2900 may include a body portion 2910. The golf club head 2900 may include a plurality of weight ports (e.g. one is generally shown as 2920) and a plurality of weight portions that may be similar in many respects to the weight ports and weight portions of the golf club heads described herein. Accordingly, a detailed description of the weight ports and the weight portions of the golf club head 2900 is not provided. Alternatively, the golf club head 2900 may not include any weight ports or weight portions. The body portion 2910 may include a top portion 2930, a bottom portion 2940, a toe portion 2950, a heel portion 2960, a front portion 2970, and a rear portion 2980. The bottom portion 2940 may include a skirt portion (not shown) defined as a side portion of the golf club head 2900 between the top portion 2930 and the bottom portion 2940 excluding the front portion 2970 and extending across a periphery of the golf club head 2900 from the toe portion, around the rear portion 2980, and to the heel portion 2960. The bottom portion 2940 may include one or more weight port regions (not shown). For example, a weight port region may include a plurality of weight ports, one of which is generally shown as 2920, to receive a plurality of weight portions (not shown). The front portion 2970 may include a face portion 2975 to engage a golf ball (not shown). The body portion 2910 may also include a hosel portion (not shown) to receive a shaft (not shown). Alternatively, the body portion 2910 may include a bore (not shown) instead of a hosel portion. For example, the body portion 2910 may be made partially or entirely of an aluminum-based material, a magnesium-type material, a steel-based material, a titanium-based material, any combination thereof, or any other suitable material. In another example the body portion 2910 may be made partially or entirely of a non-metal material such as a ceramic material, a composite material, any combination thereof, or any other suitable material.

The golf club head 2900 may have a club head volume greater than or equal to 300 cubic centimeters ($cm^3$ or cc). In one example, the golf club head 2900 may be about 460 cc. Alternatively, the golf club head 2900 may have a club head volume less than or equal to 300 cc. In particular, the golf club head 2900 may have a club head volume between 100 cc and 200 cc. The club head volume of the golf club head 2900 may be determined by using the weighted water displacement method (i.e., Archimedes Principle). For example, procedures defined by golf standard organizations and/or governing bodies such as the United States Golf Association (USGA) and/or the Royal and Ancient Golf Club of St. Andrews (R&A) may be used for measuring the club head volume of the golf club head 2900. Although FIGS. 29 and 30 may depict a particular type of club head (e.g., a driver-type club head), the apparatus, methods, and articles of manufacture described herein may be applicable to other types of club head (e.g., a fairway wood-type club head, a hybrid-type club head, an iron-type club head, a putter-type club head, etc.). Accordingly, the golf club head 2900 may be any type of club head such as the club heads described herein. The apparatus, methods, and articles of manufacture described herein are not limited in this regard.

The body portion 2910 may be a hollow body including one or more interior cavities 2990, which may at or near the bottom portion 2940 and/or in a transition region between the bottom portion 2940 and the front portion 2970, in a transition region between the bottom portion 2940 and the toe portion 2950, in a transition region between the bottom portion 2940 and the heel portion 2960, and/or in a transition region between the bottom portion 2940 and the rear portion 2980. In FIGS. 29 and 30, the body portion 2910 includes two interior cavities that are generally shown as interior cavities 2991 and 2992. The interior cavity 2991 may be at or near the bottom portion between the weight ports 2920 and the front portion 2970 and extend between the toe portion 2950 and the heel portion 2960. The interior cavity 2992 may be at or near the bottom portion between the weight ports 2920 and the rear portion 2980 and extend between the toe portion 2950 and the heel portion 2960. In one example, any one or both of the interior cavities 2991 and 2992 may be unfilled (i.e., empty space). Alternatively, the interior cavities 2991 and 2992 may be partially or entirely filled with an elastic polymer or elastomer material (e.g., a viscoelastic urethane polymer material such as Sorbothane® material manufactured by Sorbothane, Inc., Kent, Ohio), a thermoplastic elastomer material (TPE), a thermoplastic polyurethane material (TPU), and/or other suitable types of materials to absorb shock, isolate vibration, and/or dampen noise. The elastic polymer or elastomer material is generally shown as 2995. For example, at least 50% of the interior cavities 2991 and 2992 may be filled with a TPE material to absorb shock, isolate vibration, and/or dampen noise when the golf club head 2900 strikes a golf ball via the face portion 2975. At least partially or filling the interior cavities 2991 and 2992 may also change the feel and sound of the golf club to an individual when striking a golf ball. The elastomer material may also provide structural support for the body portion 2910 near the interior cavities 2991 and 2992. The elastomer material may be a non-foaming injection moldable elastomer material that can provide structural support for adjacent portions of the body portion. The apparatus, methods, and articles of manufacture described herein are not limited in this regard.

In one example, the interior cavities 2991 and 2992 may be filled with an elastic polymer or elastomer material through at least one of the weight ports such as the weight port shown as 2920. For example, the weight port 2920 that is shown in FIG. 30 as being near the front portion 2970 may include an interior port 2926 connecting the weight port 2920 to the interior cavity 2991. Alternatively, the body portion 2910 may include one or more openings (not shown) near the interior cavities 2991 and 2992. An elastic polymer or elastomer material may be injected into the interior cavities 2991 and 2992 through the one or more openings. The openings may then be closed after the process of injecting the elastic polymer with elastomer material into the interior cavities 2991 and 2992 is complete. The apparatus, methods, and articles of manufacture described herein are not limited in this regard.

Figure 31:
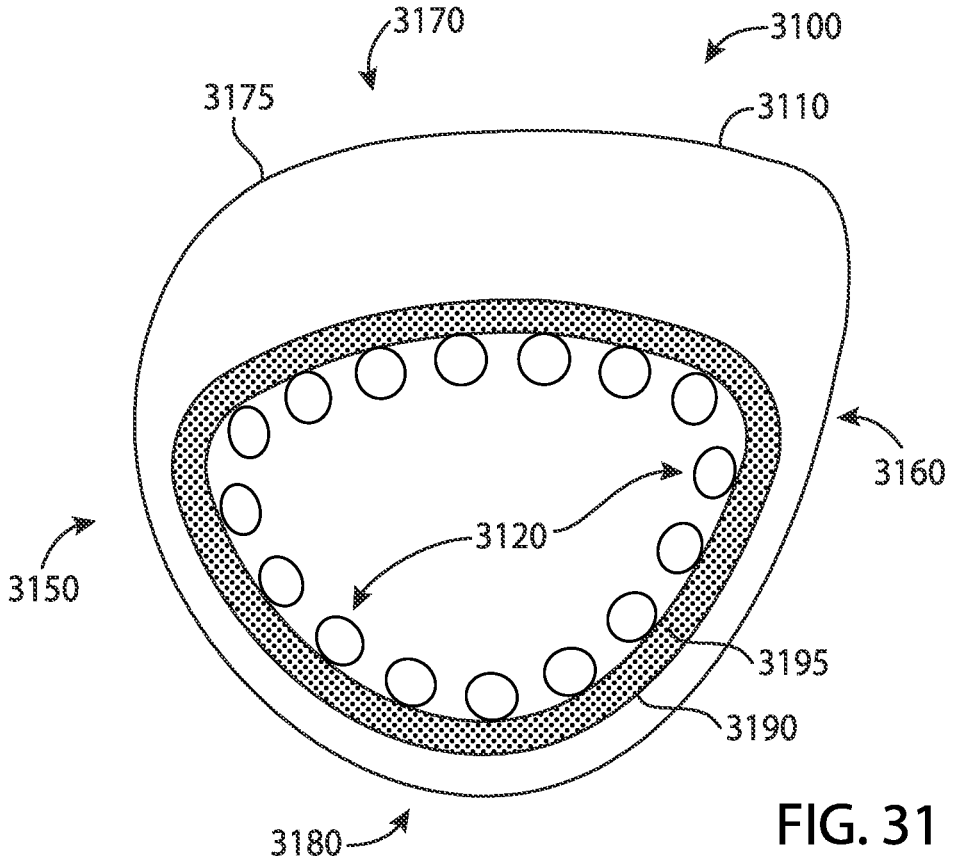
FIG. 31 depicts a schematic bottom cross-sectional view of another example golf club head.
Figure 32:
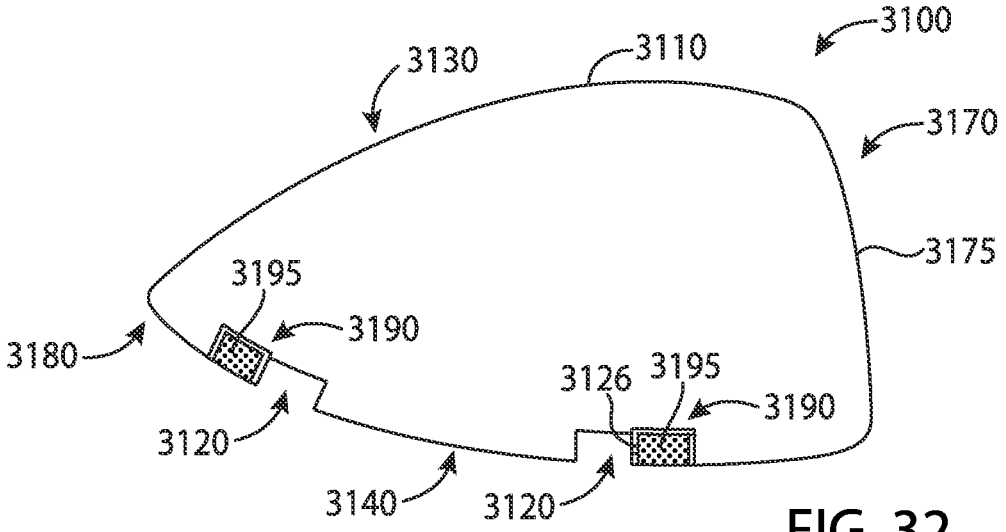
FIG. 32 depicts a schematic side cross-sectional view of the golf club head of FIG. 31.
Figure 33:
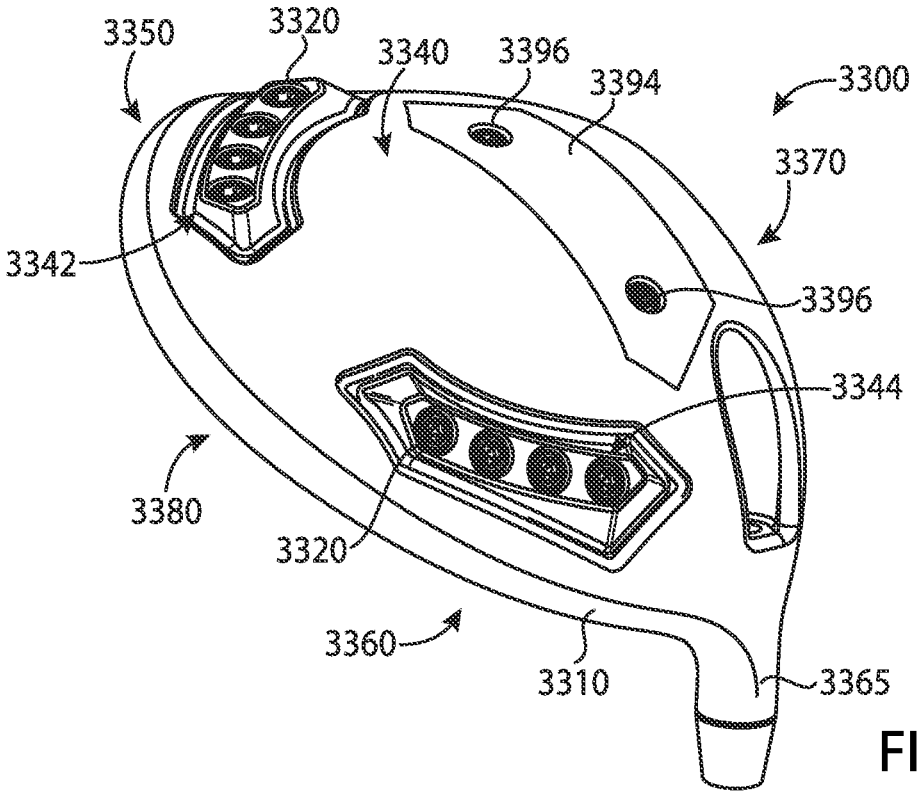
FIG. 33 depicts a bottom perspective view of another example golf club head.

In the example of FIGS. 31 and 32, a golf club head 3100 may include a body portion 3110. The golf club head 3100 may include a plurality of weight ports (e.g. one is generally shown as 3120) and a plurality of weight portions that may be similar in many respects to the weight ports and weight portions of the golf club heads described herein. Accordingly, a detailed description of the weight ports and the weight portions of the golf club head 3100 is not provided. Alternatively, the golf club head 3100 may not include any weight ports or weight portions. The body portion 3110 may include a top portion 3130, a bottom portion 3140, a toe portion 3150, a heel portion 3160, a front portion 3170, and a rear portion 3180. The bottom portion 3140 may include a skirt portion (not shown) defined as a side portion of the golf club head 3100 between the top portion 3130 and the bottom portion 3140 excluding the front portion 3170 and extending across a periphery of the golf club head 3100 from the toe portion, around the rear portion 3180, and to the heel portion 3160. The bottom portion 3140 may include one or more weight port region (not shown). For example, a weight port region may include a plurality of weight ports, one of which is generally shown as 3120, to receive a plurality of weight portions (not shown). The front portion 3170 may include a face portion 3175 to engage a golf ball (not shown). The body portion 3110 may also include a hosel portion (not shown) to receive a shaft (not shown). Alternatively, the body portion 3110 may include a bore (not shown) instead of a hosel portion. For example, the body portion 3110 may be made partially or entirely of an aluminum-based material, a magnesium-type material, a steel-based material, a titanium-based material, any combination thereof, or any other suitable material. In another example the body portion 3110 may be made partially or entirely of a non-metal material such as a ceramic material, a composite material, any combination thereof, or any other suitable material.

The golf club head 3100 may have a club head volume greater than or equal to 300 cubic centimeters ($cm^3$ or cc). In one example, the golf club head 3100 may be about 460 cc. Alternatively, the golf club head 3100 may have a club head volume less than or equal to 300 cc. In particular, the golf club head 3100 may have a club head volume between 100 cc and 200 cc. The club head volume of the golf club head 3100 may be determined by using the weighted water displacement method (i.e., Archimedes Principle). For example, procedures defined by golf standard organizations and/or governing bodies such as the United States Golf Association (USGA) and/or the Royal and Ancient Golf Club of St. Andrews (R&A) may be used for measuring the club head volume of the golf club head 3100. Although FIGS. 31 and 32 may depict a particular type of club head (e.g., a driver-type club head), the apparatus, methods, and articles of manufacture described herein may be applicable to other types of club head (e.g., a fairway wood-type club head, a hybrid-type club head, an iron-type club head, a putter-type club head, etc.). Accordingly, the golf club head 3100 may be any type of club head such as the club heads described herein. The apparatus, methods, and articles of manufacture described herein are not limited in this regard.

The body portion 3110 may be a hollow body including one or more interior cavities 3190, which may at or near the bottom portion 3140 between the front portion 3170, the toe portion 3150, the heel portion 3160 and the rear portion 3180. In FIGS. 31 and 32, the body portion 3110 includes an interior cavity 3190 that may be at or near the bottom portion and extend in a loop around the weight portions 3120. In one example, the interior cavity 3190 may be unfilled (i.e., empty space). Alternatively, the interior cavity 3190 may be partially or entirely filled with an elastic polymer or elastomer material (e.g., a viscoelastic urethane polymer material such as Sorbothane® material manufactured by Sorbothane, Inc., Kent, Ohio), a thermoplastic elastomer material (TPE), a thermoplastic polyurethane material (TPU), and/or other suitable types of materials to absorb shock, isolate vibration, and/or dampen noise. The elastic polymer or elastomer material is generally shown as 3195. For example, at least 50% of the interior cavity 3190 may be filled with a TPE material to absorb shock, isolate vibration, and/or dampen noise when the golf club head 3100 strikes a golf ball via the face portion 3175. At least partially or filling the interior cavity 3190 may also change the feel and sound of the golf club to an individual when striking a golf ball. The elastomer material may also provide structural support for the body portion 3110 near the interior cavity 3190. The elastomer material may be a non-foaming injection moldable elastomer material that can provide structural support for adjacent portions of the body portion. The apparatus, methods, and articles of manufacture described herein are not limited in this regard.

In one example, the interior cavity 3190 may be filled with an elastic polymer or elastomer material through at least one of the weight ports 3120. For example, the weight port 3120 that is shown in FIG. 32 to be near the front portion 3170 may include an interior port 3126 connecting the weight port 3120 to the interior cavity 3190. Alternatively, the body portion 3110 may include one or more openings (not shown) near the interior cavity 3190. An elastic polymer or elastomer material may be injected into the interior cavity 3190 through the one or more openings. The openings may then be closed after the process of injecting the elastic polymer with elastomer material into the interior cavity 3190 is complete. The apparatus, methods, and articles of manufacture described herein are not limited in this regard.

A golf club head may include any one or a combination of the interior cavities 2590, 2790, 2990 and 3190. For example, a golf club head may include the interior cavities 2590 and 2990. In another example, a golf club head may include the interior cavities 2790 and 3190. In the examples provided herein, the interior cavities are shown to have a certain configuration. However, the interior cavities may have any configuration. For example, the interior cavities 2591 and/or 2592 may extend between the toe portion 2550 and the heel portion 2560 in a smaller length than shown in FIG. 26. In another example, the body portion 2510 may include a plurality of separate internal cavities of similar or different configurations that may be located in a transition region between the top portion 2530 and the front portion 2570, in a transition region between the bottom portion 2540 and the front portion 2570, in a transition region between the toe portion 2550 and the front portion 2570, and/or in a transition region between the heel portion 2560 and the front portion 2570. In another example, any one of the weight ports described herein may extend into any one of the interior cavities described herein. Accordingly, such weight ports may be partially or fully surrounded with an elastic polymer material if the corresponding interior cavity is filled with the elastic polymer material. The apparatus, methods, and articles of manufacture described herein are not limited in this regard.

In the example of FIGS. 33-41, a golf club head 3300 may include a body portion 3310. The golf club head 3300 may include a plurality of weight ports (e.g., one is generally shown as 3320) and a plurality of weight portions that may be similar in many respects to the weight ports and weight portions, respectively, of the golf club heads described herein. Accordingly, a detailed description of the weight ports and the weight portions of the golf club head 3300 is not provided. Alternatively, the golf club head 3300 may not include any weight ports or weight portions. The body portion 3310 may include a top portion 3330, a bottom portion 3340, a toe portion 3350, a heel portion 3360, a front portion 3370, and a rear portion 3380. The bottom portion 3340 may include a skirt portion (not shown) defined as a side portion of the golf club head 3300 between the top portion 3330 and the bottom portion 3340 excluding the front portion 3370 and extending across a periphery of the golf club head 3300 from the toe portion 3350, around the rear portion 3380, and to the heel portion 3360.

The bottom portion 3340 may include one or more weight port region, generally shown as a first weight port region 3342 and a second weight port region 3344. For example, each of the first and second weight port regions 3342 and 3344, respectively, may include a plurality of weight ports, one of which is generally shown as 3320, to receive a plurality of weight portions. The front portion 3370 may include a face portion 3375 to engage a golf ball (not shown). The body portion 3310 may also include a hosel portion 3365 to receive a shaft (not shown). Alternatively, the body portion 3310 may include a bore (not shown) instead of a hosel portion 3365. For example, the body portion 3310 may be made partially or entirely of an aluminum-based material, a magnesium-type material, a steel-based material, a titanium-based material, any combination thereof, or any other suitable material. In another example the body portion 3310 may be made partially or entirely of a non-metal material such as a ceramic material, a composite material, any combination thereof, or any other suitable material.

The golf club head 3300 may have a club head volume greater than or equal to 300 cubic centimeters ($cm^3$ or cc). In one example, the golf club head 3300 may be about 460 cc. Alternatively, the golf club head 3300 may have a club head volume less than or equal to 300 cc. In particular, the golf club head 3300 may have a club head volume between 100 cc and 200 cc. The club head volume of the golf club head 3300 may be determined by using the weighted water displacement method (i.e., Archimedes Principle). For example, procedures defined by golf standard organizations and/or governing bodies such as the United States Golf Association (USGA) and/or the Royal and Ancient Golf Club of St. Andrews (R&A) may be used for measuring the club head volume of the golf club head 3300. Although FIG. 33 may depict a particular type of club head (e.g., a driver-type club head), the apparatus, methods, and articles of manufacture described herein may be applicable to other types of club head (e.g., a fairway wood-type club head, a hybrid-type club head, an iron-type club head, a putter-type club head, etc.). Accordingly, the golf club head 3300 may be any type of club head such as the club heads described herein. The apparatus, methods, and articles of manufacture described herein are not limited in this regard.

The body portion 3310 may be a hollow body including a first interior cavity 3385 and a second interior cavity 3390. The first interior cavity 3385 and the second interior cavity 3390 may generally define a volume of the body portion 3310, with the first interior cavity substantially defining the volume of the body portion 3310. Accordingly, the first interior cavity 3385 may be substantially greater than the second interior cavity 3390. Alternatively, the first interior cavity 3385 may define the volume of the body portion 3310 when the second interior cavity 3390 is considered to be recess in the bottom portion 3340.

The second interior cavity 3390 may be near the bottom portion 3340 or at the bottom portion 3340 and extend between the front portion 3370 and the rear portion 3380. The second interior cavity 3390 may extend between the top portion 3330 and the bottom portion 3340. The second interior cavity 3390 may be defined by a recessed portion 3392 of the bottom portion 3340 that is covered with a bottom cover 3394. The space between the recessed portion 3392 of the bottom portion 3340 and the bottom cover 3394 may define the second interior cavity 3390. Accordingly, a portion of the bottom portion 3340 may be between the first interior cavity 3385 and the second interior cavity 3390. Alternatively, the bottom cover 3394 may be considered a portion of the bottom portion 3340 so that the second interior cavity 3390 is considered to be a part of the total volume of the body portion 3310. The second interior cavity 3390 may be at any location on the body portion 3310.

In one example, the second interior cavity 3390 may be near the front portion 3370 and have a length that extends between the toe portion 3350 and the heel portion 3360 and may be greater than or equal to a portion of the face portion 3375 that engages or strikes a golf ball. Accordingly, the second interior cavity 3390 may be located proximate and behind the face portion 3375. In one example, the second interior cavity 3390 may have any shape, configuration, length and/or width.

Figure 34:
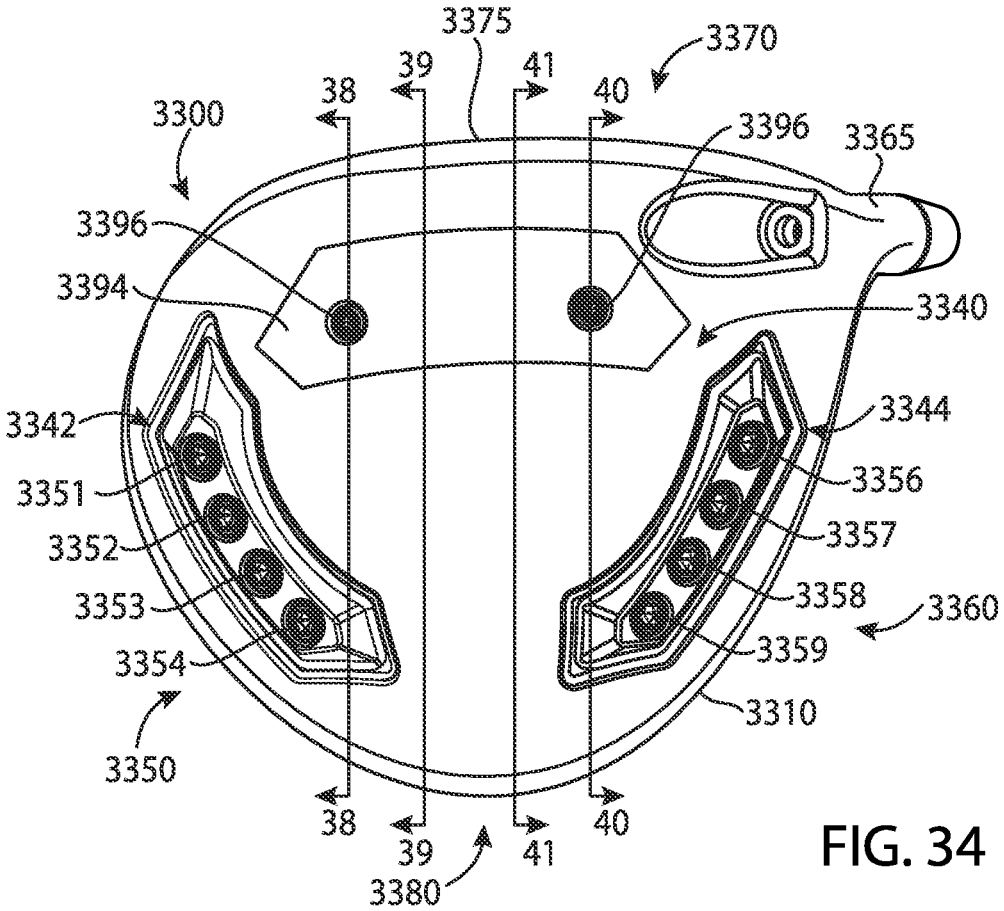
FIG. 34 depicts a bottom view of the golf club head of FIG. 33.
Figure 35:
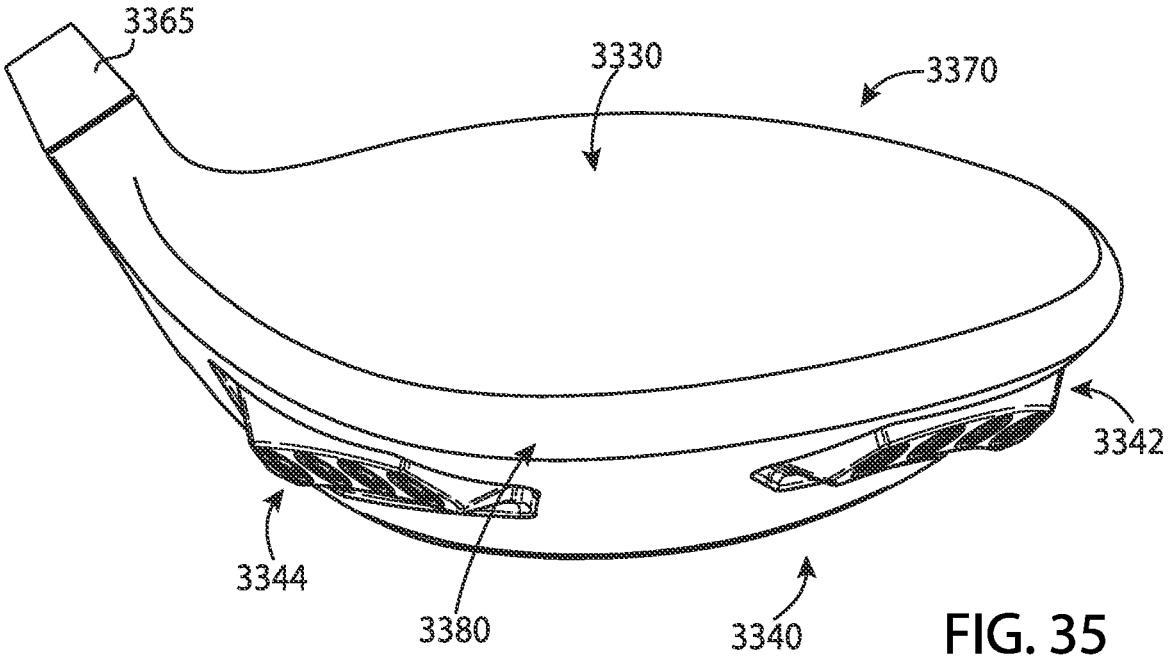
FIG. 35 depicts a rear view of the golf club head of FIG. 33.
Figure 36:
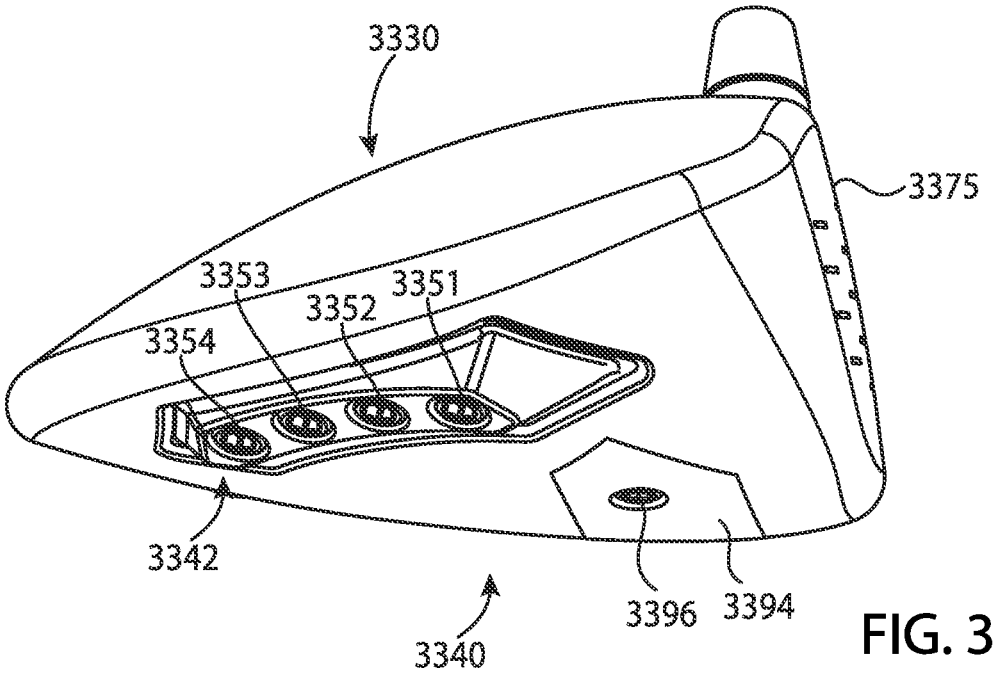
FIG. 36 depicts a toe view of the golf club head of FIG. 33.
Figure 37:
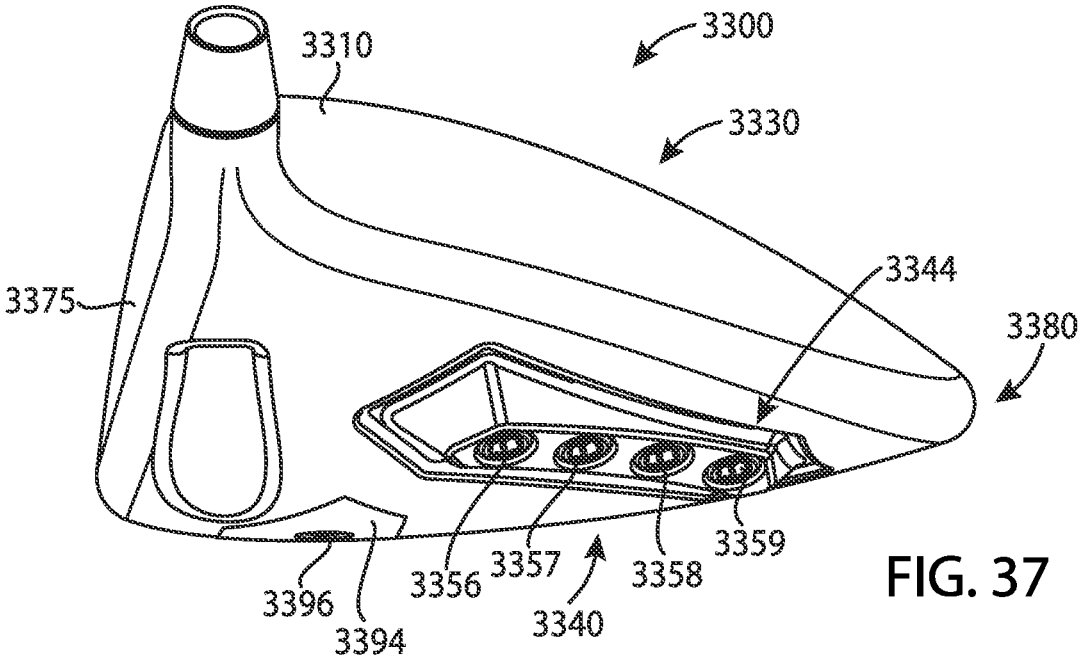
FIG. 37 depicts a heel view of the golf club head of FIG. 33.
Figure 38:
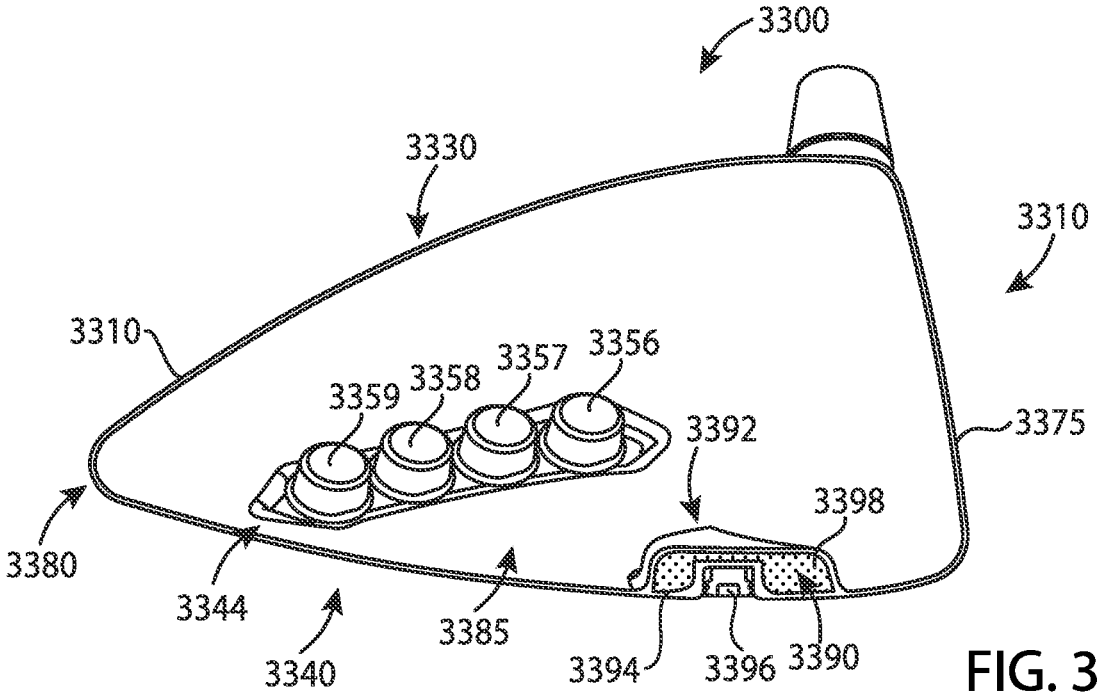
FIG. 38 depicts a side cross-sectional view of the golf club head of FIG. 33 along line 38-38.
Figure 39:
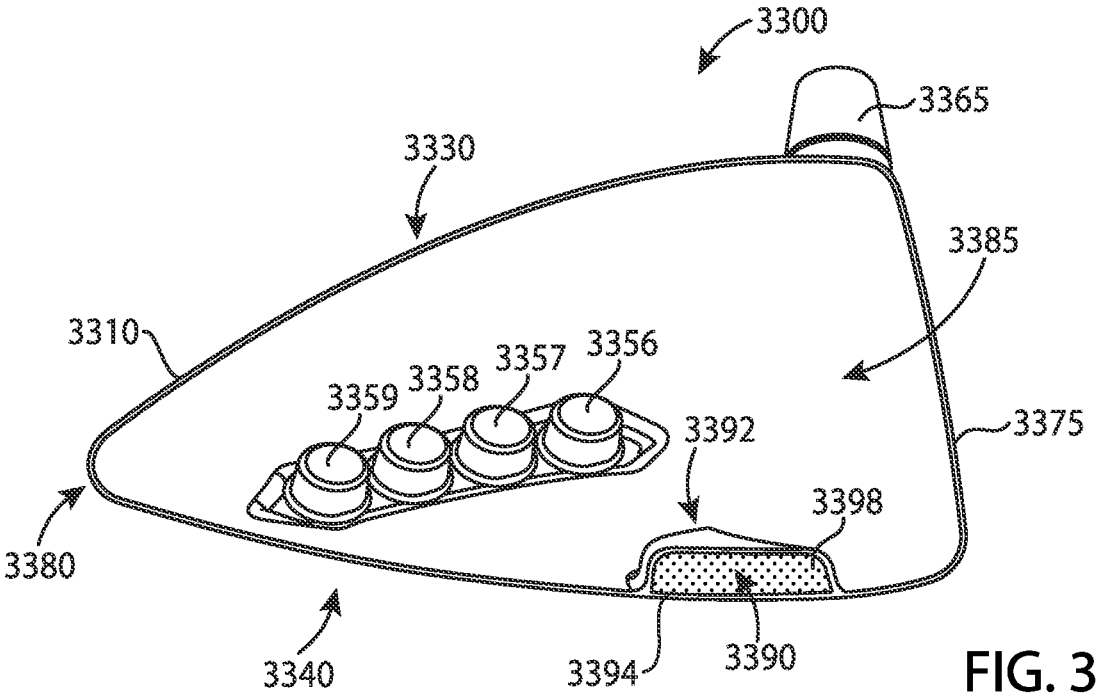
FIG. 39 depicts another side cross-sectional view of the golf club head of FIG. 33 along line 39-39.
Figure 40:
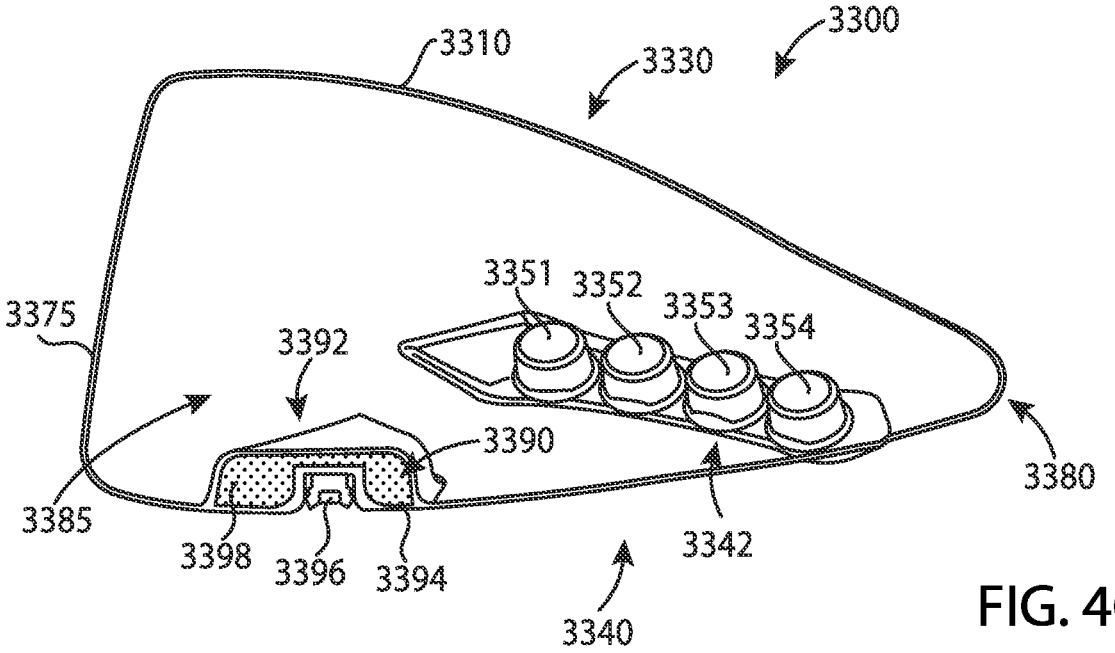
FIG. 40 depicts another side cross-sectional view of the golf club head of FIG. 33 along line 40-40.
Figure 41:
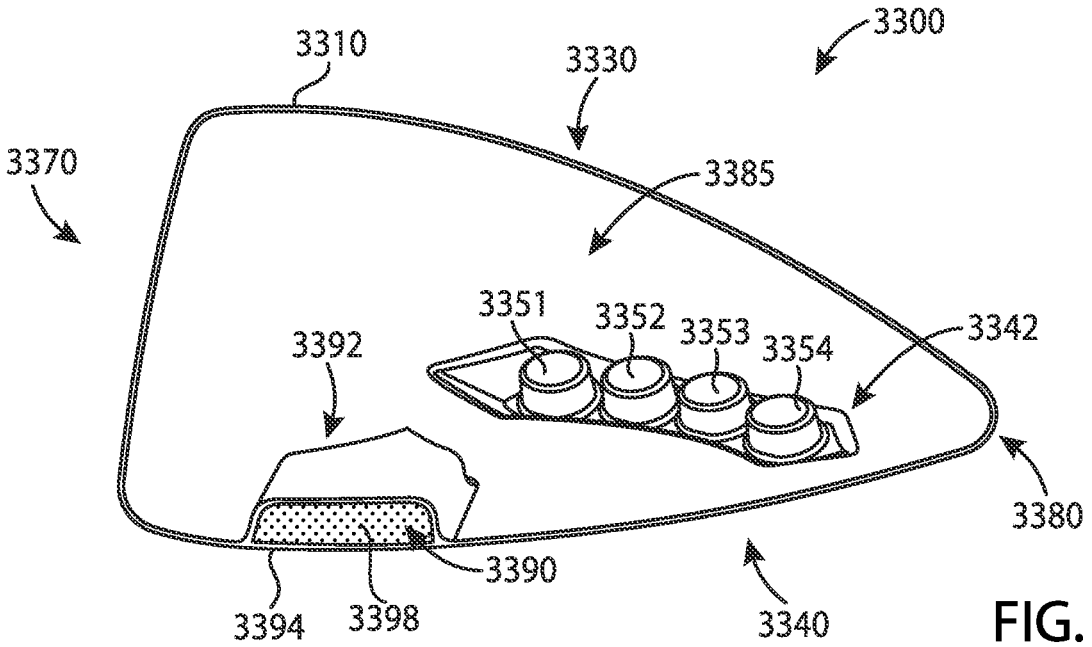
FIG. 41 depicts another side cross-sectional view of the golf club head of FIG. 33 along line 41-41.
Figure 42:
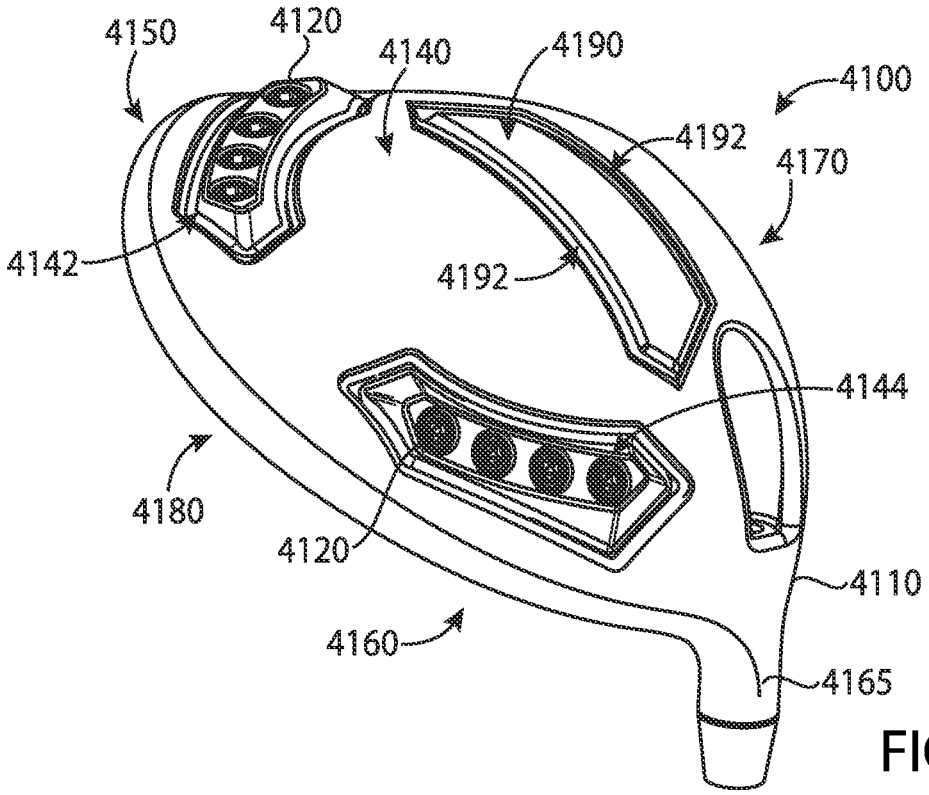
FIG. 42 depicts a bottom perspective view of another example golf club head.

In one example, the second interior cavity 2390 may be unfilled (i.e., empty space). Alternatively, the second interior cavity 3390 may be partially or entirely filled with an elastic polymer or elastomer material (e.g., a viscoelastic urethane polymer material such as Sorbothane® material manufactured by Sorbothane, Inc., Kent, Ohio), a thermoplastic elastomer material (TPE), a thermoplastic polyurethane material (TPU), and/or other suitable types of materials to absorb shock, isolate vibration, and/or dampen noise. For example, at least 50% of the second interior cavity 3390 may be filled with a TPE material to absorb shock, isolate vibration, and/or dampen noise when the golf club head 3300 strikes a golf ball via the face portion 3375. As described herein, the second interior cavity 3390 may be near and behind the face portion 3375. When the face portion 3375 strikes a golf ball, the resulting vibrations that may propagate from the face portion 3375 to the rest of the body portion 3310 may be at least partially absorbed and dampened by the second interior cavity 3390 and/or the material by which the second interior cavity 3390 may be filled. Accordingly, the second interior cavity 3390 may provide vibration and noise dampening. Further, the second interior cavity 3390 may provide a preferred sound and feel to an individual. The second interior cavity 3390 may have any shape so as to provide the function of vibration and noise dampening as described herein. For example, the second interior cavity 3390 may have a rectangular, triangular or polygonal shape. Further, the length and width of the second interior cavity 3390 may be determined so as to provide vibration and noise dampening as described herein. For example, the shape, length and/or width of the second interior cavity 3390 may change depending on the shape, size, volume and/or materials of construction of the body portion 3310. In one example, the second interior cavity 3390 may extend generally parallel to the face portion 3375 as shown in FIG. 34. In one example (not shown), the second interior cavity 3390 may be closer to the face portion 3375 near a center portion of the face portion 3375 and farther from the face portion 3375 near the toe portion 3350 and the heel portion 3360. In one example (not shown), the shape and size of the second interior cavity 3390 may be determined by numerical analysis (e.g., finite element analysis) and/or experimental analysis (e.g., vibration testing) so as to provide a particular or an optimum vibration, noise dampening, sound and/or feel. The apparatus, methods, and articles of manufacture described herein are not limited in this regard.

In one example, the second interior cavity 3390 may be filled with an elastic polymer or elastomer material (e.g., shown as 3398) by filling the recessed portion 3392 of the bottom portion 3340 with elastomer polymer or elastomer material, and then attaching the bottom cover 3394 over the recessed portion 3392. Alternatively, the bottom cover 3394 may be initially placed over the recessed portion 3392 and then attached to the bottom portion 3340 with one of the fasteners 3396. Elastic polymer or elastomer material may then be injected into the interior cavity 3390 through a fastener port or another one of the fasteners 3396 for the bottom cover 3394. After the second interior cavity 3390 is filled, all of the fasteners for the bottom cover 3394 may fastened to completely attach the bottom cover 3394 over the recessed portion 3392. In another example, the bottom cover 3394 may be fastened to the bottom portion 3340 prior to filling the second interior cavity 3390 with an elastic polymer or an elastomer material. The bottom cover 3394 or the body portion 3310 may include a port (not shown) that provides access to the second interior cavity 3390. The second interior cavity 3390 may be then filled with an elastic polymer or an elastomer material through the port. The port may then be filled or closed with a plug and/or adhesive. In another example, a combination of the methods described herein including the methods described below may be used to fill the second interior cavity 3390 with an elastic polymer or elastomer material. The apparatus, methods, and articles of manufacture described herein are not limited in this regard.

In one example, the bottom portion 3340 may include a first weight port region 3342 and a second weight port region 3344. Each of the weight port regions 3342 and 3344 may be defined by a portion of the outer surface of the bottom portion 3340 such as the examples described herein and shown in FIGS. 9 and 10. In one example, each of the weight port regions 3342 and 3344 may be defined by a recessed portion of the bottom portion 3340 (not shown). In one example, each of the weight port regions 3342 and 3344 may be defined by a protruded portion of the bottom portion 3340 as shown in FIGS. 33-41. Accordingly, each weight port region 3342 and 3344 may provide a platform on the bottom portion 3340 for accommodating a plurality of weight ports 3320. In one example, each of the weight port regions 3342 and 3344 may be a separate weight port region as shown in FIGS. 33-41. In one example, the weight port regions 3342 and 3344 may be connected to define a single weight port region having a plurality of weight ports with each weight port configured to receive a weight portion of a plurality of weight portions. The apparatus, methods, and articles of manufacture described herein are not limited in this regard.

The first weight port region 3342 may include a plurality of weight ports. In one example, the first weight port region 3342 may include four weight ports, which are generally shown as 3351, 3352, 3353 and 3354. The first weight port region 3342 may be near the toe portion 3350 and extend between the front portion 3370 and the rear portion 3380. The first weight port region 3342 may have any configuration, size and/or shape. In one example, the first weight port region 3342 may generally extend near the toe portion 3350 similar to the contour of the body portion 3310 at the toe portion 3350. Each weight port 3351-3354 of the first weight port region 3342 may be associated with a first port diameter and configured to receive at least one weight portion of a plurality of weight portions. Two adjacent weight ports of the first weight port region 3342 may be separated by less than or equal to the first port diameter. The port diameter associated with each weight port of the first weight port region 3342, the distance between adjacent weight ports of the first weight port region 3342, and the configuration of each weight portion of the plurality of weight portions may be similar in many respects to the example weight ports and weight portions described herein. Accordingly, a detailed description of the weight ports of the first weight port region 3342 and the weight portions received in the weight ports of the first weight port region 3342 is not provided.

The first weight port region 3342 may be a separate piece from the bottom portion 3340 and/or constructed from a different material than the bottom portion 3340. For example, the first weight port region 3342 may be constructed from one or more non-metallic composite materials and attached to the bottom portion 3340 or attached in a corresponding recess (not shown) in the bottom portion 3340. The first weight port region 3342 may include the weight ports 3351, 3352, 3353, and 3354. Each of the weight ports 3351, 3352, 3353, and 3354 may be threaded to receive a weight portion as described herein. Alternatively, each of the weight ports 3351, 3352, 3353, and 3354 may include a threaded metallic sleeve for receiving a weight portion as described herein when the first weight port region 3342 is constructed from a non-metallic material such as a composite material. The apparatus, methods, and articles of manufacture described herein are not limited in this regard.

The weight ports 3351, 3352, 3353, and 3354 of the first weight port region 3342 may be partially or fully surrounded and enveloped by an elastic polymer or elastomer material or any of the suitable materials described herein to absorb shock, isolate vibration, and/or dampen noise. According to one example, the first weight port region 3342 and the weight ports 3351, 3352, 3353, and 3354 may be similar in many respects to the second interior cavity 4790 and the weight ports 4720 of the example of FIG. 47. Accordingly, a detailed description of the first weight port region 3342 is not provided. Similar to the example of FIG. 47, the first weight port region 3342 may define an interior cavity (not shown), through which each of the weight ports 3351, 3352, 3353, and 3354 extends. The interior cavity may be then partially or fully filled with an elastic polymer or elastomer material that may partially or fully surround the weight ports 3351, 3352, 3353, and 3354. The apparatus, methods, and articles of manufacture described herein are not limited in this regard.

The second weight port region 3344 may include a plurality of weight ports. In one example, the second weight port region 3344 may include four weight ports, which are generally shown as 3356, 3357, 3358 and 3359. The second weight port region 3344 may be near the heel portion 3360 and extend between the front portion 3370 and the rear portion 3380. The second weight port region 3344 may have any configuration, size and/or shape. In one example, the second weight port region 3344 may generally extend near the heel portion 3360 similar to the contour of the body portion 3310 at the heel portion 3360. Each weight port 3356-3359 of the second weight port region 3344 may be associated with a second port diameter and configured to receive at least one weight portion of a plurality of weight portions. Two adjacent weight ports of the second weight port region 3344 may be separated by less than or equal to the second port diameter. The first port diameter may be similar to the second port diameter or different from the second port diameter. In one example, the first port diameter may be similar to the second port diameter so that each weight portion of the plurality of weight portions may be interchangeably used in the weight ports of the first weight port region 3342 and the second weight port region 3344. The port diameter associated with each weight port of the second weight port region 3344, the distance between adjacent weight ports of the second weight port region 3344, and the configuration of each weight portion of the plurality of weight portions may be similar in many respects to the example weight ports and weight portions described herein. Accordingly, a detailed description of the weight ports of the second weight port region 3344 and the weight portions received in the weight ports of the second weight port region 3344 is not provided.

The second weight port region 3344 may be a separate piece from the bottom portion 3340 and constructed from a different material than the bottom portion 3340. For example, the second weight port region 3344 may be constructed from one or more non-metallic composite materials and attached to the bottom portion 3340 or attached in a corresponding recess (not shown) in the bottom portion 3340. The second weight port region 3344 may include the weight ports 3356, 3357, 3358, and 3359. Each of the weight ports 3356, 3357, 3358, and 3359 may be threaded to receive a weight portion as described herein. Alternatively, each of weight the ports 3356, 3357, 3358, and 3359 may include a threaded metallic sleeve for receiving a weight portion as described herein when the second weight port region 3344 is constructed from a non-metallic material such as a composite material. The apparatus, methods, and articles of manufacture described herein are not limited in this regard.

The weight ports 3356, 3357, 3358, and 3359 of the second weight port region 3344 may be partially or fully surrounded and enveloped by an elastic polymer or elastomer material or any of the suitable materials described herein to absorb shock, isolate vibration, and/or dampen noise. According to one example, the second weight port region 3344 and the weight ports 3356, 3357, 3358, and 3359 may be similar in many respects to the second interior cavity 4790 and the weight ports 4720 of the example of FIG. 47. Accordingly, a detailed description of the weight port region 3342 is not provided. Similar to the example of FIG. 47, the second weight port region 3344 may define an interior cavity (not shown), through which each of the weight ports 3356, 3357, 3358, and 3359 extends. The interior cavity may be then partially or fully filled with an elastic polymer or elastomer material that may partially or fully surround the weight ports 3356, 3357, 3358, and 3359. The apparatus, methods, and articles of manufacture described herein are not limited in this regard.

In the example of FIGS. 41-46, a golf club head 4100 may include a body portion 4110. The golf club head 4100 may include a plurality of weight ports (e.g., one is generally shown as 4120) and a plurality of weight portions. Alternatively, the golf club head 4100 may not include any weight ports or weight portions. The body portion 4110 may include a top portion 4130, a bottom portion 4140, a toe portion 4150, a heel portion 4160, a front portion 4170, and a rear portion 4180. The bottom portion 4140 may include a skirt portion (not shown) defined as a side portion of the golf club head 4100 between the top portion 4130 and the bottom portion 4140 excluding the front portion 4170 and extending across a periphery of the golf club head 4100 from the toe portion 4150, around the rear portion 4180, and to the heel portion 4160. The bottom portion 4140 may include at least one weight port region, generally shown as a first weight port region 4142 and a second weight port region 4144. For example, each of the first and second weight port regions 4142 and 4144, respectively, may include a plurality of weight ports, one of which is generally shown as 4120, to receive the plurality of weight portions. The first and second weight port regions 4142 and 4144, the plurality of weight ports of the first and second weight port regions 4142 and 4144, and the plurality of weight portions received in the first and second weight port regions 4142 and 4144 may be similar in many respect to the first and second weight port regions 3342 and 3344, respectively, and the other examples described herein. Further, the first and second weight port regions 4142 and 4144 may be constructed from a different material than the bottom portion 4140 and filled with an elastic or elastomer material such that the weight ports of the weight port regions 4142 and 4144 may be partially or fully surrounded by the elastic polymer material as described in detail. Accordingly, a detailed description of the first and second weight port regions 4142 and 4144 is not provided.

The front portion 4170 may include a face portion 4175 to engage a golf ball (not shown). The body portion 4110 may also include a hosel portion 4165 to receive a shaft (not shown). Alternatively, the body portion 4110 may include a bore (not shown) instead of a hosel portion 4165. For example, the body portion 4110 may be made partially or entirely of an aluminum-based material, a magnesium-type material, a steel-based material, a titanium-based material, any combination thereof, or any other suitable material.

In another example the body portion 4110 may be made partially or entirely of a non-metal material such as a ceramic material, a composite material, any combination thereof, or any other suitable material.

The golf club head 4100 may have a club head volume greater than or equal to 300 cubic centimeters ($cm^3$ or cc). In one example, the golf club head 4100 may be about 460 cc. Alternatively, the golf club head 4100 may have a club head volume less than or equal to 300 cc. In particular, the golf club head 4100 may have a club head volume between 100 cc and 200 cc. The club head volume of the golf club head 4100 may be determined by using the weighted water displacement method (i.e., Archimedes Principle). For example, procedures defined by golf standard organizations and/or governing bodies such as the United States Golf Association (USGA) and/or the Royal and Ancient Golf Club of St. Andrews (R&A) may be used for measuring the club head volume of the golf club head 4100. Although FIG. 42 may depict a particular type of club head (e.g., a driver-type club head), the apparatus, methods, and articles of manufacture described herein may be applicable to other types of club head (e.g., a fairway wood-type club head, a hybrid-type club head, an iron-type club head, a putter-type club head, etc.). Accordingly, the golf club head 4100 may be any type of club head such as the club heads described herein. The apparatus, methods, and articles of manufacture described herein are not limited in this regard.

The body portion 4110 may be a hollow body including an interior cavity (not shown), which may be similar in many respect to the first interior cavity 3385 of the example of FIGS. 33-40. The bottom portion 4140 may include a recessed region 4190 that may extend between the front portion 4170 and the rear portion 4180 and between the toe portion 4150 and the heel portion 4160. However, the bottom portion may not include the recessed region 4190. The recessed region 4190 may be defined by a recess or a groove 4192 in the bottom portion 4140. In one example, the recessed region 4190 may be near the front portion 4170 and have a length that extends between the toe portion 4150 and the heel portion 4160 and is greater than or equal to a portion of the face portion 4175 that engages or strikes a golf ball. Accordingly, recessed region 4190 may be located proximate and behind the face portion 4175. In one example, recessed region 4190 may have any length and/or width. The recessed region 4190 may be at any location on the body portion 4110.

Figure 43:
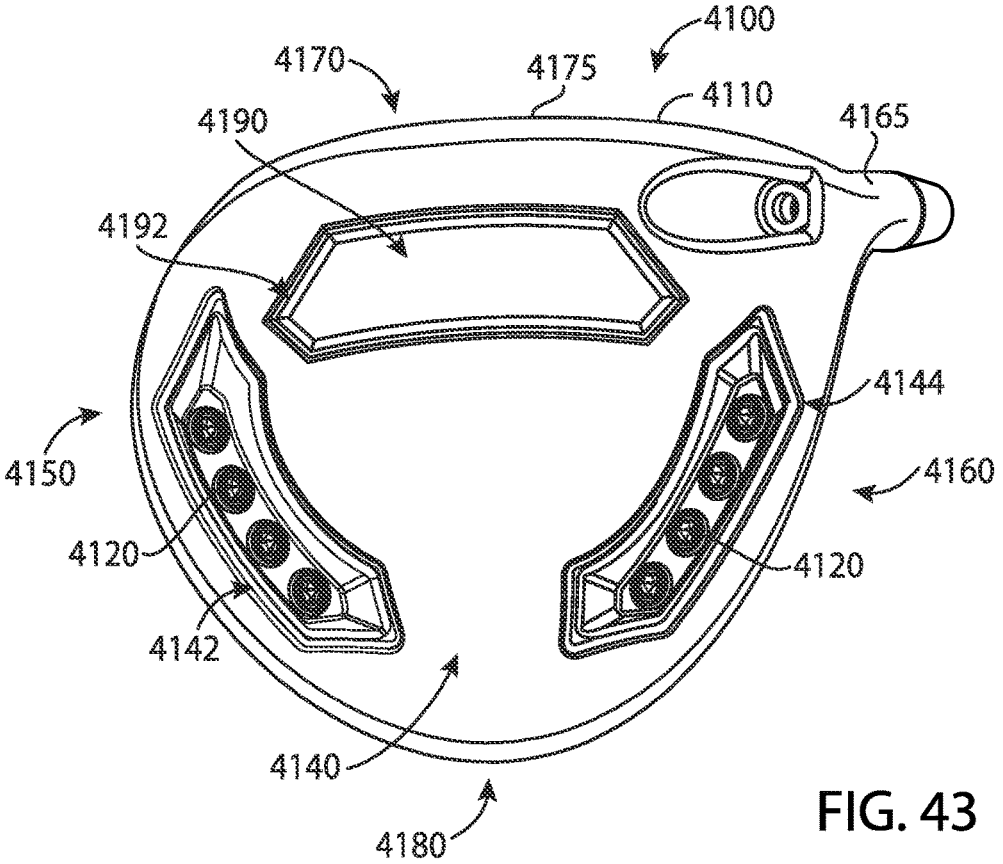
FIG. 43 depicts a bottom view of the golf club head of FIG. 42.
Figure 44:
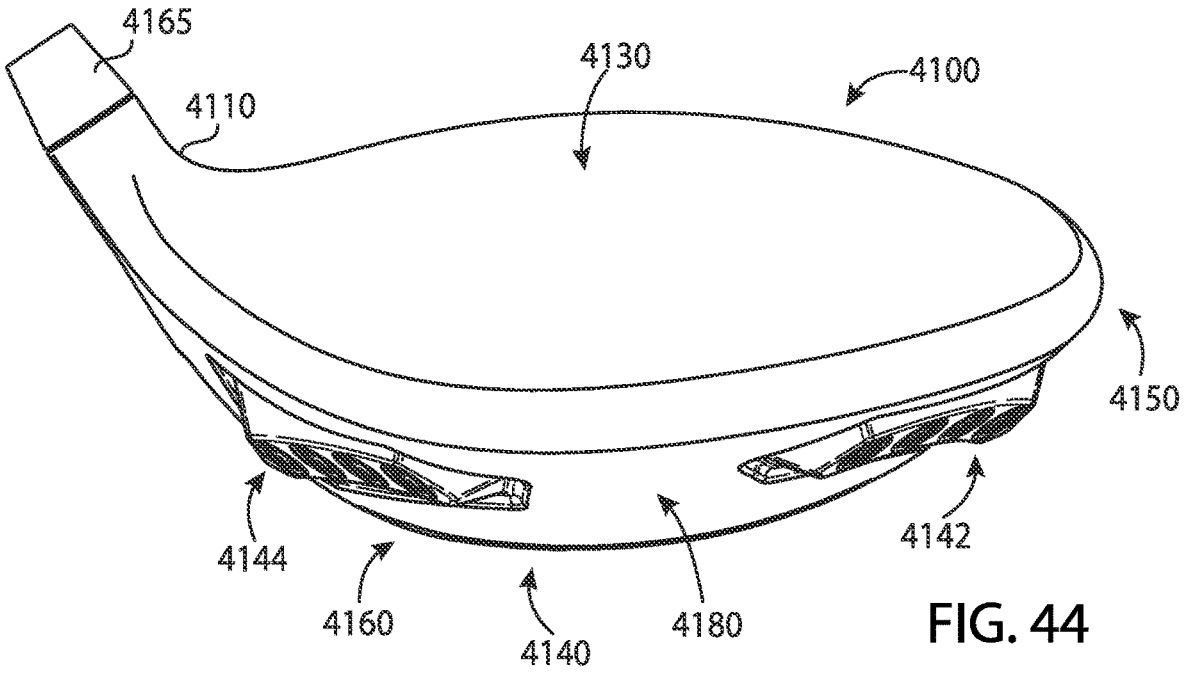
FIG. 44 depicts a rear view of the golf club head of FIG. 42.
Figure 45:
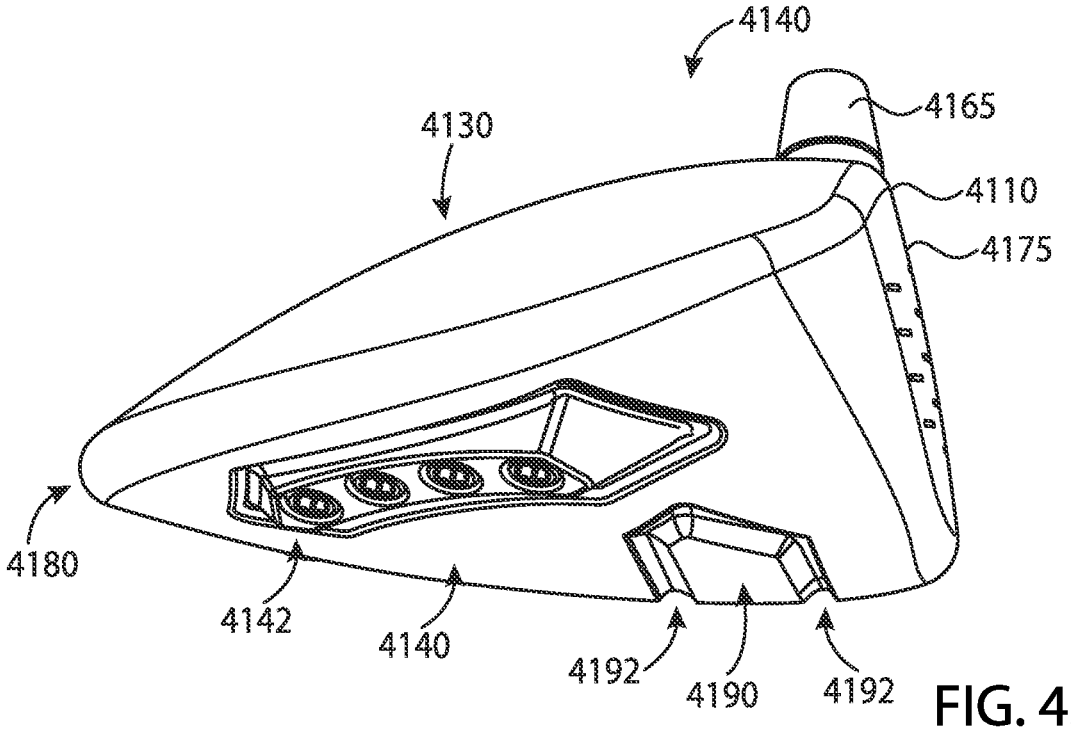
FIG. 45 depicts a toe view of the golf club head of FIG. 42.
Figure 46:
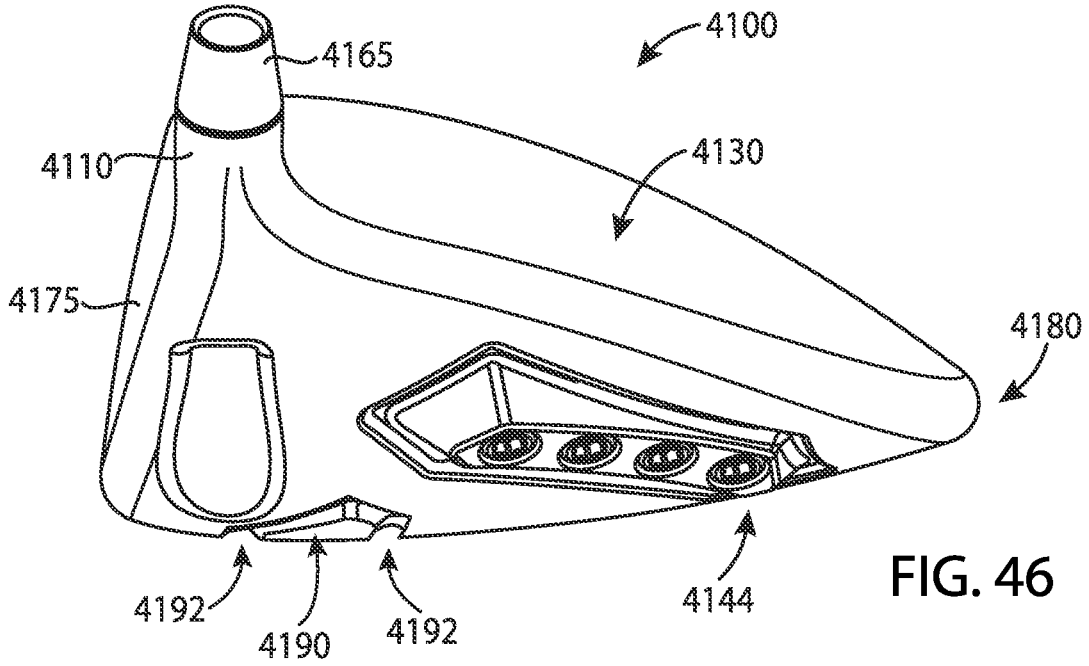
FIG. 46 depicts a heel view of the golf club head of FIG. 42.

The recessed region 4190, which may be defined by the groove 4192, may change the stiffness of the bottom portion 4140. Accordingly, the recessed region 4190 may change the noise and dampening characteristics of the body portion 4110 when the face portion 4175 strikes a golf ball. The characteristics of the vibrations that may propagate from the face portion 4175 to the rest of the body portion 4110 when the face portion 4175 strikes a golf ball may be changed and/or dampened by the recessed region 4190. Accordingly, the recessed region 4190 may provide vibration and noise dampening. Further, the recessed region 4190 may provide a preferred sound and feel to an individual when striking a golf ball (not shown). The recessed region 4190 may have any shape so as to provide a function of vibration and noise dampening as described herein. For example, the recessed region 4190 may have a rectangular, triangular or polygonal shape. Further, the length and width of the recessed region 4190 may be determined so as to provide vibration and noise dampening as described herein. For example, the shape, length and/or width of the recessed region 4190 may change depending on the shape, size, volume and/or materials of construction of the body portion 4110. In one example, the recessed region 4190 may extend generally parallel to the face portion 4175 as shown in FIG. 43. In one example (not shown), the recessed region may be closer to the face portion 4175 near a center portion of the face portion 4175 and farther from the face portion 4175 near the toe portion 4150 and the heel portion 4160. In one example (not shown), the shape and size of the recessed region 4190 and the shape, width and depth of the groove 4192 may be determined by numerical analysis (e.g., finite element analysis) and/or experimental analysis (e.g., vibration testing) so as to provide a particular or an optimum vibration and noise dampening. The recessed region 4190 may include additional grooves, dimples, projections, ridges of the like for providing particular vibration, dampening and noise characteristics for the body portion 4110. The apparatus, methods, and articles of manufacture described herein are not limited in this regard.

Figure 47:
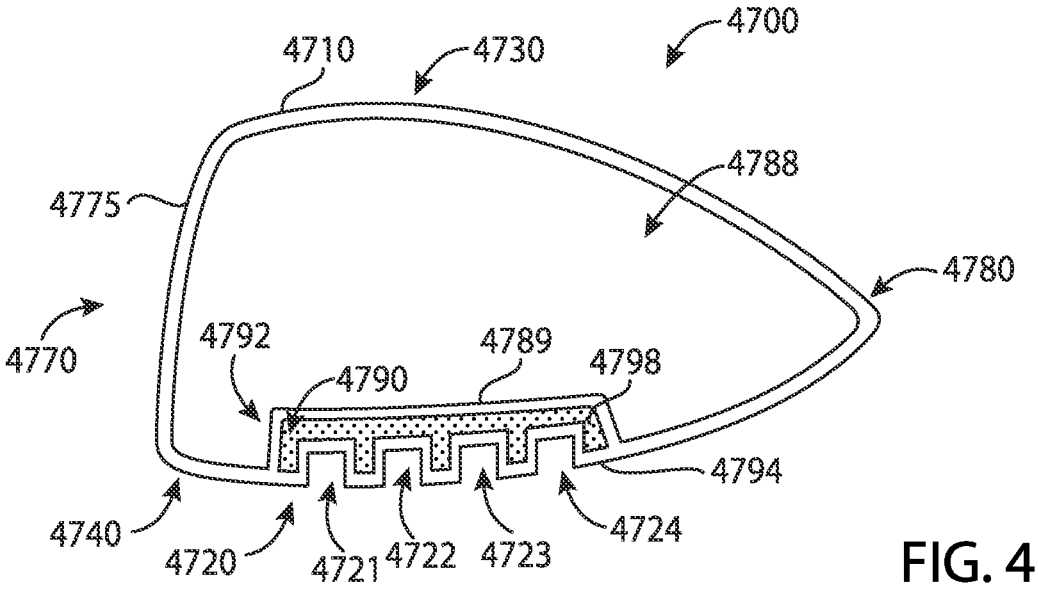
FIG. 47 depicts a schematic side cross-sectional view of another example golf club head.
Figure 48:
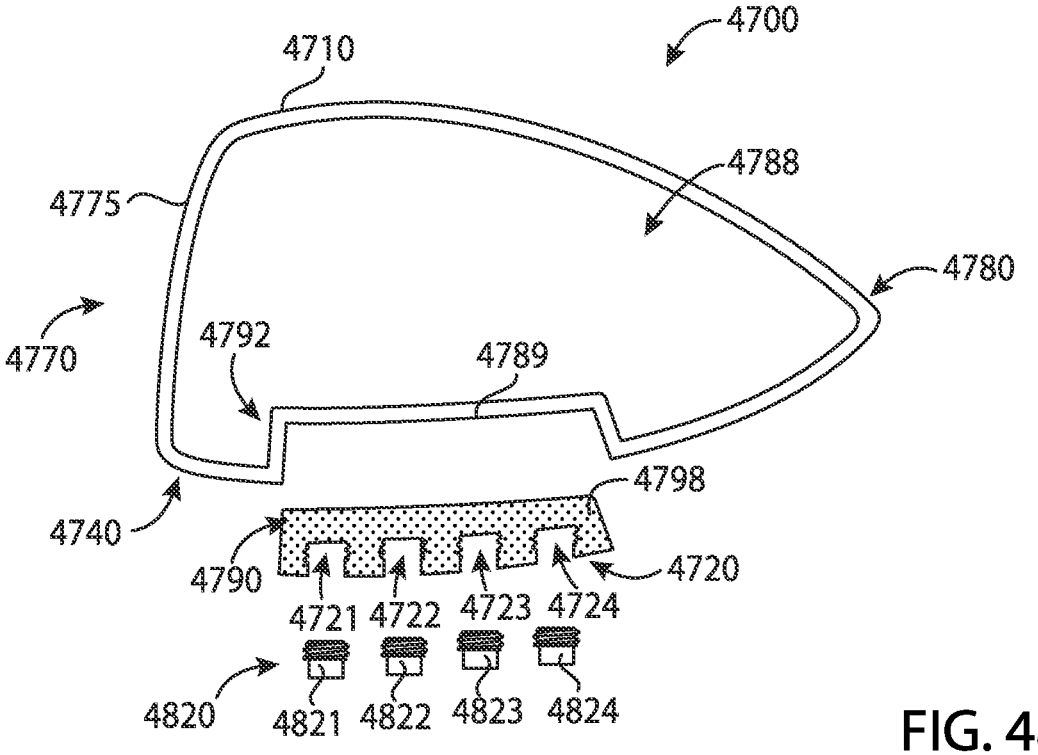
FIG. 48 depicts a schematic exploded cross-sectional view of the golf club head of FIG. 47.

In the example of FIGS. 47 and 48, a golf club head 4700 may include a body portion 4710. The golf club head 4700 may include a plurality of weight ports 4720 (e.g., four weight ports are generally shown as 4721, 4722, 4723, and 4724) that may be similar in many respects to the weight ports and weight portions, respectively, of the golf club heads described herein. Accordingly, a detailed description of the weight ports and the weight portions of the golf club head 4700 is not provided.

The body portion 4710 may include a top portion 4730, a bottom portion 4740, a toe portion (not shown), a heel portion (not shown), a front portion 4770, and a rear portion 4780. The bottom portion 4740 may include a skirt portion (not shown) defined as a side portion of the golf club head 4700 between the top portion 4730 and the bottom portion 4740 excluding the front portion 4770 and extending across a periphery of the golf club head 4700 from the toe portion, around the rear portion 4780, and to the heel portion. The bottom portion 4740 may include one or more weight port regions. In the example of FIG. 47, a weight port region 4715 is shown. A weight port region may include a plurality of weight ports, one of which is generally shown as 4720, to receive a plurality of weight portions, which are generally shown as 4820 in FIG. 48 (e.g., weight portions 4821, 4822, 4823 and 4824). The front portion 4770 may include a face portion 4775 to engage a golf ball (not shown). The body portion 4710 may also include a hosel portion (not shown) to receive a shaft (not shown). Alternatively, the body portion 4710 may include a bore (not shown) instead of a hosel portion (not shown). For example, the body portion 4710 may be made partially or entirely of an aluminum-based material, a magnesium-type material, a steel-based material, a titanium-based material, any combination thereof, or any other suitable material. In another example the body portion 4710 may be made partially or entirely of a non-metal material such as a ceramic material, a composite material, any combination thereof, or any other suitable material.

The golf club head 4700 may have a club head volume greater than or equal to 300 cubic centimeters ($cm^3$ or cc). In one example, the golf club head 4700 may be about 460 cc. Alternatively, the golf club head 4700 may have a club head volume less than or equal to 300 cc. In particular, the golf club head 4700 may have a club head volume between 100 cc and 200 cc. The club head volume of the golf club head 4700 may be determined by using the weighted water displacement method (i.e., Archimedes Principle). For example, procedures defined by golf standard organizations and/or governing bodies such as the United States Golf Association (USGA) and/or the Royal and Ancient Golf Club of St. Andrews (R&A) may be used for measuring the club head volume of the golf club head 4700. Although FIG. 47 may depict a particular type of club head (e.g., a driver-type club head), the apparatus, methods, and articles of manufacture described herein may be applicable to other types of club head (e.g., a fairway wood-type club head, a hybrid-type club head, an iron-type club head, a putter-type club head, etc.). Accordingly, the golf club head 4700 may be any type of club head such as the club heads described herein. The apparatus, methods, and articles of manufacture described herein are not limited in this regard.

The body portion 4710 may be a hollow body including a first interior cavity 4788 that may extend from the front portion 4770 to the rear portion 4780 and from the toe portion to the heel portion. The body portion 4710 may include a second interior cavity 4790 near the bottom portion 4740 or at the bottom portion 4740 and extending between the front portion 4770 and the rear portion 4780. The second interior cavity 4790 may extend between the top portion 4730 and the bottom portion 4740. The first interior cavity 4788 and the second interior cavity 4790 may be separated by a cavity wall 4789. The second interior cavity 4790 may be an integral part of the golf club head 4700. In other words, the second interior cavity may be located between the bottom portion 4740 and the top portion 4730. Alternatively, as shown in FIG. 48, the second interior cavity 4790 may be defined by a separate and hollow weight port region 4715 that may be attached in a recessed portion 4792 of the bottom portion 4740.

The weight port region 4715 includes the weight ports 4720 (generally shown as weight ports 4721, 4722, 4723 and 4724). The weight ports 4720 may be defined by ports that extend into the hollow weight port region 4715 (i.e., into the second interior cavity 4790). The second interior cavity 4790 may surround and envelop the weight ports 4720. In one example, the second interior cavity 4790 may be unfilled (i.e., empty space). Alternatively, the second interior cavity 4790 may be partially or entirely filled with an elastic polymer or elastomer material 4798 (e.g., a viscoelastic urethane polymer material such as Sorbothane® material manufactured by Sorbothane, Inc., Kent, Ohio), a thermoplastic elastomer material (TPE), a thermoplastic polyurethane material (TPU), and/or other suitable types of materials to absorb shock, isolate vibration, and/or dampen noise. Accordingly, each of the weight ports 4721, 4722, 4723 and 4724 may be partially or entirely surrounded by the elastic polymer material. Elastic polymer or elastomer material may be injected into the second interior cavity 4792 through one of the weight ports 4720 that may have an opening to the second interior cavity 4790 or another access port (not shown). For example, at least 50% of the second interior cavity 4790 may be filled with a TPE material to absorb shock, isolate vibration, and/or dampen noise when the golf club head 4700 strikes a golf ball via the face portion 4775. The apparatus, methods, and articles of manufacture described herein are not limited in this regard.

According to one example, the weight port region 4715 may be a separate part that may be constructed from the same material as or a different material than the golf club head 4700. For example, the weight port region 4715 may be constructed from a non-metallic composite material. Each of the weight ports 4721, 4722, 4723, and 4724 may include a threaded metallic sleeve for receiving a weight portion as described herein when the weight port region 4715 is constructed from a non-metallic material such as a composite material. The weight port region 4715 may be partially or fully filled with an elastic or elastomer material prior to or after attachment inside the recessed portion 4792 of the bottom portion 4740. The apparatus, methods, and articles of manufacture described herein are not limited in this regard.

In the example of FIGS. 49-52, a golf club head 4900 may include a body portion 4910. The golf club head 4900 may include a plurality of weight ports having a first set of weight ports 5020 (e.g., generally shown as weight ports 5021, 5022, 5023, 5024, and 5025) and a second set of weight ports 5120 (e.g., generally shown as weight ports 5121, 5122, 5123, 5124, and 5125). The golf club head 4900 also may include a plurality of weight portions (not shown). The weight ports 5020 and 5120 and the weight portions may be similar in many respects to the weight ports and weight portions, respectively, of the golf club heads described herein. Accordingly, a detailed description of the weight ports 5020 and 5120 and the weight portions of the golf club head 4900 is not provided. Alternatively, the golf club head 4900 may not include any weight ports or weight portions.

Figure 49:
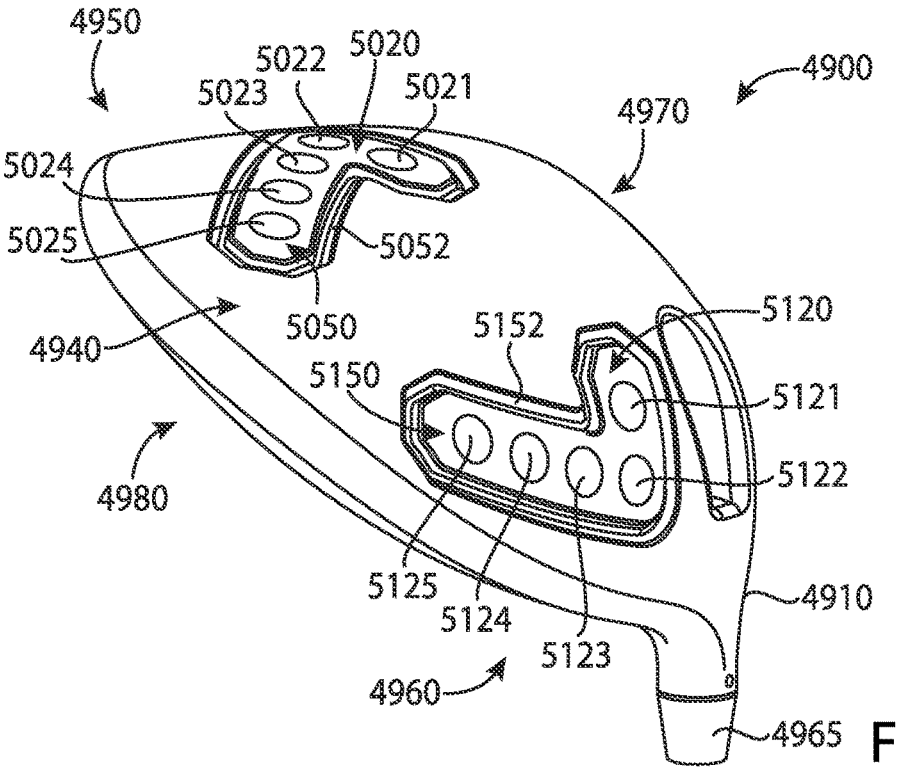
FIG. 49 depicts a bottom perspective view of another example golf club head.
Figure 50:
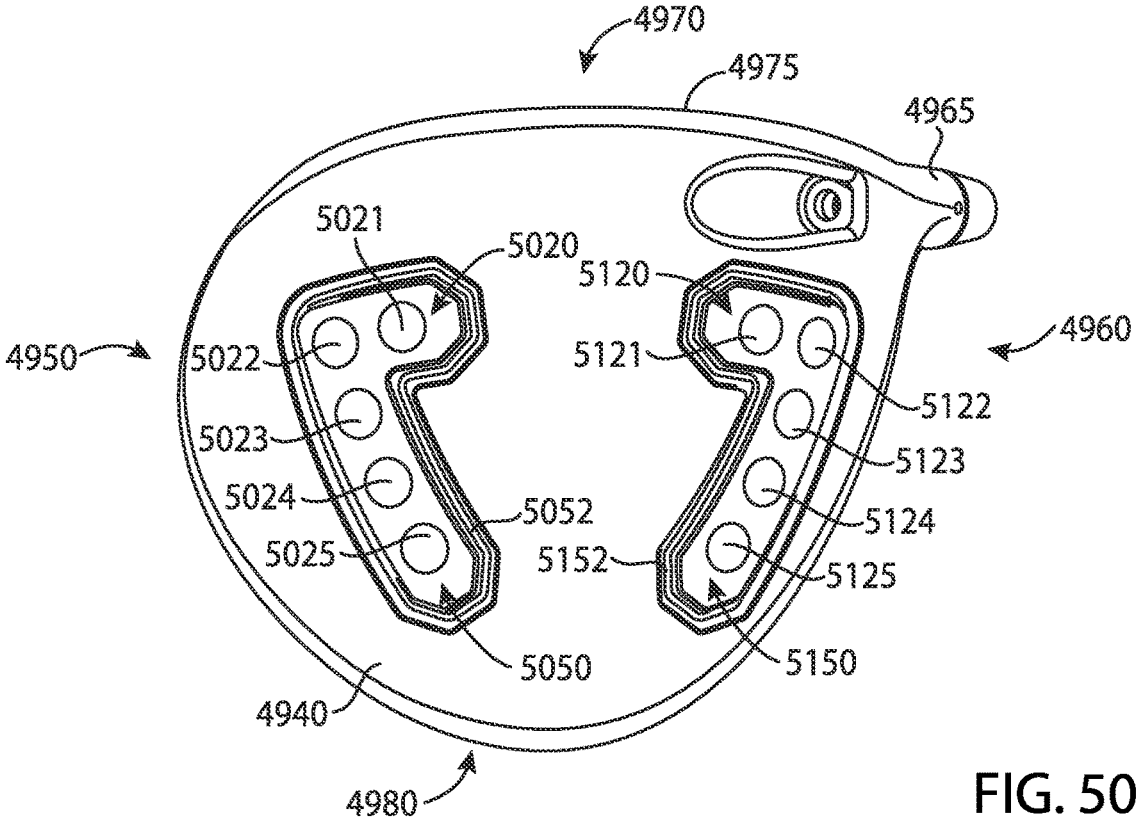
FIG. 50 depicts a bottom view of the golf club head of FIG. 49.

The body portion 4910 may include a top portion 4930, a bottom portion 4940, a toe portion 4950, a heel portion 4960, a front portion 4970, and a rear portion 4980. The bottom portion 4940 may include a skirt portion (not shown) defined as a side portion of the golf club head 4900 between the top portion 4930 and the bottom portion 4940 excluding the front portion 4970 and extending across a periphery of the golf club head 4900 from the toe portion 4950, around the rear portion 4980, and to the heel portion 4960. The bottom portion 4940 may include at least one weight port region. In the example of FIG. 49, the bottom portion 4940 includes a first weight port region 5050 having the first set of weight ports 5020 and a second weight port region 5150 having the second set of weight ports 5120.

The front portion 4970 may include a face portion 4975 to engage a golf ball (not shown). The body portion 4910 may also include a hosel portion 4965 to receive a shaft (not shown). Alternatively, the body portion 4910 may include a bore (not shown) instead of a hosel portion 4965. For example, the body portion 4910 may be made partially or entirely of an aluminum-based material, a magnesium-type material, a steel-based material, a titanium-based material, any combination thereof, or any other suitable material. In another example the body portion 4910 may be made partially or entirely of a non-metal material such as a ceramic material, a composite material, any combination thereof, or any other suitable material. The apparatus, methods, and articles of manufacture described herein are not limited in this regard.

The golf club head 4900 may have a club head volume greater than or equal to 300 cubic centimeters ($cm^3$ or cc). In one example, the golf club head 4900 may be about 460 cc. Alternatively, the golf club head 4900 may have a club head volume less than or equal to 300 cc. In particular, the golf club head 4900 may have a club head volume between 100 cc and 200 cc. The club head volume of the golf club head 4900 may be determined by using the weighted water displacement method (i.e., Archimedes Principle). For example, procedures defined by golf standard organizations and/or governing bodies such as the United States Golf Association (USGA) and/or the Royal and Ancient Golf Club of St. Andrews (R&A) may be used for measuring the club head volume of the golf club head 4900. Although FIG. 49 may depict a particular type of club head (e.g., a driver-type club head), the apparatus, methods, and articles of manufacture described herein may be applicable to other types of club head (e.g., a fairway wood-type club head, a hybrid-type club head, an iron-type club head, a putter-type club head, etc.). Accordingly, the golf club head 4900 may be any type of club head such as the club heads described herein. The apparatus, methods, and articles of manufacture described herein are not limited in this regard.

Each of the weight port regions 5050 and 5150 may be defined by a portion of the outer surface of the bottom portion 4940 such as all of the examples described herein and shown in 49 and 50. In one example, each of the weight port regions 5050 and 5150 may be defined by a recessed portion of the bottom portion 4940 (not shown). In one example, each of the weight port regions 5050 and 5150 may be defined by a protruded portion of the bottom portion 4940 (not shown in FIGS. 49-52, and example shown in FIG. 43). In one example, each of the weight port regions 5050 and 5150 may be a separate weight port region (not shown) that may be attached to and protrude from the bottom portion 4940. In one example, each of the weight port regions 5050 and 5150 may be a separate weight port region that may be attached inside a recess that may define each weight port region 5050 and 5150, respectively (not shown) on the bottom portion 4940. In the example of FIG. 49, each of the weight port regions 5050 and 5150 may be defined by a portion of the outer surface of the bottom portion 4940. Each of the weight port regions 5050 and 5150 may be defined by a recess or groove, a projection, or any type of demarcation (e.g., etching, painting, etc.) that may define each of the weight port regions 5050 and 5150, respectively. Alternatively, the weight port regions 5050 and 5150 may be defined by the weight ports of each weight port region 5050 and 5150 without any weight port region boundary structural or visual identification. In the example of FIG. 49, each of the weight port regions 5050 and 5150 may be defined by a boundary recess or boundary groove 5052 and 5152, respectively, which may provide structural reinforcement and/or rigidity to the bottom portion 4940 at and around the weight port regions 5050 and 5150. Instead of the boundary grooves 5052 and 5152, each of the weight port regions 5050 and 5150 may be defined by a boundary projection or boundary rib (not shown) that may provide structural reinforcement and/or rigidity to the bottom portion 4940 at and around the weight port regions 5050 and 5150. The apparatus, methods, and articles of manufacture described herein are not limited in this regard.

The first weight port region 5050 may have any shape. In the example of FIG. 49, the first weight port region 5050 is generally L-shaped. The first weight port region 5050 may be near the toe portion 4950 and include a first portion 5054 that may extend between the front portion 4970 and the rear portion 4980 (e.g., weight ports 5022, 5023, 5024, and 5025), and a second portion 5056 that may extend between the toe portion 4950 and the heel portion 4960 (e.g., weight ports 5021 and 5022). The first portion 5054 and the second portion 5056 may be transverse to resemble a generally L-shaped first weight port region 5050. Each of the first portion 5054 and the second portion 5056 may include any number of weight ports. In the example of FIGS. 49-52, the first portion 5054 may include two weight ports 5021 and 5022 that may extend in a direction between the toe portion 4950 and the heel portion 4960. The second portion 5056 may include four weight ports 5022, 5023, 5024 and 5025 that may extend in a direction between the face portion 4975 and the rear portion 4980. The weight ports of the first portion 5054 may extend along a line or a curve. The weight ports of the second portion 5056 may extend along a line or a curve. In one example, the weight ports of the first portion 5054 may extend in a direction that may generally correspond to the contour of the front portion 4970. In one example, the weight ports of the second portion 5056 may extend in a direction that may generally correspond to the contour of the toe portion 4950. Accordingly, the first weight port region 5050 may be defined by linear or curved sides that may generally define a generally linear or curved L-shaped region on the bottom portion 4940. A generally L-shaped region may be defined by two regions that may be generally transverse and form a right angle, a large acute angle (e.g., greater than 45°) or a small obtuse angle (e.g., less than 135°) relative to each other. The apparatus, methods, and articles of manufacture described herein are not limited in this regard.

Each weight port 5021, 5022, 5023, 5024, and 5025 of the first weight port region 5050 may be associated with a first port diameter and configured to receive at least one weight portion of a plurality of weight portions. Adjacent weight ports of the first weight port region 5050 may be separated by any distance. In one example, two adjacent weight ports of the first weight port region 5050 may be separated by less than or equal to a first port diameter, which may be the diameter of any of the two adjacent weight ports. The port diameter associated with each weight port of the first weight port region 5050, the distance between adjacent weight ports of the first weight port region 5050, and the configuration of each weight portion of the plurality of weight portions may be similar in many respects to the example weight ports and weight portions described herein. Accordingly, a detailed description of the weight ports of the first weight port region 5050 and the weight portions received in the weight ports of the first weight port region 5050 is not provided. The apparatus, methods, and articles of manufacture described herein are not limited in this regard.

The second weight port region 5150 may have any shape. In the example of FIG. 49, the second weight port region 5150 is generally L-shaped. The second weight port region 5150 may be near the heel portion 4960 and may include a first portion 5154 that may extend between the front portion 4970 and the rear portion 4980 (e.g., weight ports 5122, 5123, 5124, and 5125), and a second portion 5156 that may extend between the toe portion 4950 and the heel portion 4960 (e.g., weight ports 5121 and 5122). The first portion 5154 and the second portion 5156 may be transverse to define a generally L-shaped second weight port region 5150. Each of the first portion 5154 and the second portion 5156 may include any number of weight ports. In the example of FIGS. 49-52, the first portion 5154 may include two weight ports 5121 and 5122 that may extend in a direction between the toe portion 4950 and the heel portion 4960. The second portion 5156 may include four weight ports 5122, 5123, 5124 and 5125 that may extend in a direction between the face portion 4975 and the rear portion 4980. The weight ports of the first portion 5154 may extend along a line or a curve. The weight ports of the second portion 5156 may extend along a line or a curve. In one example, the weight ports of the first portion 5154 may extend in a direction that may generally correspond to the contour of the front portion 4970. In one example, the weight ports of the second portion 5156 may extend in a direction that may generally correspond to the contour of the heel portion 4960. Accordingly, the second weight port region 5150 may be defined by linear or curved sides that may generally define a generally linear or curved L-shaped region on the bottom portion 4940. A generally L-shaped region may be defined by two regions that may be generally transverse and form a right angle, a large acute angle (e.g., greater than 45°) or a small obtuse angle (e.g., less than 135°) relative to each other. The apparatus, methods, and articles of manufacture described herein are not limited in this regard.

Each weight port 5121, 5122, 5123, 5124, and 5125 of the second weight port region 5150 may be associated with a second port diameter and configured to receive at least one weight portion of a plurality of weight portions. Adjacent weight ports of the second weight port region 5150 may be separated by any distance. In one example, two adjacent weight ports of the second weight port region 5150 may be separated by less than or equal to the second port diameter, which may be the port diameter of any of the two adjacent weight ports. The second port diameter may be similar to the first port diameter or different from the first port diameter. In one example, the first port diameter may be similar to the second port diameter so that each weight portion of the plurality of weight portions may be interchangeably used in the weight ports of the first weight port region 5050 and the second weight port region 5150. The port diameter associated with each weight port of the second weight port region 5150, the distance between adjacent weight ports of the second weight port region 5150, and the configuration of each weight portion of the plurality of weight portions may be similar in many respects to the example weight ports and weight portions described herein. Accordingly, a detailed description of the weight ports of the second weight port region 5150 and the weight portions received in the weight ports of the second weight port region 5150 is not provided. The apparatus, methods, and articles of manufacture described herein are not limited in this regard.

The body portion 4910 may be a hollow body including an interior cavity (not shown) that may generally define the volume of the body portion 4910. Alternatively, the body portion 4910 may include a plurality of interior cavities that may generally define the volume of the body portion 4910. The configuration of any interior cavities of the body portion 4910 may be similar in many respects to the one or more interior cavities of the golf club heads described herein. Furthermore, any interior cavity of the body portion 4910 may be unfilled (i.e., empty space), partially filled, or entirely filled with an elastic polymer or elastomer material in a similar manner as any of the golf club heads described herein. Any one or a plurality of weight ports of the weight port regions 5050 and/or 5150 may be partially or entirely surrounded by an elastic polymer or elastomer material. In one example, one or more of the weight ports of the weight port regions 5050 and/or 5150 may be proximate to or surrounded by an elastic polymer material similar to the examples shown in FIGS. 29 and 30. In one example, one or more of the weight ports of the weight port regions 5050 and/or 5150 may be proximate to or surrounded by an elastic polymer material similar to the examples shown in FIGS. 31 and 32. In one example, one or more of the weight ports of the weight port regions 5050 and/or 5150 may be proximate to or surrounded by an elastic polymer material similar to the examples shown in FIGS. 47 and 48. A weight port having a portion thereof covered by an elastic polymer material and a portion thereof exposed to an internal cavity (not shown) of the body portion 4910 may be defined as a weight port being partially surrounded by an elastic polymer material. For example, as shown in FIGS. 30 and 32, one side of a weight port may be covered by an elastic polymer material, hence the weight port may be partially surrounded by an elastic polymer material. Alternatively, a weight port that may be entirely surrounded by an elastic polymer material in an internal cavity (not shown) of the body portion 4910 may be defined as a weight port being fully surrounded by an elastic polymer material. For example, as shown in FIG. 47, a weight port may be fully surrounded by an elastic polymer material in an internal cavity of the body portion 4910. The configuration of any interior cavities of the body portion 4910 and/or the weight ports 5050 and/or 5150 may be similar in many respects to the one or more interior cavities of the golf club heads described herein. Furthermore, any interior cavity of the body portion 4910 and/or any portion of an interior cavity that is near or surrounding any of the weight ports 5050 and/or 5150 may be unfilled (i.e., empty space), partially filled, or entirely filled with an elastic polymer or elastomer material in a similar manner as any of the golf club heads described herein. Any interior cavity of the body portion 4910 may be filled with an elastic polymer material through one or more weight ports as described in detail herein. Therefore, a detailed description of any interior cavities of the body portion 4090 and the filling of such interior cavities with an elastic polymer or elastomer material is not provided. The apparatus, methods, and articles of manufacture described herein are not limited in this regard.

Figure 51:
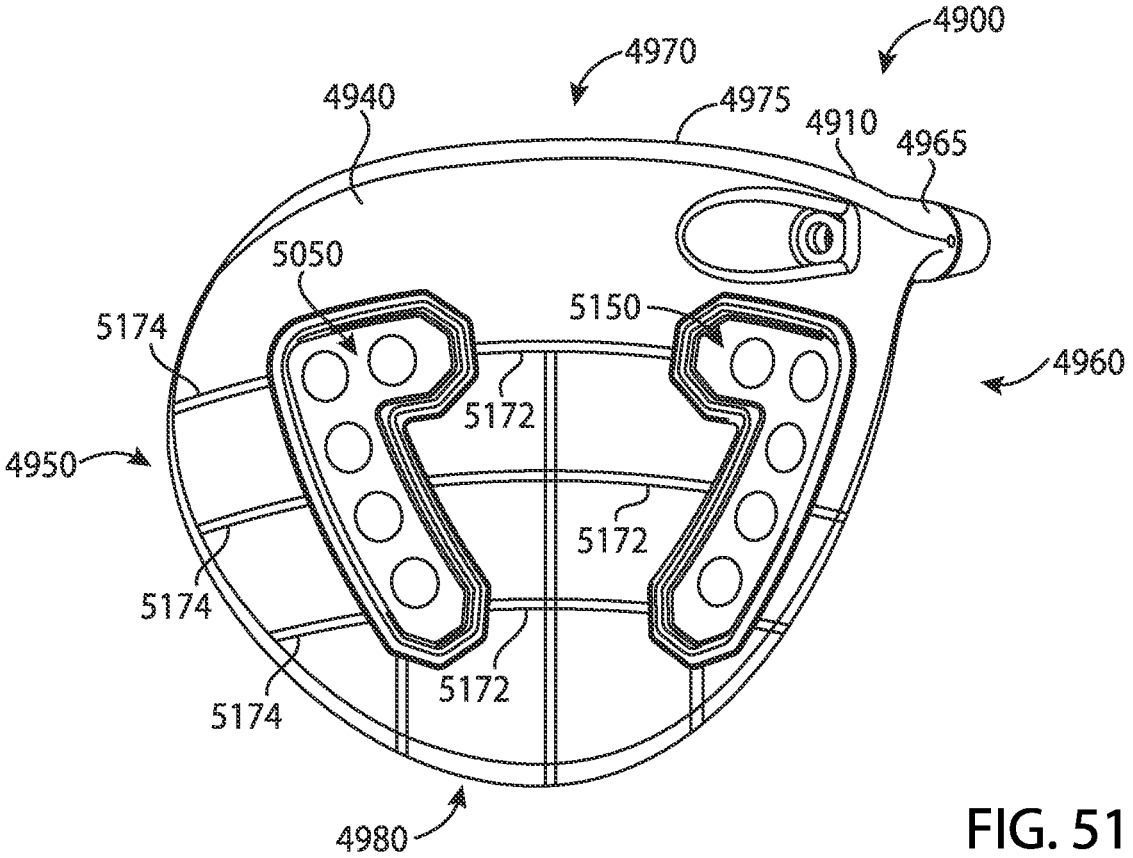
FIG. 51 depicts a bottom cross-sectional view of the golf club head of FIG. 49.
Figure 52:
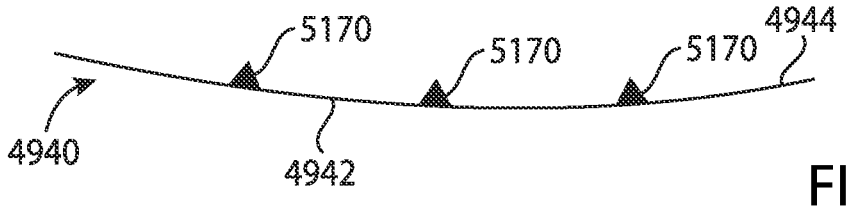
FIG. 52 depicts a schematic cross-sectional view of a portion of a bottom portion of the golf club head of FIG. 51.

In one example shown in FIGS. 51 and 52, the bottom portion 4940 may include an outer surface 4942 and an inner surface 4944. The inner surface 4944 may include a plurality of support portions 5170. Alternatively, or in conjunction with the inner surface 4944, the outer surface 4942 may include a plurality of support portions (not shown). For example, at least one of the support portions may be an elongated recessed rib (e.g., a groove, not shown) or an elongated projecting rib (shown in FIG. 52). The plurality of support portions 5170 may include one or more first support portions 5172 extending between the toe portion 4950 and heel portion 4960. The plurality of support portions 5170 may include one or more second support portions 5174 extending between the front portion 4970 and rear portion 4980. At least one of the first support portions may intersect with at least one of the second support portions. In one example, intersecting first support portions and second support portions may provide a truss-like structure that may function similar to a truss to enhance structural reinforcement and rigidity of the bottom portion 4940. The apparatus, methods, and articles of manufacture described herein are not limited in this regard.

In one example, the bottom portion 4940 may include at least three of the first support portions 5172 that may extend between the toe portion 4950 and the heel portion 4960. The first support portions 5172 may be similarly spaced apart and/or generally parallel and configured to intersect with the first and second weight port regions 5050 and 5150. Accordingly, the first support portions 5172 may provide structural reinforcement and rigidity to the weight port regions 5050 and 5150 and/or areas of the bottom portion 4940 near the weight port regions 5050 and 5150. The first support portions 5172 may have a curvature similar to either the curvature of the front portion 4970 or the rear portion 4980. In the example of FIG. 51, the first support portions 5172 have a similar curvature at the curvature of the front portion 4970, which may provide structural reinforcement and rigidity to the bottom portion 4940 when the face portion 4975 strikes a golf ball (not shown). Alternatively, the first support portions 5172 may have any configuration or curvature or may be linear. In one example, the first support portions 5172 may be defined by radial lines (not shown) that converge at a point (not shown) on or outside of the bottom portion 4940. The apparatus, methods, and articles of manufacture described herein are not limited in this regard.

In one example, the bottom portion 4940 may include at least three of the second support portions 5174 that may extend between the front portion 4970 and the rear portion 4980. The second support portions 5174 may be similarly spaced apart and/or generally parallel. At least one or more of the second support portions 5174 may be configured to intersect with the first and second weight port regions 5050 and 5150. Accordingly, the second support portions 5174 may provide structural reinforcement and rigidity to the weight port regions 5050 and 5150 and/or areas of the bottom portion 4940 near the weight port regions 5050 and 5150. The first support portions 5172 may have a curvature similar to either the curvature of the toe portion 4950 or the heel portion 4960. In the example of FIG. 51, the second support portions 5174 extend generally linearly between the rear portion 4980 and the front portion 4970 yet follow the curvature of the bottom portion 4940 from the rear portion 4980 to the front portion 4970. The second support portions 5174 may provide structural reinforcement and rigidity to the bottom portion 4940 when the face portion 4975 strikes a golf ball (not shown). Alternatively, the second support portions 5174 may have any configuration. In one example, the second support portions 5174 may be defined by radial lines (not shown) that converge at a point (not shown) on or outside of the bottom portion 4940. The apparatus, methods, and articles of manufacture described herein are not limited in this regard.

Figure 53:
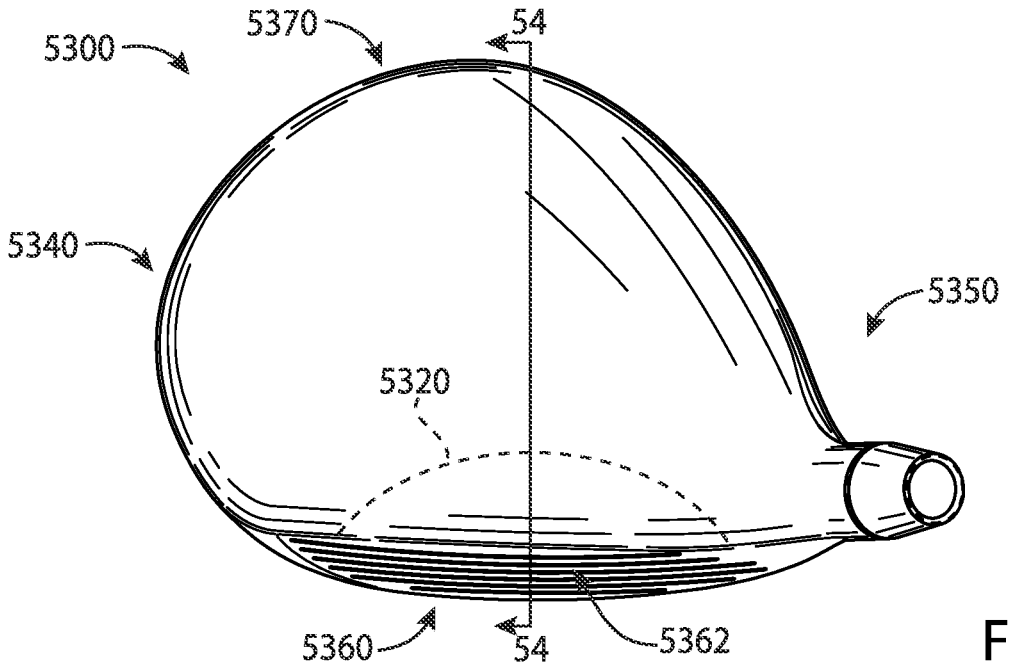
FIG. 53 depicts a top view of a golf club head according to another embodiment of the apparatus, methods, and articles of manufacture described herein.
Figure 54:
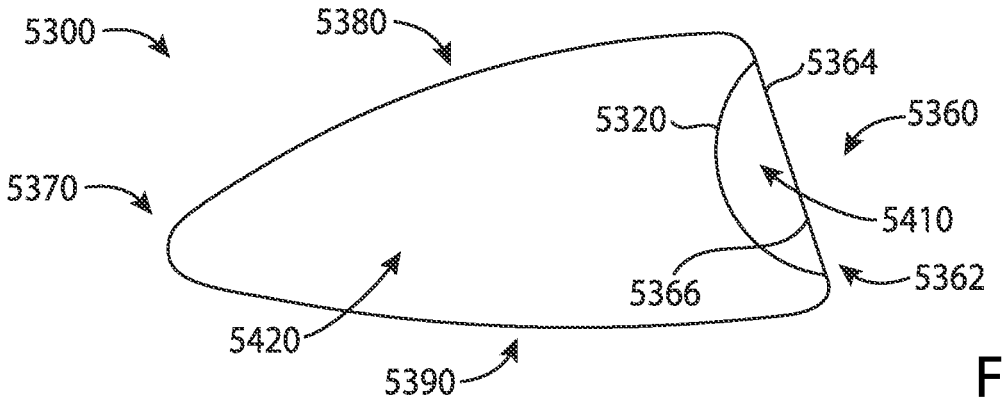
FIG. 54 depicts a schematic cross-sectional view of the example golf club head of FIG. 53 along line 54-54.
Figure 55:
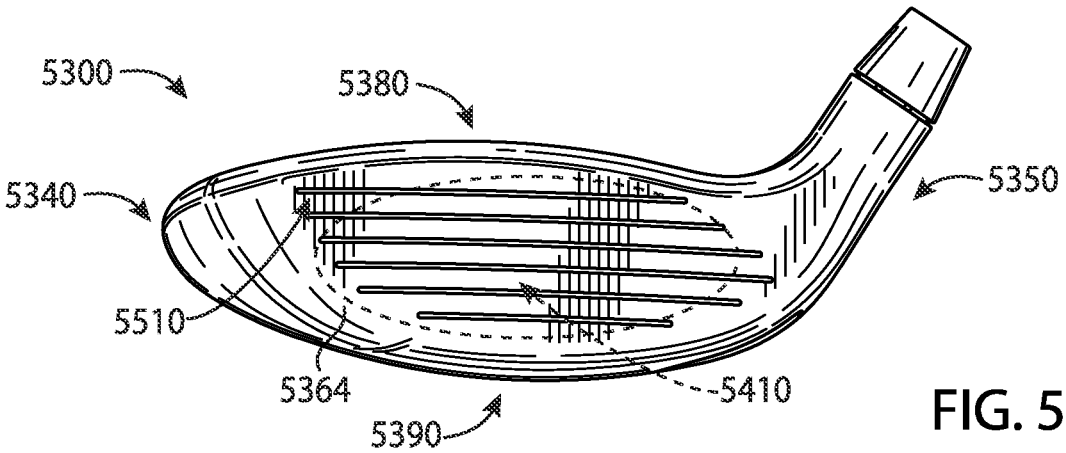
FIG. 55 depicts a front view of the example golf club head of FIG. 53.

While the above examples may describe a certain type of golf club head, the apparatus, methods, and articles of manufacture described herein may be applicable to other types of golf club heads. Referring to FIGS. 53-55, for example, a golf club head 5300 may include a body portion 5310 and a cavity wall portion 5320. The golf club head 5300 may have a club head volume greater than or equal to 300 cubic centimeters ($cm^3$ or cc). In one example, the golf club head 5300 may be about 460 cc. Alternatively, the golf club head 5300 may have a club head volume less than or equal to 300 cc. For example, the golf club head 5300 may have a club head volume between 100 cc and 200 cc. The club head volume of the golf club head 5300 may be determined by using the weighted water displacement method (i.e., Archimedes Principle). For example, procedures defined by golf standard organizations and/or governing bodies such as the United States Golf Association (USGA) and/or the Royal and Ancient Golf Club of St. Andrews (R&A) may be used for measuring the club head volume of the golf club head 100. Although FIGS. 53-55 may depict a particular type of club head (e.g., a fairway wood-type club head), the apparatus, methods, and articles of manufacture described herein may be applicable to other types of club head (e.g., a driver-type club head, a hybrid-type club head, an iron-type club head, a putter-type club head, etc.). The apparatus, methods, and articles of manufacture described herein are not limited in this regard.

The body portion 5310 may include a toe portion 5340, a heel portion 5350, a front portion 5360, a rear portion 5370, a top portion 5380 (e.g., a crown portion), and a bottom portion 5390 (e.g., a sole portion). The body portion 5310 may be a hollow body made partially or entirely of an aluminum-based material, a magnesium-type material, a steel-based material, a titanium-based material, any other suitable material, or any combination thereof. In another example, the body portion 5310 may be made partially or entirely of a non-metal material such as a ceramic material, a composite material, any other suitable material, or any combination thereof. The front portion 5360 may include a face portion 5362 (e.g., a strike face). The face portion 5362 may include a front surface 5364 and a back surface 5366. The front surface 5364 may include a plurality of grooves, generally shown as 5510 in FIG. 55.

The cavity wall portion 5320 may form a first interior cavity 5410 and a second interior cavity 5420 within the body portion 5310. For example, the cavity wall portion 5320 may be made partially or entirely of an aluminum-based material, a steel-based material, any other suitable material, or any combination thereof. In another example, the cavity wall portion 5320 may be made partially or entirely of a non-metal material such as a ceramic material, a composite material, any other suitable material, or any combination thereof. The first interior cavity 5410 may be associated with a first volume, and the second interior cavity 5420 may be associated with a second volume. In one example, the first volume may be less than the second volume. Further, the first volume may be less than or equal to 50% of the second volume.

As illustrated in FIG. 54, for example, the cavity wall portion 5320 may extend from the back surface 5366 of the face portion 5362. In one example, the cavity wall portion 5320 may extend no more than one inch from the back surface 5366. In another example, the cavity wall portion 5320 may extend no more than two inches from the back surface 5366. The cavity wall portion 5320 may be a single curved wall section. In particular, the cavity wall portion 5320 may have a convex arc profile relative to the back surface 5366 (e.g., C shape) to form a dome-like structure with an elliptical base (e.g., FIG. 55) or a circular base on the back surface 5366. In another example, the cavity wall portion 5320 may form a cone-like structure or a cylinder-like structure with the body portion 5310. Alternatively, the cavity wall portion 5320 may be a concave arc profile relative to the back surface 5366. The apparatus, methods, and articles of manufacture described herein are not limited in this regard.

The first interior cavity 5410 may be partially or entirely filled with an elastic polymer or elastomer material (e.g., a viscoelastic urethane polymer material such as Sorbothane® material manufactured by Sorbothane, Inc., Kent, Ohio), a thermoplastic elastomer material (TPE), a thermoplastic polyurethane material (TPU), and/or other suitable types of materials to absorb shock, isolate vibration, dampen noise, and/or provide structural support. The elastic polymer material may be injected into the first interior cavity 5410 via an injection molding process via a port on the face portion 5362. For example, at least 50% of the first interior cavity 5410 may be filled with a TPE material to absorb shock, isolate vibration, dampen noise, and/or provide structural support when the golf club head 5300 strikes a golf ball via the face portion 5362. With the support of the cavity wall portion 5320 to form the first interior cavity 5410 and filling at least a portion of the first interior cavity 5410 with an elastic polymer material, the face portion 5362 may be relatively thin without degrading the structural integrity, sound, and/or feel of the golf club head 5300. In one example, the face portion 5362 may have a thickness of less than or equal to 0.075 inch (e.g., a distance between the front surface 5364 and the back surface 5366). In another example, the face portion 5362 may have a thickness of less than or equal to 0.060 inch. In yet another example, the face portion 5362 may have a thickness of less than or equal to 0.050 inch. Further, the face portion 5362 may have a thickness of less than or equal to 0.030 inch. The apparatus, methods, and articles of manufacture described herein are not limited in this regard.

Figure 56:
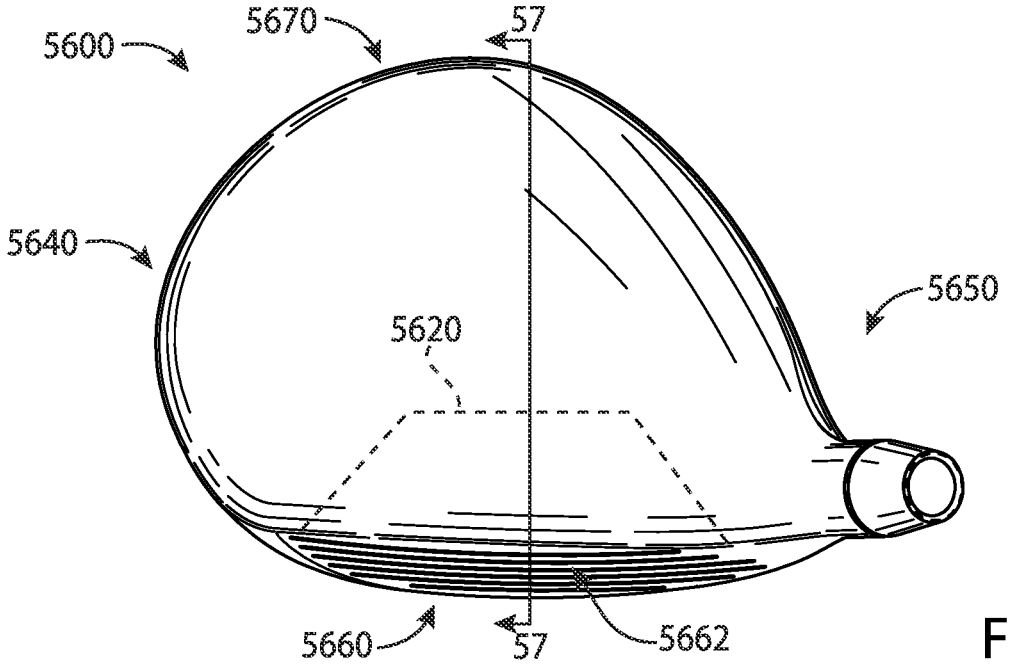
FIG. 56 depicts a top view of a golf club head according to yet another embodiment of the apparatus, methods, and articles of manufacture described herein.
Figure 57:
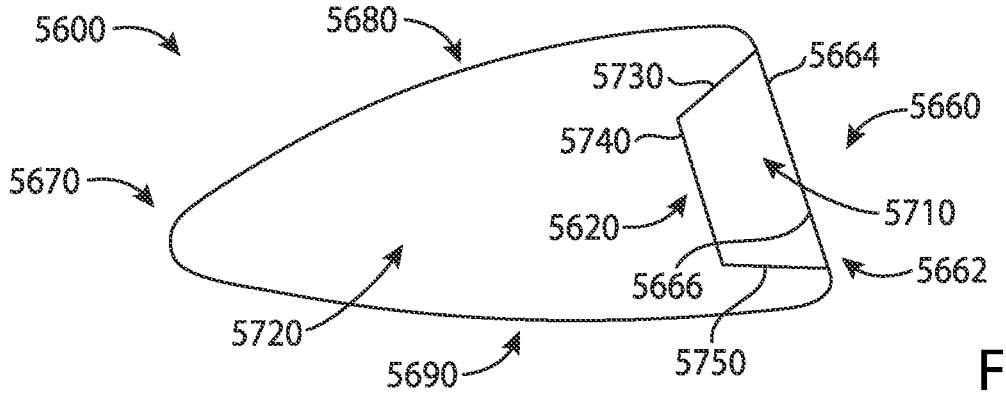
FIG. 57 depicts a schematic cross-sectional view of the example golf club head of FIG. 56 along line 57-57.
Figure 58:
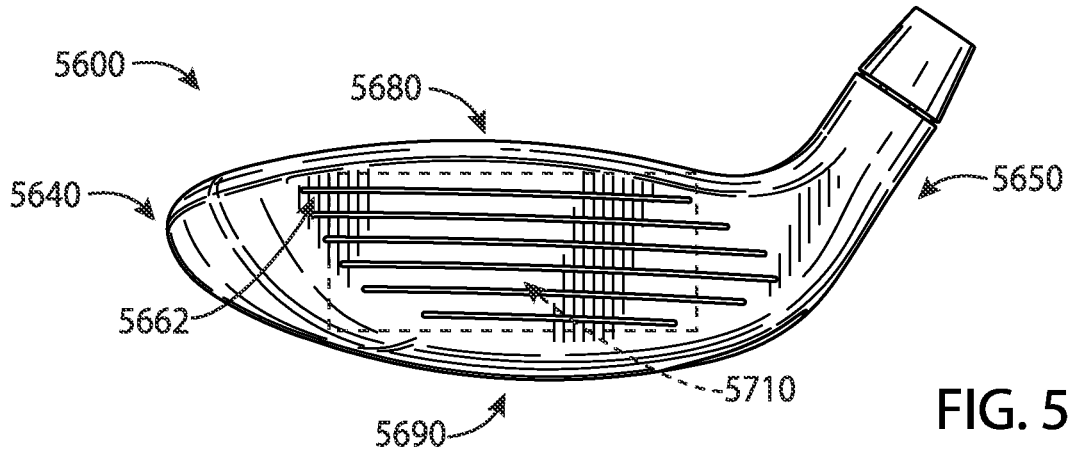
FIG. 58 depicts a front view of the example golf club head of FIG. 56.

The cavity wall portion 5320 may include multiple sections. Turning to FIGS. 56-58, for example, a golf club head 5600 may include a body portion 5610 and a cavity wall portion 5620. The body portion 5610 may include a toe portion 5640, a heel portion 5650, a front portion 5660, a rear portion 5670, atop portion 5680 (e.g., a crown portion), and a bottom portion 5690 (e.g., a sole portion). The front portion 5660 may include a face portion 5662 (e.g., a strike face) with a front surface 5664 and a back surface 5666. The cavity wall portion 5620 may extend from the back surface 5666 to form a first interior cavity 5710 and a second interior cavity 5720 within the body portion 5610. The cavity wall portion 5620 may include two or more wall sections, generally shown as 5730, 5740, and 5750 in FIG. 57. The cavity wall portion 5620 may form a truncated pyramid-like structure with a rectangular base (e.g., FIG. 58) or a square base on the back surface 5666. Alternatively, the cavity wall portion 5620 may form a cuboid-like structure (i.e., with a rectangular base) or a cuboid-like structure (i.e., with a square base) on the back surface 5666. In another example, the cavity wall portion 5620 may form a square-based, pyramid-like structure on the back surface 5666. In yet another example, the cavity wall portion 5620 may form a triangular-based, pyramid-like structure or a triangular prism-like structure on the back surface 5666. Similar to the first interior cavity 5410 (FIGS. 53-55), the first interior cavity 5710 may be partially or entirely filled with an elastic polymer or elastomer material (e.g., a TPE material, a TPU material, etc.). The elastic polymer material may be injected into the first interior cavity 5710 via an injection molding process via a port on the face portion 5662. The apparatus, methods, and articles of manufacture described herein are not limited in this regard.

Figure 59:
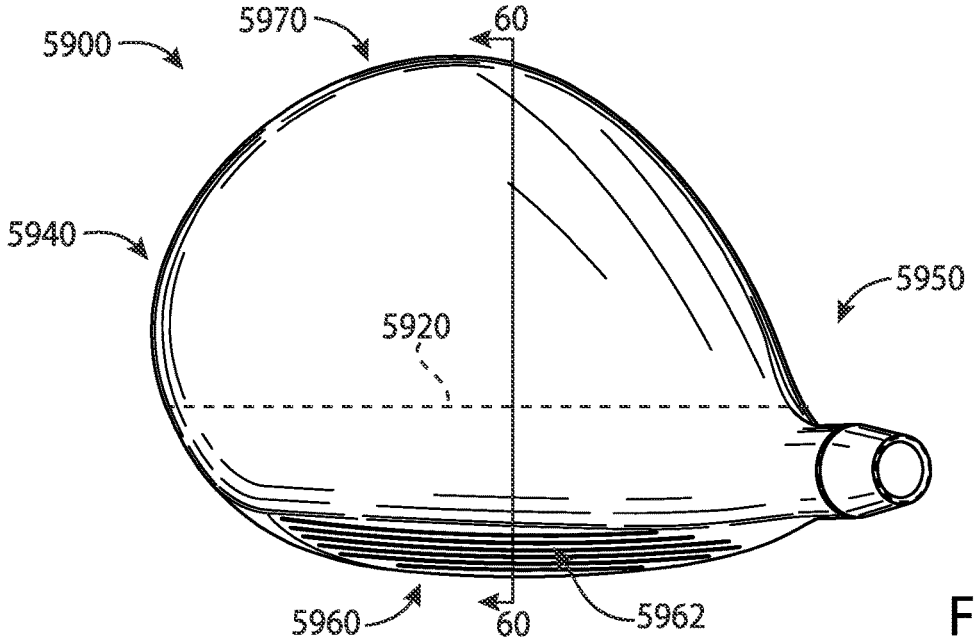
FIG. 59 depicts a top view of a golf club head according to yet another embodiment of the apparatus, methods, and articles of manufacture described herein.
Figure 60:
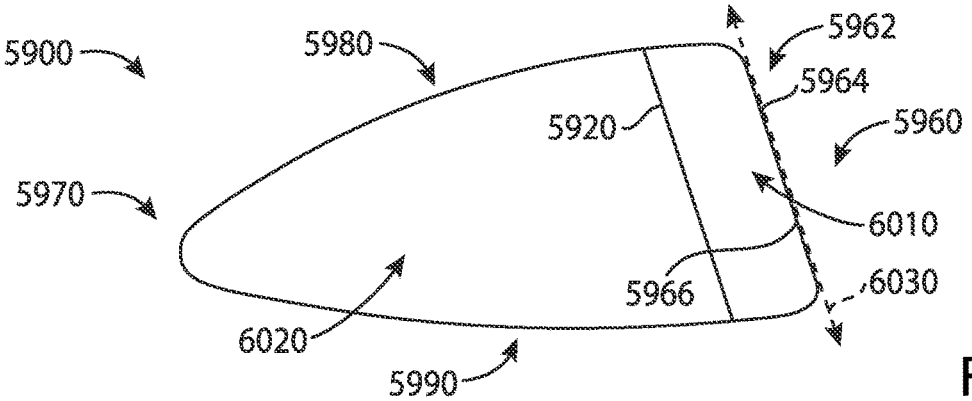
FIG. 60 depicts a schematic cross-sectional view of the example golf club head of FIG. 59 along line 60-60.

As illustrated in FIGS. 59 and 60, for example, a golf club head 5900 may include a body portion 5910 and a cavity wall portion 5920. The body portion 5910 may include a toe portion 5940, a heel portion 5950, a front portion 5960, a rear portion 5970, a top portion 5980 (e.g., a crown portion), and a bottom portion 5990 (e.g., a sole portion). The front portion 5960 may include a face portion 5962 (e.g., a strike face) with a front surface 5964 and a back surface 5966. The face portion 5962 may be associated with a loft plane 6005 that defines the loft angle of the golf club head 5900.

Figure 61:
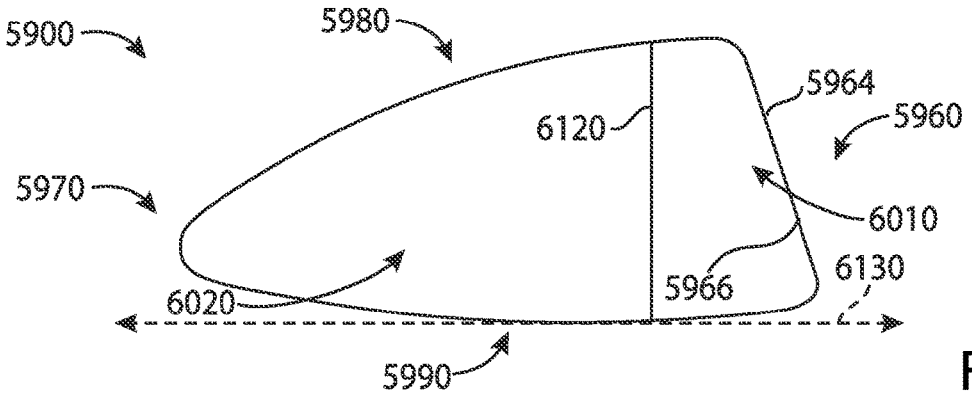
FIG. 61 depicts a schematic cross-sectional view of the example golf club head of FIG. 59 along line 60-60 according to another embodiment of the apparatus, methods, and articles of manufacture described herein.
Figure 62:
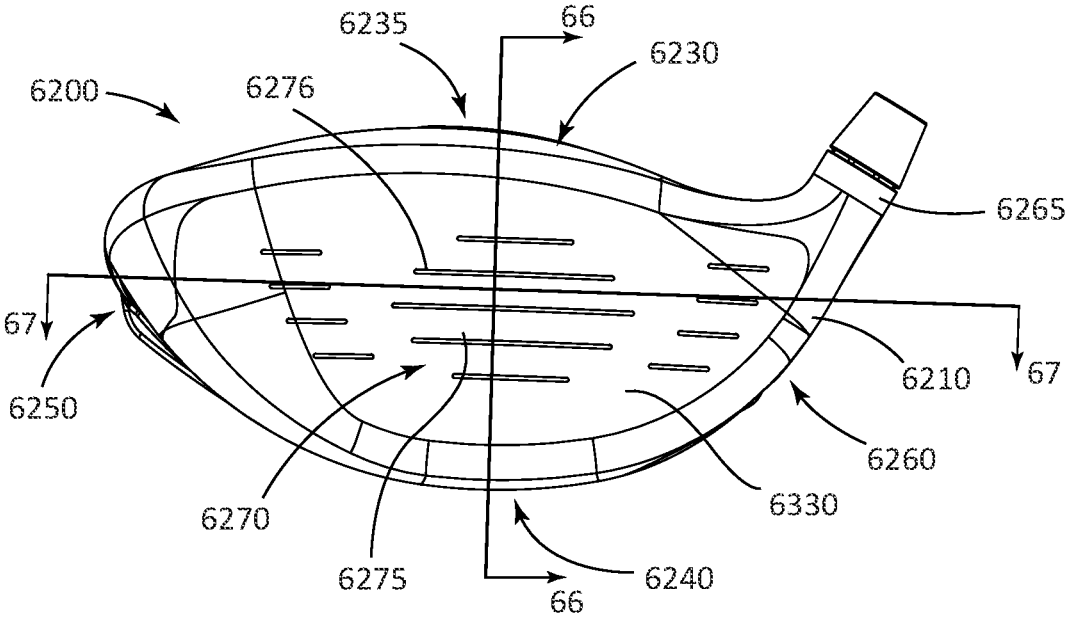
FIG. 62 depicts a front view of a golf club head according to another embodiment of the apparatus, methods, and articles of manufacture described herein.
Figure 63:
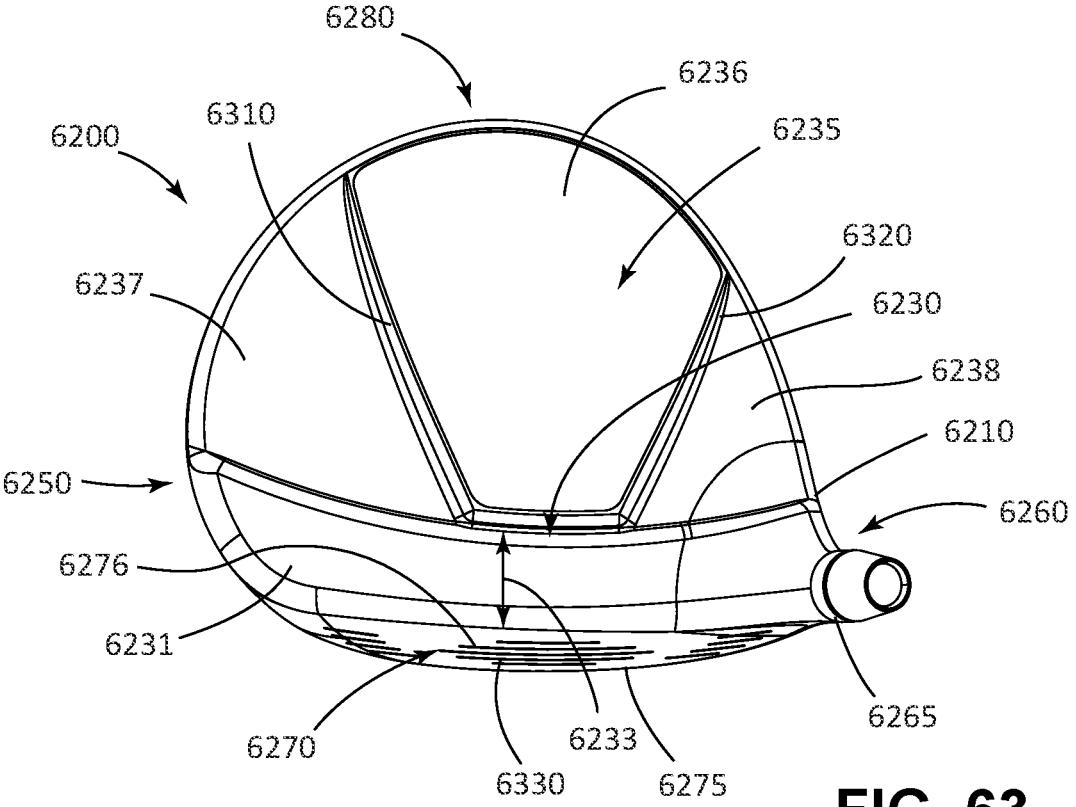
FIG. 63 depicts a top view of the example golf club head of FIG. 62.

The cavity wall portion 5920 may be a single flat wall section. In particular, the cavity wall portion 5920 may extend between the toe portion 5940 and the heel portion 5950 and between the top portion 5980 and the bottom portion 5990 to form a first interior cavity 6010 and a second interior cavity 6020 within the body portion 5910. The cavity wall portion 5920 may be parallel or substantially parallel to the loft plane 6005. Alternatively, as shown in FIG. 61, a cavity wall portion 6120 may be perpendicular or substantially perpendicular to a ground plane 6130. Similar to the first interior cavities 5410 (FIGS. 53-55) and 5710 (FIGS. 56-58), the first interior cavity 6010 may be partially or entirely filled with an elastic polymer or elastomer material. The elastic polymer material may be injected into the first interior cavity 6010 via an injection molding process via a port on the face portion 5962 and/or the bottom portion 5990. The apparatus, methods, and articles of manufacture described herein are not limited in this regard.

Alternatively, the cavity wall portion 5920 may extend between the bottom portion 5990 and a top-and-front transition region (i.e., a transition region between the top portion 5980 and the front portion 5960) so that the cavity wall portion 5920 and the loft plane 6030 may not be parallel to each other. In another example, the cavity wall portion 5920 may extend between the top portion 5980 and a bottom-and-front transition region (i.e., a transition region between the bottom portion 5990 and the front portion 5960) so that the cavity wall portion 5920 and the loft plane 6030 may be not parallel to each other. Although FIGS. 59-61, may depict the cavity wall portions 5920 and 6120 being flat or substantially flat, the cavity wall portions 5920 and/or 6120 may be concave or convex relatively to the face portion 5962. The apparatus, methods, and articles of manufacture described herein are not limited in this regard.

In the example of FIGS. 62-67, a golf club head 6200 may include a body portion 6210 with a top portion 6230, a crown portion 6235, a bottom portion 6240, a toe portion 6250, a heel portion 6260, a front portion 6270, and a rear portion 6280. The body portion 6210 may include a skirt portion 6290 defined as a side portion of the golf club head 6200 between the top portion 6230 and the bottom portion 6240. The skirt portion 6290 may exclude the front portion 6270 and may extend across a periphery of the golf club head 6200 from the toe portion 6250, around the rear portion 6280, and to the heel portion 6260. Alternatively, the golf club head 6200 may not include the skirt portion 6290. The front portion 6270 may include a face portion 6275 to engage a golf ball. The face portion 6275 may be integral to the body portion 6210 or may be a separate component that is coupled (e.g., welded) to the front portion 6270 to enclose an opening formed therein. The body portion 6210 may also include a hosel portion 6265 configured to receive a shaft portion (not shown). The hosel portion 6265 may be similar in many respects to any of the hosel portions described herein. The hosel portion 6265 may include an interchangeable hosel sleeve. Alternatively, the body portion 6210 may include a bore instead of the hosel portion 6265. The body portion 6210 may be made of any material or combination of materials described herein and may be dimensioned (e.g., size, shape, volume, etc.) according to any of the golf club heads described herein. The golf club head 6200 may include one or more ports (e.g., 6244, 6246, 6248) in the bottom portion 6240. Each mass port may be configured to receive a mass portion (not shown) A first port 6244 may be located closer to the rear portion 6280 than to the front portion 6270. A second port 6246 may be located closer to the front portion 6270 than to the rear portion. A third port 6248 may be located closer to the heel portion 6860 than to the toe portion 6850. The ports and mass portions be similar to the ports and mass portions shown in any of the golf club heads described herein and/or any of the incorporated by reference applications. The apparatus, methods, and articles of manufacture described herein are not limited in this regard.

The top portion 6230 may include a forward portion 6231 extending a distance 6233 between the front portion 6270 and the crown portion 6235. In one example, the distance 6233 in which the forward portion 6231 extends between the front portion 6270 and the crown portion 6235 may be at least 12 mm in a front-to-rear direction. In another example, the distance 6233 may be at least 16 mm in a front-to-rear direction. In another example, the distance 6233 may be at least 20 mm in a front-to-rear direction. In yet another example, the distance 6233 may be between 12 mm to 20 mm in a front-to-rear direction. While the above examples may describe particular distances, the apparatus, methods, and articles of manufacture described herein may include a forward portion extending a distance less than 12 mm in a front-to-rear direction. The forward portion 6231 may enhance structural integrity of the golf club head 6200 and resist rearward deflection of the front portion 6270 during impact with a golf ball. The forward portion 6231 may transfer an impact force to the crown portion 6235 during an impact with a golf ball. The forward portion 6231 may distribute an impact force along a surface of the crown portion 6235 that abuts a junction 6232 formed between the crown portion 6235 and the forward portion 6231 of the top portion 6230. The apparatus, methods, and articles of manufacture described herein are not limited in this regard.

The crown portion 6235 may include a central crown portion 6236, a toe-side crown portion 6237, and a heel-side crown portion 6238, each of which may be integral to the body portion 6210. In other words, the central crown portion 6236, a toe-side crown portion 6237, and/or the heel-side crown portion 6238 may be a separate piece that may be attached to the top portion 6230. The crown portion 6235 or portions thereof may be constructed from one or more materials that may be the same or different from the material of the body portion 6210. In one example, the crown portion 6235 may be at least partially constructed from a composite material such as a fiber-based composite material. In the illustrated example, the central crown portion 6236 may be a separate piece attached to a shoulder portion 6239 of the crown portion 6235. The shoulder portion 6239 may extend along all or a portion of an opening 6300 located between the toe-side crown portion 6237 and the heel-side crown portion 6238 and may support the central crown portion 6236. In one example, the shoulder portion 6239 may be a continuous portion encircling the opening 6300 in the crown portion 6235. In another example, the shoulder portion 6239 may include one or more discrete shoulder portions arranged to support the central crown portion 6236. In another example, the shoulder portion 6239 may include a plurality of tabs arranged to support the central crown portion 6236. In another example, the shoulder portion 6239 may be omitted and the central crown portion 6236 may be adhered to an outer surface and/or an inner surface of the toe-side crown portion 6237 and/or the heel-side crown portion 6238. In yet another example, the shoulder portion 6239 may be omitted and the central crown portion 6236 may include a protrusion extending from a bottom surface of the central crown portion 6236 that provides an interference fit with a perimeter edge of the opening 6300. The toe-side crown portion 6237 and/or the heel-side crown portion 6238 may be integral with the body portion 6210 or separately attached thereto. The apparatus, methods, and articles of manufacture described herein are not limited in this regard.

The central crown portion 6236 may be raised relative to the toe-side crown portion 6237 and/or the heel-side crown portion 6238. The central crown portion 6236 may be located between the toe-side crown portion 6237 and the heel-side crown portion 6238. In this arrangement, the central crown portion 6236 may serve as a visual alignment aid. Additionally, the central crown portion 6236 may improve aerodynamic performance of the golf club head 6200. Additionally still, the central crown portion 6236 may stiffen the crown portion 6235 and reduce deflection (e.g., bulging) of the crown portion 6235 in response to the face portion 6275 impacting a golf ball. Reducing bulging of the crown portion 6235 may be desirable to reduce shear stress on a joint (e.g., an adhesive bond) between the crown portion 6235 and the top portion 6230 of the golf club head. The apparatus, methods, and articles of manufacture described herein are not limited in this regard.

The crown portion 6235 may include a plurality of contoured surfaces. The plurality of contoured surfaces may reduce aerodynamic drag of the golf club head 6200. The plurality of contoured surfaces may enhance structural integrity of the golf club head 6200. An outer surface of the central crown portion 6236 may be elevated above an outer surface of the toe-side crown portion 6237. The outer surface of the central crown portion 6236 may be elevated above an outer surface of the heel-side crown portion 6238. The crown portion 6235 may include a first contoured transition region 6310 located between the central crown portion 6236 and the toe-side crown portion 6237. The crown portion 6235 may include a second contoured transition region 6320 located between the central crown portion 6236 and the heel-side crown portion 6238. Together, the central crown portion 6236, the toe-side crown portion 6237, the heel-side crown portion 6238, the first contoured transition region 6310, and the second contoured transition region 6320 may form a multi-level and/or multi-thickness crown portion 6235. The apparatus, methods, and articles of manufacture described herein are not limited in this regard.

The face portion 6275 may include a front side 6330 and a rear side 6340 opposite the front side 6330. The front side 6330 may define an exterior surface of the body portion 6210 and the rear side 6340 may define an interior surface of the body portion 6210. A distance between the front side 6330 and the rear side 6340 may define a thickness of the face portion 6275. The thickness of the face portion may be substantially uniform subject to a desired roll (i.e., the curvature of the face portion 6275 from the top portion 6230 to the bottom portion 6240) and bulge (i.e., the curvature of the face portion 6275 from the toe portion 6250 to the heel portion 6260). In the illustrated example, the face portion 6275 may include an outer face plate 6350 bounded by the top portion 6230, the bottom portion 6240, the toe portion 6250, and the heel portion 6260. The outer face plate 6350 may enclose an inner face plate 6360 that is sized and dimensioned to fit a central opening 6351 formed through the outer face plate 6350. Together, the front surfaces of the outer and inner face plates 6350 and 6360 may define the front side 6330 of the face portion 6275 and the rear surfaces of the outer and inner face plates 6350 and 6360 may define the rear side 6340 of the face portion 6275. The inner face plate 6360 may be irremovably coupled to the outer face plate 6350 through a welding or other bonding process. In one example, the inner face plate 6360 may occupy a central portion of the face portion 6275 and is generally delimited at boundary line 6361, which is generally shown for purposes of illustration and understanding. In practice, however, the boundary of the inner face plate 6360 may be less noticeable due to the fitment between the inner face plate 6360 and the outer face plate 6350 and may be not noticeable after welding the inner face plate 6360 to the outer face plate 6350 and smoothing the welded surfaces. The front of the inner face plate 6360 may correspond to less than half, half, or more than half the total surface area of the front side 6330 of the face portion 6275. The apparatus, methods, and articles of manufacture described herein are not limited in this regard.

The inner face plate 6360 may be shaped according to a contour of the face portion 6275 or another contour. In one example, the inner face plate 6360 may have an irregular rounded shape such as, but not limited to, an irregular oval, elliptical, or circular shape. In another example, the inner face plate 6360 may have any other regular or irregular geometric shape such as, but not limited to, a square shape, a rectangular shape, a triangular shape, or a polygonal shape. In one example, the face portion 6275 may have a thickness (i.e., the distance between the front and rear sides 6330 and 6340) of about 0.100 inch (2.54 mm). In another example, the face portion 6275 may have a thickness of about 0.110 inch (2.79 mm). In yet another example, the face portion 6275 may have a thickness of about 0.120 inch (3.05 mm). In yet another example, the face portion 6275 may have a thickness of about 0.100 inch (2.54 mm) to about 0.120 inch (3.05 mm). In yet another example, the face portion 6275 may have a thickness less than or equal to 0.100 inch (2.54 mm). In yet another example, the face portion 6275 may have a thickness greater than or equal to 0.120 inch (3.05 mm). The face portion 6275, including the outer and inner face plates 6350 and 6360 may be made of any material or combination of materials described herein and may be dimensioned according to any of the provided examples. In one example, the face portion 6275 may be made of a high strength metal alloy material such as, but not limited to titanium (e.g., Ti-412). Optionally, the face portion 6275 may have one or more scorelines (e.g., scoreline 6276) formed at the front side 6330. The apparatus, methods, and articles of manufacture described herein are not limited in this regard.

Figure 64:
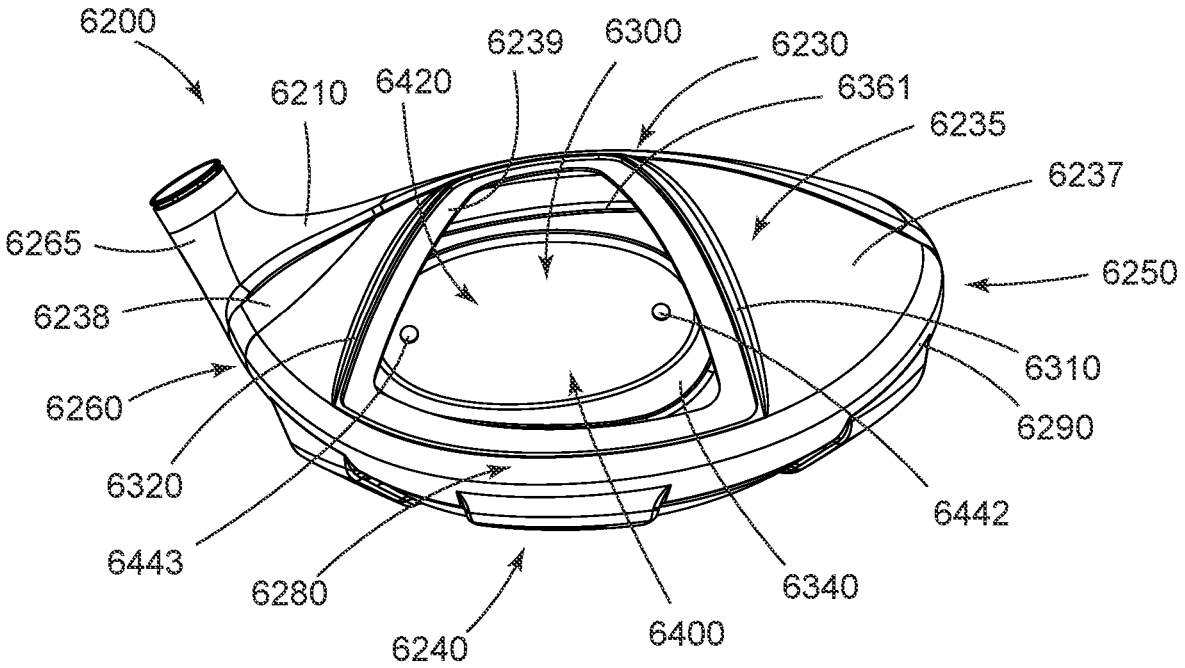
FIG. 64 depicts a rear view of the example golf club head of FIG. 62.
Figure 65:
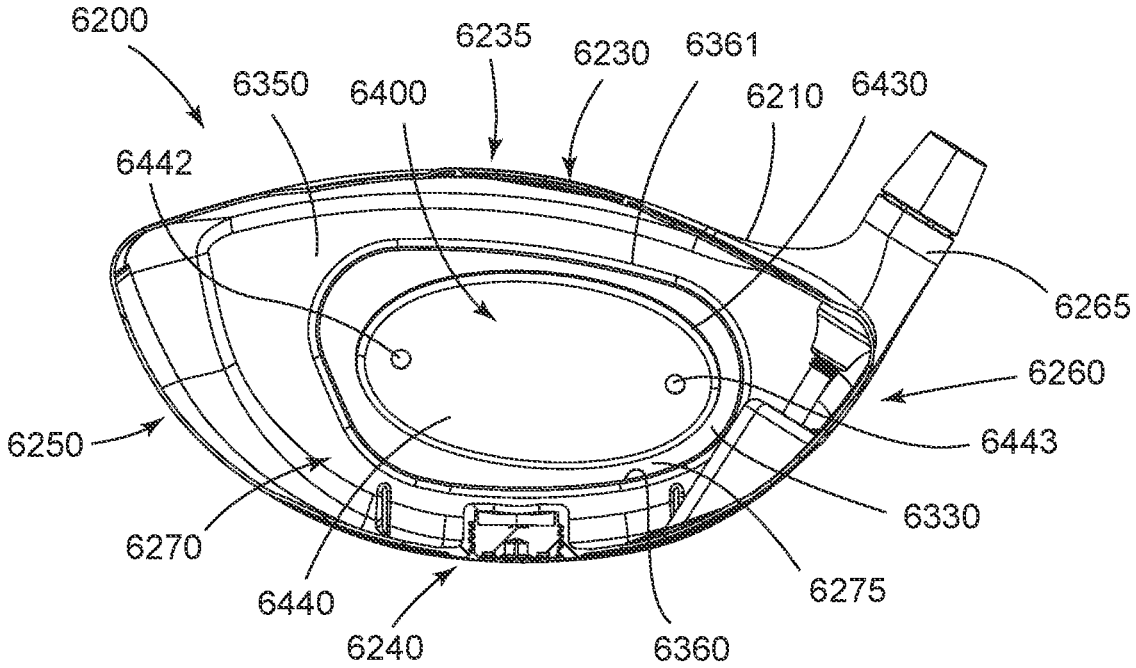
FIG. 65 depicts a front view of the example golf club head of FIG. 62, wherein a pocket structure is made visible for purposes of illustration and understanding.
Figure 66:
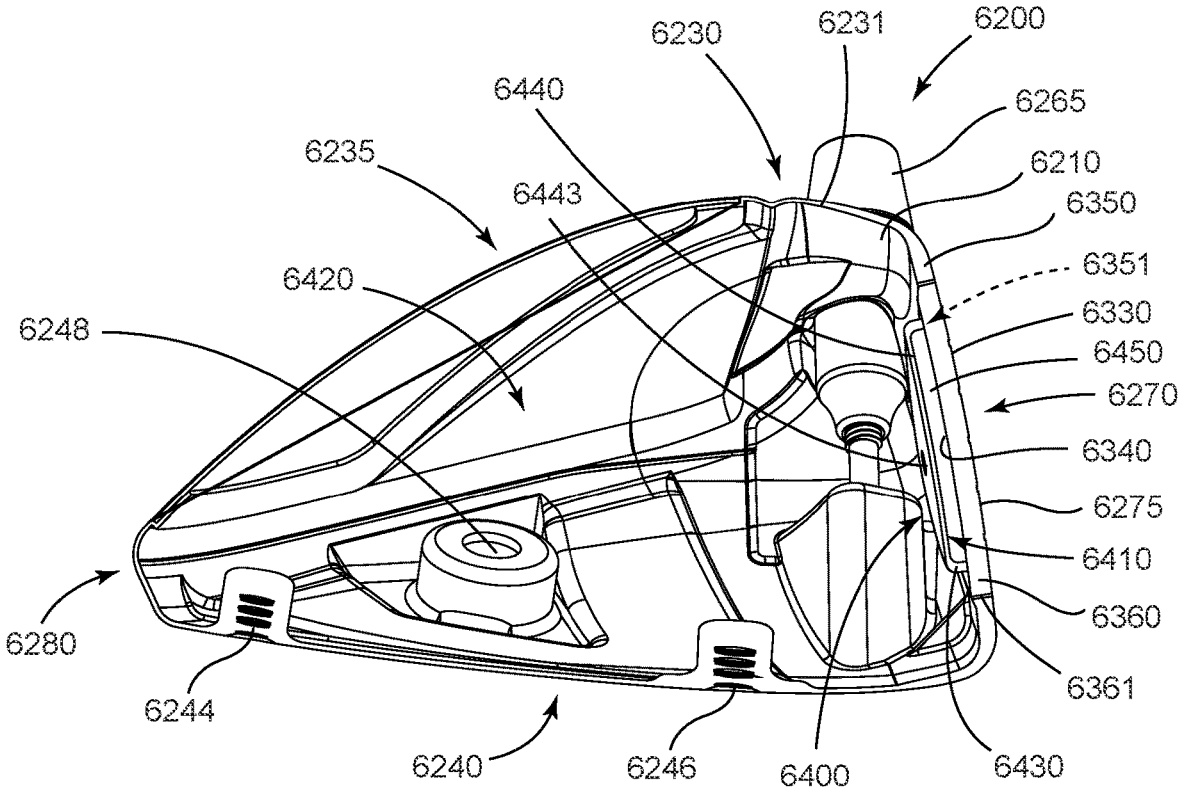
FIG. 66 depicts a schematic cross-sectional side view of the example golf club head of FIG. 62 along line 66-66.
Figure 67:
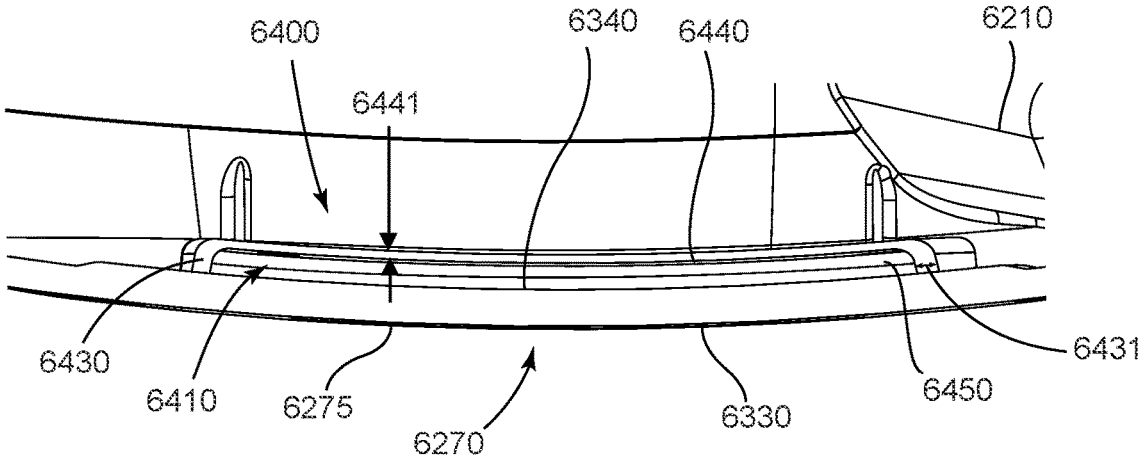
FIG. 67 depicts an enlarged partial schematic cross-sectional top view of the example golf club head of FIG. 62 along line 67-67.
Figure 68:
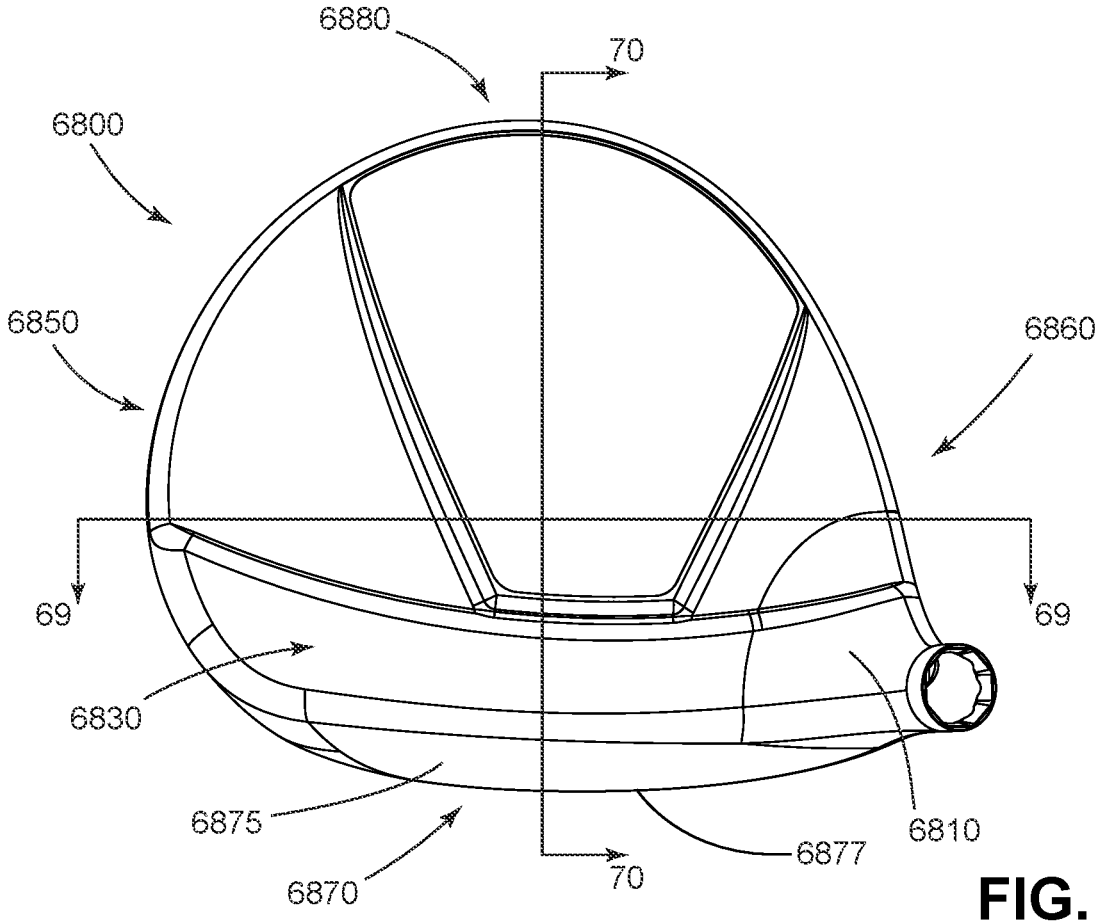
FIG. 68 depicts a top view of a golf club head according to another embodiment of the apparatus, methods, and articles of manufacture described herein.
Figure 69:
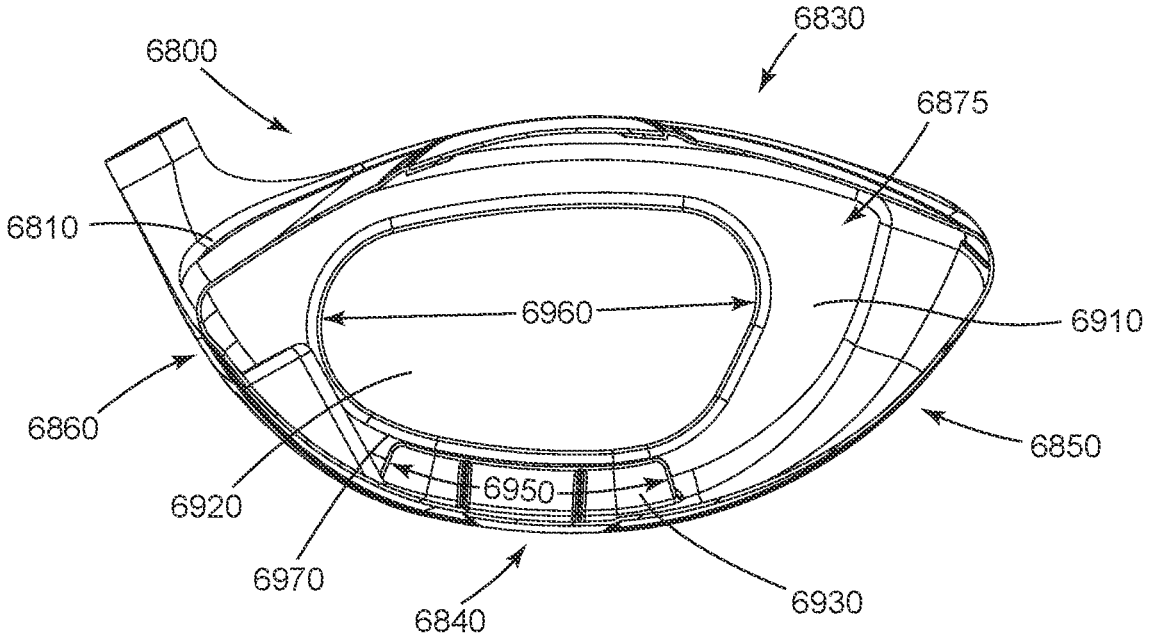
FIG. 69 depicts a schematic cross-sectional rear view of the example golf club head of FIG. 68 along line 69-69.

In the example of FIGS. 62-67, a pocket structure 6400 may be coupled to the rear surface of the inner face plate 6360 to form a pocket cavity 6410 defined by the pocket structure 6400 and the inner face plate 6360. For purposes of illustration and understanding, the pocket structure 6400 is made visible in FIG. 65 but would otherwise be concealed by the face portion 6275 and located within the body portion 6210. In one example, the pocket structure 6400 may serve to partition the body portion 6210 into a first cavity depicted as pocket cavity 6410 and a second, larger cavity, depicted as body cavity 6420 (see, e.g., FIG. 66). The pocket structure 6400 may be irremovably coupled to the rear surface of the inner face plate 6360 through a welding or other bonding process. The pocket structure 6400 may include a perimeter side wall 6430 joined to a back wall 6440. In one example, the perimeter side wall 6430 may have a uniform thickness 6431 of 0.050 inch or approximately 0.050 inch. In another example, the thickness 6431 of the perimeter side wall 6430 may be less than 0.050 inch (1.27 mm) or greater than 0.050 inch (1.27 mm). The particular thickness 6431 (e.g., 1.27 mm) of the perimeter side wall 6430 may be chosen to help ensure a strong attachment between the pocket structure 6400 and the inner face plate 6360. In one example, the back wall 6440 may have a uniform thickness 6441 of about 0.025 inch. In another example, the thickness 6441 of the back wall 6440 may be less than 0.025 inch or greater than 0.025 inch (0.635 mm). The particular thickness 6441 of the back wall 6440 may be chosen to minimize an overall mass of the pocket structure 6400. In one example, the back wall 6440 may have an elliptical shape following a contour or curvature of the inner face plate 6360, or in other words, may extend pursuant to the roll and/or bulge of the face portion 6275 as depicted in FIGS. 66 and 67. Accordingly, the back wall 6440 may be parallel with the inner face plate 6360 and may share a common loft therewith. In another example, the back wall 6440 may have other regular or irregular geometric shapes such as, but not limited to, a square shape, an oval shape, a circular shape, a triangular shape, or a polygonal shape. Accordingly, the pocket structure 6400 may be generally shaped as an ellipsoid, a dome, a box, a pyramid, or any other three dimensional shape. The back wall 6440 may include one or more through-holes generally shown as first through-hole 6442 and a second through-hole 6443. The first through-hole 6442 may share similar or different dimensions (e.g., size and shape) with the second through-hole 6443. In one example, as shown in FIGS. 64 and 65, the first through-hole 6442 may be located toward the toe portion 6250 of the body portion 6210 and the second through-hole 6443 may be located toward the heel portion 6260 of the body portion 6210. In another example, the first through-hole 6442 and/or the second through-hole 6443 may be formed elsewhere in the back wall 6440 including a central location, a location toward the top portion 6230, and/or a location toward the bottom portion 6240. In yet another example, the first through-hole 6442 and/or the second through-hole 6443 may be formed in the perimeter side wall 6430. The apparatus, methods, and articles of manufacture described herein are not limited in this regard.

The pocket structure 6400 may be made of the same material as or different material than the inner face plate 6360. In one example, the pocket structure 6400 may be made of a high strength metal alloy material such as, but not limited to titanium (e.g., Ti-811). Accordingly, the pocket structure 6400 may have the same Young's modulus as or a different Young's modulus than the inner face plate 6360. Additionally, the pocket structure 6400 may have the same density as or a different density than the inner face plate 6360. In one example, the pocket structure 6400 may have a higher Young's modulus and a lower density than the inner face plate 6360. The apparatus, methods, and articles of manufacture described herein are not limited in this regard.

The pocket cavity 6410 may include a filler material 6450 added to the pocket cavity 6410 via one of the first and second through-holes 6442 and 6443. The other of the first and second through-holes 6442 and 6443 may be provided to allow air to escape from the pocket cavity 6410 during the filling process. In one example, the pocket cavity 6410 may be fully filled with the filler material 6450. In another example, the pocket cavity 6410 may be partially filled with the filler material 6450. In yet another example, the pocket cavity 6410 may not be filled with the filler material 6450. The apparatus, methods, and articles of manufacture described herein are not limited in this regard.

The filler material 6450 may be similar to any of the filler materials described herein or in any of the incorporated by reference applications. The filler material 6450 may be an elastic polymer or elastomer material (e.g., a viscoelastic urethane polymer material such as Sorbothane® material manufactured by Sorbothane, Inc., Kent, Ohio), a thermoplastic elastomer material (TPE), a thermoplastic polyurethane material (TPU), and/or other suitable types of materials to absorb shock, isolate vibration, and/or dampen noise. In another example, the filler material 6450 may be a high density ethylene copolymer ionomer, a fatty acid modified ethylene copolymer ionomer, a highly amorphous ethylene copolymer ionomer, an ionomer of ethylene acid acrylate terpolymer, an ethylene copolymer comprising a magnesium ionomer, an injection moldable ethylene copolymer that may be used in conventional injection molding equipment to create various shapes, an ethylene copolymer that can be used in conventional extrusion equipment to create various shapes, and/or an ethylene copolymer having high compression and low resilience similar to thermoset polybutadiene rubbers. For example, the ethylene copolymer may include any of the ethylene copolymers associated with DuPont™

High-Performance Resin (HPF) family of materials (e.g., DuPont™ HPF AD1172, DuPont™ HPF AD1035, DuPont® HPF 1000 and DuPont™ HPF 2000), which are manufactured by E.I. du Pont de Nemours and Company of Wilmington, Del. The DuPont™ HPF family of ethylene copolymers are injection moldable and may be used with conventional injection molding equipment and molds, provide low compression, and provide high resilience. The apparatus, methods, and articles of manufacture described herein are not limited in this regard.

The filler material 6450 may be a liquid, solid, gas, or combination thereof. In one example, the filler material 6450 may be a solid filler material with gas bubbles trapped within the solid filler material. In another example, the filler material 6450 may be a solution of liquid filler material having suspended solid particles. Where the filler material 6450 includes a liquid or gaseous filler material, the pocket cavity 6410 may be a sealed cavity. Where the filler material 6450 includes a liquid or gaseous filler material, the contents of the pocket cavity 6410 may be pressurized to a pressure greater than atmospheric pressure. In one example, the filler material 6450 may be pressurized to a pressure of between and including 1.1 atm and 25 atm. In another example, the filler material 6450 may be pressurized to a pressure of between and including 1.1 atm and 10 atm. In still another example, the filler material 6450 may be pressurized to a pressure of between and including 1.1 atm and 5 atm. The apparatus, methods, and articles of manufacture described herein are not limited in this regard.

Figure 75:
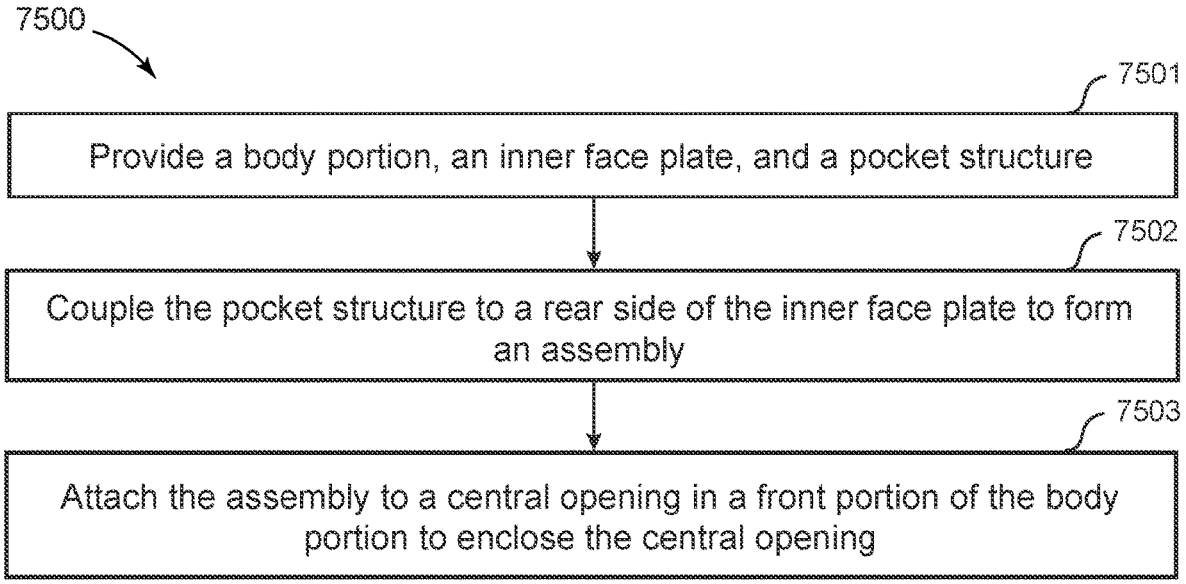
FIG. 75 depicts one manner in which the example golf club head of FIG. 62 may be manufactured.

FIG. 75 depicts one manner by which the example golf club head 6200 as described herein may be manufactured. In the example of FIG. 75, a process 7500 may include providing a body portion 6200, an inner face plate 6360, and a pocket structure 6400 (block 7501). The body portion 6200 may be manufactured via a casting process. The process 7500 may include coupling (e.g., welding) the pocket structure 6400 the rear side 6340 of the inner face plate 6360 to form the pocket cavity 6410 therebetween (block 7502). Both the inner face plate 6360 and the pocket structure 6400 may be manufactured via a casting process or other suitable process. The process 7500 may include attaching the inner face plate 6360 and pocket structure 6400 assembly to the body portion 6210 by coupling (e.g., welding) the inner face plate 6360 to the central opening 6351 of the outer face plate 6350 such that the pocket structure 6400 and the pocket cavity 6410 are located inside the body portion 6210 (block 7503). The pocket cavity 6410 may be partially or entirely filled with the filler material 6450 via one or more through holes (first and second through-holes 6442 and 6443) formed through the pocket structure (e.g., back wall 6440), wherein access to the one or more through-holes may be granted via the opening 6300 of the crown portion 6235. Upon the cavity being partially or entirely filled, the opening 6300 may be covered by attaching the central crown portion 6236 to the shoulder portion 6239 of the crown portion 6235. The apparatus, methods, and articles of manufacture described herein are not limited in this regard.

While above examples may describe a pocket structure 6400 dividing an interior cavity of a hollow body portion to form two separate interior cavities with one interior cavity partially or entirely filled with an elastic polymer material, the apparatus, methods, and articles of manufacture described herein may include two or more cavity wall portions dividing an interior cavity of a hollow body portion to form three or more separate interior cavities with at least two interior cavities partially or entirely filled with an elastic polymer material. In one example, one interior cavity may be partially or entirely filled with a TPE material whereas another interior cavity may be partially or entirely filled with a TPU material. The apparatus, methods, and articles of manufacture described herein are not limited in this regard.

In the example of FIGS. 68-71, a golf club head 6800 may include a body portion 6810 having a top portion 6830, a bottom portion 6840, a toe portion 6850, a heel portion 6860, a front portion 6870, and a rear portion 6880. The front portion 6870 may include an exterior surface 6877 and an interior surface 6970. The front portion 6870 may include a face portion 6875 to strike a golf ball (not shown). The face portion 6875 may be configured according to any of the examples described herein. For exemplary purposes, the face portion 6875 may include an outer face plate 6910 that encloses an inner face plate 6920. The outer and inner face plates 6910 and 6920 may be similar to the outer and inner face plates 6350 and 6360 described with reference to the example golf club head 6200 of FIGS. 62-67. The golf club head 6800 may include a pocket structure similar to the pocket structure 6400 described with reference to the example golf club head 6200 of FIGS. 62-67. The apparatus, methods, and articles of manufacture described herein are not limited in this regard.

The golf club head 6800 may include a wall structure 6930 located inside the body portion 6810. The wall structure 6930 may be coupled to a bottom interior surface 7140 of the body portion 6810 and may extend laterally between the toe portion 6850 and the heel portion 6860. The wall structure 6930 may be adapted to the contour of the bottom interior surface 7140 such that the wall structure 6930 extends across a curved surface, a flat surface, or a combination thereof. In one example, the wall structure 6930 may be parallel or substantially parallel with the face portion 6875. The wall structure 6930 may be integrated with the bottom interior surface 7140 or provided separately and connected thereto. In one example, the wall structure 6930 may have a length 6950 in a toe-heel direction that is less than a length 6960 of the inner face plate 6920 in the toe-heel direction. Alternatively, the length 6950 of the wall structure 6930 may be equal to or greater than the length 6960 of the inner face plate 6920 in the toe-heel direction. In other examples, the wall structure 6930 may extend across an interior surface of the top portion 6830, the bottom portion 6840, the toe portion 6850, the heel portion 6860, or any combination thereof. In any of the examples described herein, the wall structure 6930 may be a single continuous structure or embodied as multiple structures. The apparatus, methods, and articles of manufacture described herein are not limited in this regard.

The wall structure 6930 may be located within the body cavity 6420 of the body portion 6810. The wall structure 6930 may have a base portion 7131 and a tip portion 7132. The wall structure 6930 may have a front surface 7133 and a rear surface 7134. The wall structure 6930 may extend upward from a bottom interior surface 7140 of the body portion 6810. The base portion 7131 may be located proximate to the bottom interior surface 7140. The wall structure 6930 may extend laterally across the bottom interior surface 7140 between the heel portion 6860 and the toe portion 6850. The wall structure 6930 may be widest at the base portion 7131. The wall structure 6930 may be narrowest at the tip portion 7132. The wall structure 6930 may taper from the base portion 7131 to the tip portion 7132. The wall structure 6930 may have a centerline 7135. The centerline 7135 may extend from the base portion 7131 to the tip portion 7132. The centerline 7135 may tilt rearward. The centerline 7135 may be substantially parallel to a front plane 7004 that is tangential to the exterior surface 6877 of the front portion 6870. The apparatus, methods, and articles of manufacture described herein are not limited in this regard.

The wall structure 6930 may be spaced apart from the interior surface 6970 of the front portion 6870 to create a channel 7080 therebetween. In one example, the wall structure 6930 and the interior surface 6970 of the front portion 6870 may be spaced apart by a distance of about 0.100 inch (2.54 mm). In another example, the distance between the wall structure 6930 and the interior surface 6970 of the front portion 6870 may be greater than or equal to 0.050 inch (1.27 mm) and less than or equal to 0.300 inch (7.62 mm). In yet another example, the distance between the wall structure 6930 and the interior surface 6970 of the front portion 6870 may be greater than or equal to 0.050 inch (1.27 mm). In yet another example, the distance between the wall structure 6930 and the interior surface 6970 of the front portion 6870 may be less than or equal to 0.300 inch (7.62 mm). The distance between the wall structure 6930 and the interior surface 6970 of the front portion 6870 may be uniform, nonuniform, or a combination thereof. The apparatus, methods, and articles of manufacture described herein are not limited in this regard.

The wall structure 6930 may have a height measured from the bottom interior surface 7140 of the bottom portion 6840 to the tip portion 7132. The wall structure 6930 may have a height greater than or equal to 0.200 inch (5.08 mm) and less than or equal to 0.400 inch (10.16 mm). In one example, the height of the wall structure 6930 may be about 0.280 inch (7.11 mm). In another example, the height of the wall structure 6930 may be greater than or equal to 0.200 inch (5.08 mm). In yet another example, the height of the wall structure 6930 may be less than or equal to 0.400 inch (10.16 mm). In yet another example, the height of the wall structure 6930 may be greater than 0.200 inch (5.08 mm) and less than 0.400 inch (10.16 mm). The height of the wall structure 6930 may be uniform, nonuniform, or a combination thereof. The apparatus, methods, and articles of manufacture described herein are not limited in this regard.

Figure 70:
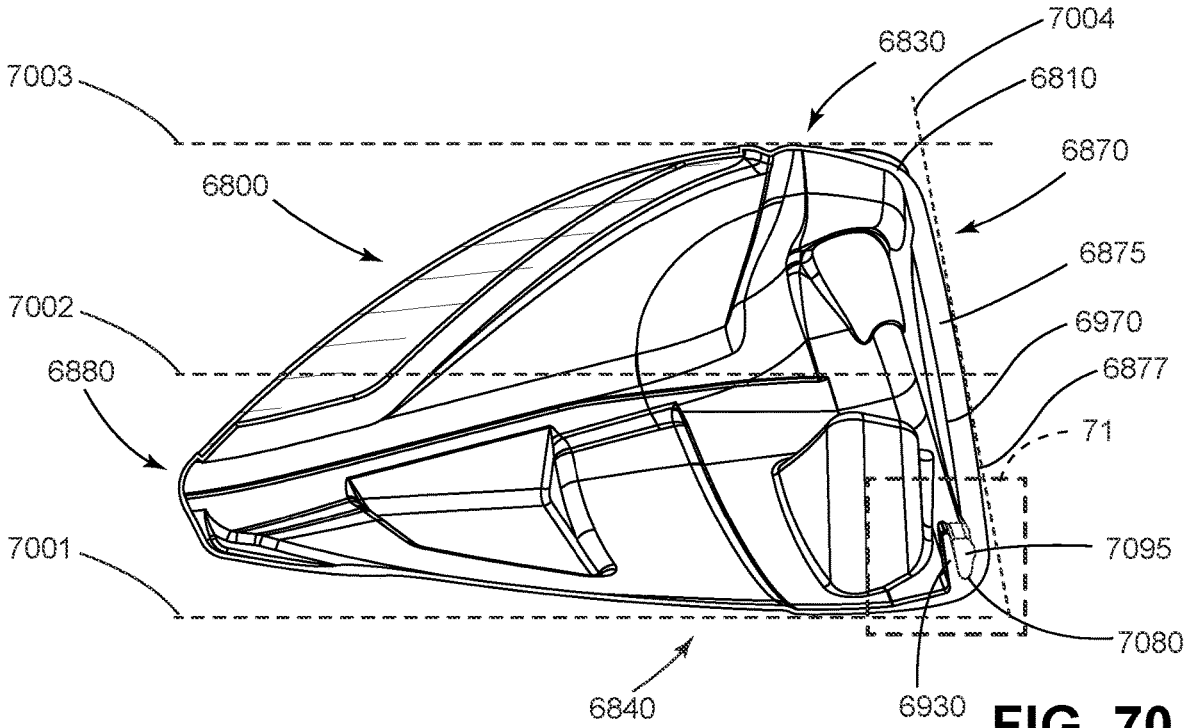
FIG. 70 depicts a schematic cross-sectional side view of the example of golf club head of FIG. 68 along line 70-70.
Figure 71:
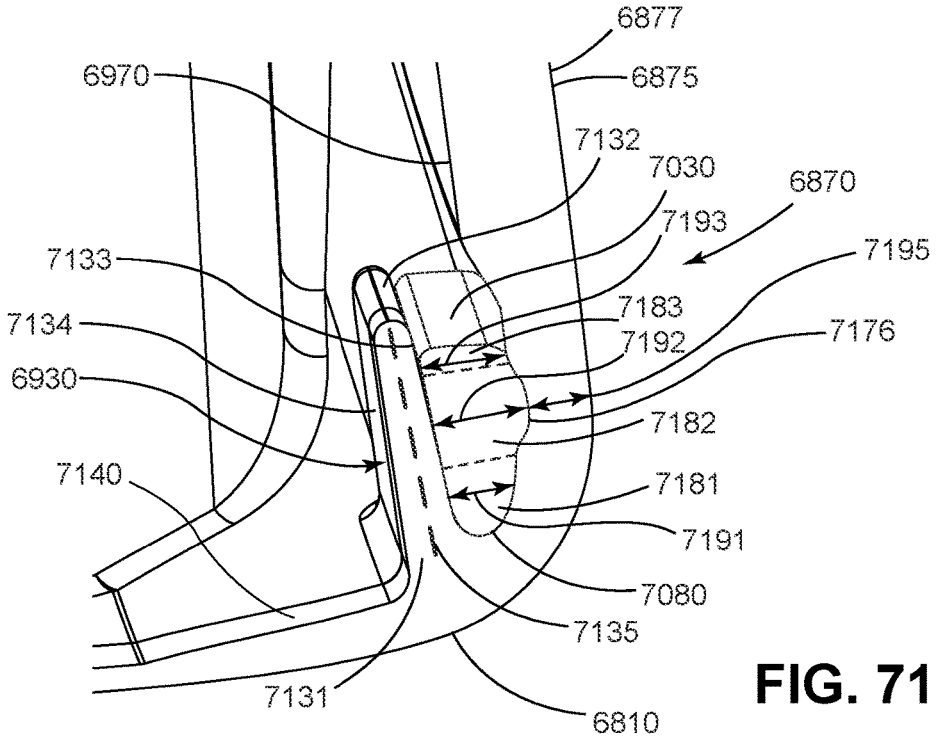
FIG. 71 depicts an enlarged view of area 71 of FIG. 70.

Referring to FIG. 70, for example, the golf club head 6800 may be associated with a ground plane 7001, a horizontal midplane 7002, and a top plane 7003. In particular, the ground plane 7001 may be a tangential plane to the bottom portion 6840 of the golf club head 6800 when the golf club head is at an address position (e.g., the golf club head 6800 is aligned to strike a golf ball). A top plane 7003 may be a tangential plane to the top portion of the 6830 of the golf club head 6800 when the golf club head is at the address position. The ground and top planes 7001 and 7003, respectively, may be substantially parallel to each other. A horizontal midplane 7002 may be vertically halfway between the ground and top planes 7001 and 7003, respectively. The wall structure 6930 may be located above the ground plane 7001 and below the horizontal midplane 7002.

The golf club head 6800 may include a cutaway portion 7176 located on the interior surface 6970 of the front portion 6870. The cutaway portion 7176 may be a groove. The cutaway portion 7176 may extend laterally between the toe portion 6850 and the heel portion 6860. The cutaway portion 7176 may be located within the channel 7080. The cutaway portion 7176 may be located within the middle channel region 7182. The cutaway portion 7176 may correspond to a minimum thickness region ($T_{min}$) 7195 of the front portion 6870. The apparatus, methods, and articles of manufacture described herein are not limited in this regard.

The channel 7080 may have a lower channel region 7181, a middle channel region 7182, and an upper channel region 7183. The lower channel region 7181 may have a first maximum width ($W_1$) 7191. The middle channel region 7182 may have a second maximum width ($W_2$) 7192. The upper channel region 7183 may have a third maximum width ($W_3$) 7193. The second maximum width ($W_2$) 7192 may correspond to a location of the cutaway portion 7176. The second maximum width 7192 may be greater than the first maximum width 7191. The second maximum width 7192 may be greater than the third maximum 7193 width. The second maximum width 7192 may be greater than the first maximum width 7191 and greater than the third maximum width 7193. The apparatus, methods, and articles of manufacture described herein are not limited in this regard.

The channel 7080 between the wall structure 6930 and the interior surface 6970 of the front portion 6870 may be partially or entirely filled with a filler material 7095. In one example, a top surface 7030 of the filler material 7095 may be located below the tip portion 7132 of the wall structure 6930. The filler material 7095 may be an elastic material that compresses against the wall structure 6930 when the face portion 6875 strikes a golf ball, thereby improving resiliency of the face portion 6875 and allowing the use of a thinner face portion 6875 without compromising durability. Compression of the filler material 7095 may aid the face portion 6875 in imparting more energy to the golf ball resulting in increased ball speed. To encourage compression of the filler material 7095, the wall structure 6930 may be constructed from a rigid and durable material, such as, but not limited to, titanium or other metal material. The apparatus, methods, and articles of manufacture described herein are not limited in this regard.

The cutaway portion 7176 may enhance a coefficient of restitution of the golf club head 6800. For example, the cutaway portion 7176 may permit greater deflection of the face portion 6875 during impact and thereby enable the face portion to impart more energy to the golf ball, resulting in increased ball speed. The cutaway portion 7176 may also aid in retaining the filler material 7095 within the channel 7080. For instance, the cutaway portion 7176 may allow the filler material 7095 in the middle channel region 7182 to be wider than the filler material in the upper channel region 7183, which may aid in retaining the filler material 7095 in the channel 7080 during use when deflection of the face portion 6875 may occur. The apparatus, methods, and articles of manufacture described herein are not limited in this regard.

Figure 72:
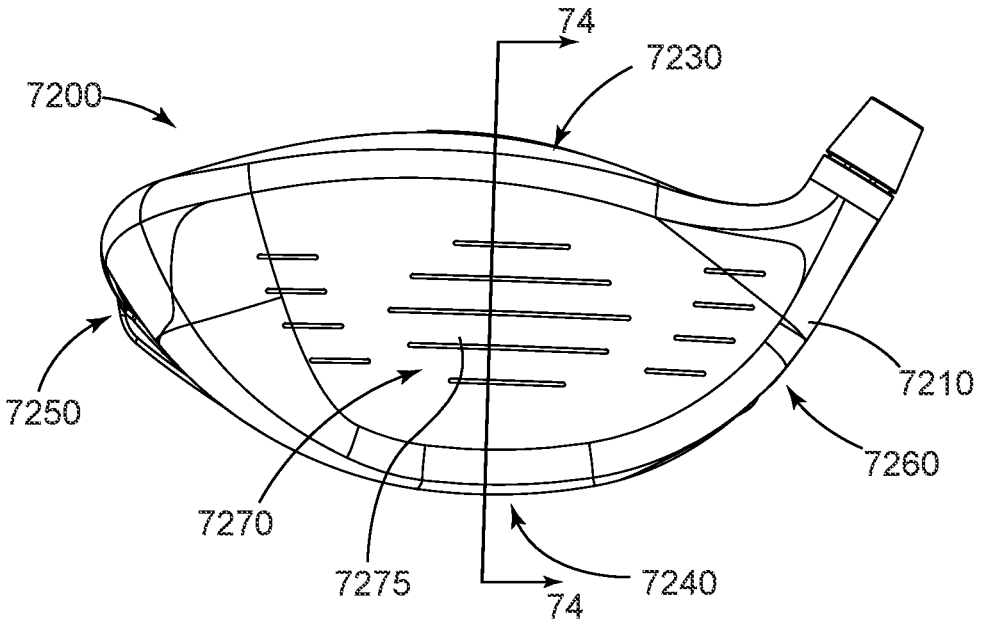
FIG. 72 depicts a front view of a golf club head according to another embodiment of the apparatus, methods, and articles of manufacture described herein.
Figure 73:
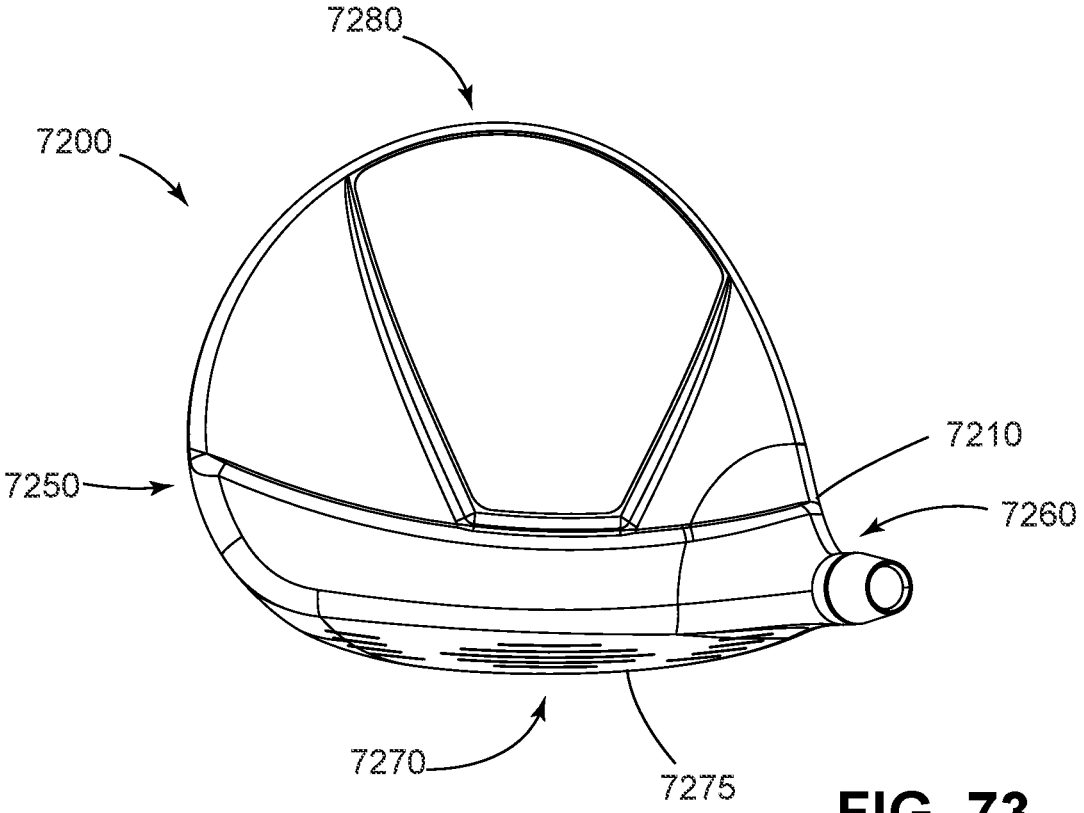
FIG. 73 depicts a top view of the example golf club head of FIG. 72.
Figure 74:
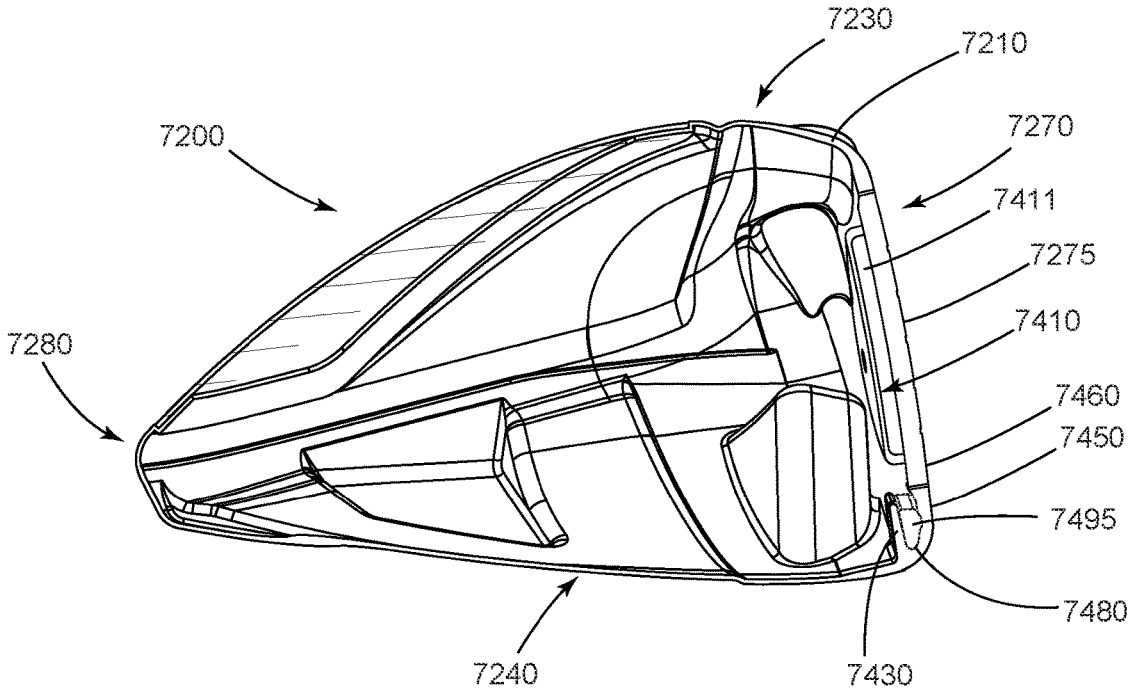
FIG. 74 depicts a schematic cross-sectional side view of the example golf club head of FIG. 72 along line 74-74.

In the example of FIGS. 72-74, a golf club head 7200 may include a body portion 7210 having a top portion 7230, a bottom portion 7240, a toe portion 7250, a heel portion 7260, a front portion 7270, and a rear portion 7280. The front portion 7270 may include a face portion 7275 with which to strike a golf ball (not shown). The face portion 7275 may be configured according to any of the examples described herein. For exemplary purposes, the face portion 7275 may include an outer face plate 7450 that encloses an inner face plate 7460. The outer and inner face plates may be similar to the outer and inner face plates 6350 and 6360 described with reference to the example golf club head 6200 of FIGS. 62-67. The golf club head 7200 may include a pocket structure 7410 similar to the pocket structure 6400 described with reference to the example golf club head 6200 of FIGS. 62-67. The pocket structure 7410 may include a filler material 7411 similar to the filler material in the pocket structure 6400 described with reference to the example golf club head 6400 of FIGS. 64-67. The golf club head 7200 may include a wall structure 7430 similar to the wall structure 6930 described with reference to the example golf club head 6800 of FIGS. 68-71. The golf club head 7200 may include a channel 7480 similar to the channel 7080 described with reference to the example golf club head 6800 of FIGS. 68-71. The channel 7480 may include a filler material 7495 similar to the filler material 7095 described with reference to the example golf club head 6800 of FIGS. 68-71. The apparatus, methods, and articles of manufacture described herein are not limited in this regard.

The apparatus, methods, and articles of manufacture described herein may include one or more club identifiers (e.g., a serial number, a matrix barcode, a brand name, a model, a club number, a loft angle, a character, etc.). For example, any of the golf club heads described herein may include a visual indicator such as a club number to identify the type of golf club. In one example, the club number may correspond to the loft angle of the golf club head (e.g., 3, 4, 5, 6, 7, 8, or 9). In one example, a 7-iron type golf club head may be marked with "7". In another example, a 54-degree wedge type golf club head may be marked "54". In yet another example, a 10.5-degree driver type golf club head may be marked "10.5." Any marking(s) associated with a club identifier may be visually differentiated (e.g., different color, texture, pattern, etc.) from the rest of the golf club head. The club identifier may be a trademark to identify a brand or a model of the golf club head. The club identifier may be another type of visual indicator such as a product number or a serial number to identify the golf club head as authentic equipment, to track inventory, or to distinguish the golf club head from fake or counterfeit products. Alternatively, the club identifier may be a digital signature or a machine-readable optical representation of information or data about the golf club head (e.g., numeric character(s), alphanumeric character(s), byte(s), a one-dimensional barcode such as a Universal Product Code (UPC), a two-dimensional barcode such as a Quick Response (QR) code, etc.). The club identifier may be placed at various locations on the golf club head (e.g., the hosel portion the face portion the sole portion etc.) using various methods (e.g., laser etched, stamped, casted, or molded onto the golf club head). For example, the club identifier may be a serial number laser etched onto the hosel portion of the golf club head. Instead of being an integral part of the golf club head, the club identifier may be a separate component coupled to the golf club head (e.g., a label adhered via an adhesive or an epoxy).

The terms "and" and "or" may have both conjunctive and disjunctive meanings. The terms "a" and "an" are defined as one or more unless this disclosure indicates otherwise. The term "coupled" and any variation thereof refer to directly or indirectly connecting two or more elements chemically, mechanically, and/or otherwise. The phrase "removably connected" is defined such that two elements that are "removably connected" may be separated from each other without breaking or destroying the utility of either element.

The term "substantially" when used to describe a characteristic, parameter, property, or value of an element may represent deviations or variations that do not diminish the characteristic, parameter, property, or value that the element may be intended to provide. Deviations or variations in a characteristic, parameter, property, or value of an element may be based on, for example, tolerances, measurement errors, measurement accuracy limitations and other factors. The term "proximate" is synonymous with terms such as "adjacent," "close," "immediate," "nearby", "neighboring", etc., and such terms may be used interchangeably as appearing in this disclosure.

The apparatus, methods, and articles of manufacture described herein may be implemented in a variety of embodiments, and the foregoing description of some of these embodiments does not necessarily represent a complete description of all possible embodiments. Instead, the description of the drawings, and the drawings themselves, disclose at least one embodiment, and may disclosure alternative embodiments.

As the rules of golf may change from time to time (e.g., new regulations may be adopted or old rules may be eliminated or modified by golf standard organizations and/or governing bodies such as the USGA, the R&A, etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

Further, while the above examples may be described with respect to golf clubs, the apparatus, methods and articles of manufacture described herein may be applicable to other suitable types of sports equipment such as a fishing pole, a hockey stick, a ski pole, a tennis racket, etc.

Although certain example apparatus, methods, and articles of manufacture have been described herein, the scope of coverage of this disclosure is not limited thereto. On the contrary, this disclosure covers all apparatus, methods, and articles of articles of manufacture fairly falling within the scope of the appended claims either literally or under the doctrine of equivalents.

What is claimed is:

1. A golf club head comprising:

a body portion comprising a top portion, a bottom portion, a toe portion, a heel portion, a front portion, and a rear portion, the front portion comprising an exterior surface and an interior surface;

a cutaway portion on the interior surface of the front portion, the cutaway portion extending laterally between the heel portion and the toe portion, the cutaway portion corresponding to a minimum thickness region of the front portion;

a wall structure located within a body cavity of the body portion and extending upward from a bottom interior surface of the body portion into the body cavity, the wall structure having a base portion and a tip portion opposite the base portion, the base portion located at or proximate to the bottom interior surface of the body portion, the wall structure extending laterally between the toe portion and the heel portion, a distance between the wall structure and the front portion being less than a distance between the wall structure and the rear portion, the wall structure located below a horizontal midplane of the golf club head;

a channel between the wall structure and the interior surface of the front portion, the channel having a lower channel region, a middle channel region, and an upper channel region, the lower channel region having a first maximum width, the middle channel region having a second maximum width, the upper channel region having a third maximum width, the second maximum width being greater than the first maximum width, and the second maximum width being greater than the third maximum width; and a filler material in the channel and extending from the lower channel region to the upper channel region and filling the cutaway portion.

2. A golf club head as defined in claim 1 further comprising a pocket structure coupled to the interior surface of the front portion, the pocket structure comprising a perimeter side wall extending rearward from the interior surface of the front portion and a back wall joined to the perimeter side wall to form a pocket cavity between the back wall and the front portion, the pocket cavity comprising a second filler material.

3. A golf club head as defined in claim 1, wherein the front portion comprises an outer face plate joined to an inner face plate, the inner face plate enclosing a central opening in the outer face plate.

4. A golf club head as defined in claim 1, wherein the cutaway portion is a groove.

5. A golf club head as defined in claim 1, wherein the filler material comprises an elastomer material.

6. A golf club head as defined in claim 1, wherein a height of the wall structure is greater than or equal to 5.08 mm and less than or equal to 10.16 mm.

7. A golf club head as defined in claim 1, wherein the wall structure is spaced rearward of the interior surface of the front portion by a distance of greater than or equal to 1.27 mm and less than or equal to 7.62 mm.

8. A golf club head comprising:

a body portion comprising a top portion, a bottom portion, a toe portion, a heel portion, a front portion, and a rear portion, the front portion comprising an exterior surface and an interior surface;

a wall structure located within a body cavity of the body portion and extending upward from a bottom interior surface of the body portion into the body cavity, the wall structure having a base portion and a tip portion opposite the base portion, the base portion located at or proximate to the bottom interior surface of the body portion, the wall structure extending laterally between the toe portion and the heel portion, a distance between the wall structure and the front portion being less than a distance between the wall structure and the rear portion, the wall structure located below a horizontal midplane of the golf club head;

a channel between the wall structure and the interior surface of the front portion, the channel having a lower channel region, a middle channel region, and an upper channel region, the lower channel region having a first maximum width, the middle channel region having a second maximum width, the upper channel region having a third maximum width, the second maximum width being greater than the first maximum width, and the second maximum width being greater than the third maximum width; and a filler material in the channel and extending from the lower channel region to the upper channel region and from the interior surface of the front portion to the wall structure.

9. A golf club head as defined in claim 8 further comprising a groove on the interior surface of the front portion, the groove located within the channel, the groove extending laterally between the heel portion and the toe portion, the groove corresponding to a minimum thickness region of the front portion, the filler material filling the groove.

10. A golf club head as defined in claim 8 further comprising a pocket structure coupled to the interior surface of the front portion, the pocket structure comprising a perimeter side wall extending rearward from the interior surface of the front portion and a back wall joined to the perimeter side wall to form a pocket cavity between the back wall and the front portion, the pocket cavity comprising a second filler material.

11. A golf club head as defined in claim 8, wherein the front portion comprises an outer face plate joined to an inner face plate, the inner face plate enclosing a central opening in the outer face plate.

12. A golf club head as defined in claim 8, wherein the filler material comprises an elastomer material.

13. A golf club head as defined in claim 8, wherein a centerline of the wall structure is substantially parallel to a front plane that is tangential to the exterior surface of the front portion.

14. A golf club head as defined in claim 8, wherein the wall structure is spaced rearward of the interior surface of the front portion by a distance of greater than or equal to 1.27 mm and less than or equal to 7.62 mm.

15. A golf club head comprising:

a body portion comprising a top portion, a bottom portion, a toe portion, a heel portion, a front portion, and a rear portion, the front portion comprising an exterior surface and an interior surface;

a pocket structure coupled to the interior surface of the front portion, the pocket structure comprising a perimeter side wall extending rearward from the interior surface of the front portion and a back wall joined to the perimeter side wall to form a pocket cavity between the back wall and the front portion, the pocket cavity comprising a first filler material;

a wall structure located within a body cavity of the body portion and extending upward from a bottom interior surface of the body portion into the body cavity, the wall structure having a base portion and a tip portion opposite the base portion, the base portion located at or proximate to the bottom interior surface of the body portion, the wall structure extending laterally between the toe portion and the heel portion, a distance between the wall structure and the front portion being less than a distance between the wall structure and the rear portion, the wall structure located below a horizontal midplane of the golf club head;

a channel between the wall structure and the interior surface of the front portion, the channel having a lower channel region, a middle channel region, and an upper channel region, the lower channel region having a first maximum width, the middle channel region having a second maximum width, the upper channel region having a third maximum width, the second maximum width being greater than the first maximum width, and the second maximum width being greater than the third maximum width; and a second filler material in the channel and extending from the lower channel region to the upper channel region and from the interior surface of the front portion to the wall structure.

16. A golf club head as defined in claim 15, wherein the front portion comprises an outer face plate joined to an inner face plate, the inner face plate enclosing a central opening in the outer face plate.

17. A golf club head as defined in claim 15, wherein the first filler material comprises an elastomer material.

18. A golf club head as defined in claim 15, wherein the second filler material comprises an elastomer material.

19. A golf club head as defined in claim 15 further comprising a groove on the interior surface of the front portion, the groove located within the channel, the groove extending laterally between the heel portion and the toe portion, the groove corresponding to a minimum thickness region of the front portion, the second filler material filling the groove.

20. A golf club head as defined in claim 15, wherein the front portion comprises a minimum thickness region below the horizontal midplane and proximate to the middle channel region.

* * * * *